US007856786B2

(12) United States Patent
Beck et al.

(10) Patent No.: US 7,856,786 B2
(45) Date of Patent: Dec. 28, 2010

(54) WALL AND FLOOR CONSTRUCTION ARRANGEMENTS AND METHODS

(75) Inventors: John R. Beck, Indiana, PA (US); Michael D. Whitticar, Cleveland Heights, OH (US)

(73) Assignee: Dietrich Industries, Inc., Columbus, OH (US)

( * ) Notice: Subject to any disclaimer, the term of this patent is extended or adjusted under 35 U.S.C. 154(b) by 1332 days.

(21) Appl. No.: 11/019,143

(22) Filed: Dec. 21, 2004

(65) Prior Publication Data

US 2006/0016139 A1 Jan. 26, 2006

Related U.S. Application Data

(63) Continuation-in-part of application No. 10/823,449, filed on Apr. 13, 2004, now Pat. No. 7,716,899.

(60) Provisional application No. 60/462,770, filed on Apr. 14, 2003.

(51) Int. Cl.
*E04H 12/00* (2006.01)

(52) U.S. Cl. ..... 52/650.1; 52/236.3; 52/92.1; 52/93.1; 52/293.3; 52/656.9; 52/741.13; 52/289; 52/702

(58) Field of Classification Search ..... 52/289, 52/702, 272, 655.1, 696, 712, 262, 264, 277, 52/278, 474, 489.2, 92.1, 93.1, 236.3, 293.3, 52/656.9, 741.13, 650.1, 649.1, 651.11, 656.1
See application file for complete search history.

(56) References Cited

U.S. PATENT DOCUMENTS 1,406,989 A * 2/1922 Lichtenberg et al. ..... 52/576
1,682,202 A 8/1928 Vaughn
2,145,407 A 1/1939 Soule (Continued)

FOREIGN PATENT DOCUMENTS

CA 1192015 8/1985

(Continued)

OTHER PUBLICATIONS

Steve Maxwell, The Big Job—Carpenters Show Their Metal, Apr.-Jun. 2005, pp. 26-29, vol. 125, No. 2 Carpenter Magazine, U.S.A.

(Continued)

*Primary Examiner*—Richard E Chilcot, Jr.
*Assistant Examiner*—Chi Q Nguyen
(74) *Attorney, Agent, or Firm*—K&L Gates LLP

(57) ABSTRACT

Various floor and wall constructions are disclosed. One embodiment includes a second vertical wall supported over a first vertical wall. One or more joist rims may be attached to the first vertical wall and pluralities of joists may be attached to the joist rims. Decking material may be supported on the plurality of joists. The second vertical wall may be fabricated from spaced second studs that extend between a top track and a bottom track. The bottom track comprises a web and two upstanding legs. The ends of the second studs serve to define open areas within the bottom track between the respective stud ends. A cementitious material may be applied onto the decking material and into the open areas within the bottom track to form the floor surfaces and barriers within the open areas.

37 Claims, 47 Drawing Sheets

U.S. PATENT DOCUMENTS

| | | | | |
|---|---|---|---|---|
| 2,185,475 | A | | 1/1940 | Rafter |
| 2,966,708 | A | | 1/1961 | Freeman, Jr. |
| 3,083,794 | A | | 4/1963 | Stovall, Jr. |
| 3,668,828 | A | | 6/1972 | Nicholas et al. |
| 3,717,964 | A | | 2/1973 | Brown et al. |
| 3,751,870 | A | | 8/1973 | Vesei |
| 3,845,601 | A | | 11/1974 | Kostecky |
| 3,908,328 | A | | 9/1975 | Nelsson |
| 4,016,700 | A | | 4/1977 | Blomstedt |
| 4,058,941 | A | | 11/1977 | Zakrzewski et al. |
| 4,075,810 | A | | 2/1978 | Zakrzewski et al. |
| 4,078,347 | A | | 3/1978 | Eastman et al. |
| 4,120,131 | A | | 10/1978 | Carroll |
| 4,179,858 | A | * | 12/1979 | Graham et al. ..... 52/262 |
| 4,197,952 | A | | 4/1980 | De Fouw et al. |
| 4,235,054 | A | | 11/1980 | Cable et al. |
| 4,276,730 | A | * | 7/1981 | Lewis ..... 52/220.2 |
| 4,288,958 | A | | 9/1981 | Chalmers et al. |
| 4,385,476 | A | | 5/1983 | Slager |
| 4,551,957 | A | | 11/1985 | Madray |
| 4,616,453 | A | | 10/1986 | Sheppard, Jr. et al. |
| 4,688,358 | A | | 8/1987 | Madray |
| 4,761,928 | A | | 8/1988 | Pichette |
| 4,793,113 | A | | 12/1988 | Bodnar |
| 4,866,899 | A | | 9/1989 | Houser |
| 4,909,007 | A | | 3/1990 | Bodnar |
| 4,918,899 | A | | 4/1990 | Karytinos |
| 5,048,257 | A | | 9/1991 | Luedtke |
| 5,113,631 | A | | 5/1992 | diGirolamo et al. |
| 5,195,293 | A | | 3/1993 | diGirolamo et al. |
| 5,207,045 | A | | 5/1993 | Bodnar |
| 5,274,973 | A | | 1/1994 | Liang |
| 5,313,752 | A | | 5/1994 | Hatzinikolas |
| 5,353,560 | A | | 10/1994 | Heydon |
| 5,394,665 | A | | 3/1995 | Johnson |
| 5,402,612 | A | | 4/1995 | diGirolamo et al. |
| 5,412,919 | A | | 5/1995 | Pellock et al. |
| 5,426,906 | A | | 6/1995 | McCracken |
| 5,527,625 | A | | 6/1996 | Bodnar |
| 5,592,848 | A | | 1/1997 | Bodnar |
| 5,596,859 | A | | 1/1997 | Horton et al. |
| 5,687,538 | A | | 11/1997 | Frobosilo et al. |
| 5,689,922 | A | | 11/1997 | Daudet |
| 5,715,642 | A | * | 2/1998 | Buers ..... 52/633 |
| 5,784,850 | A | | 7/1998 | Elderson |
| 5,857,306 | A | | 1/1999 | Pellock |
| 5,950,385 | A | | 9/1999 | Herren |
| 5,956,916 | A | | 9/1999 | Liss |
| 6,003,280 | A | | 12/1999 | Wells |
| 6,021,618 | A | | 2/2000 | Elderson |
| D423,325 | S | | 4/2000 | Liss |
| 6,131,358 | A | | 10/2000 | Wise |
| 6,176,053 | B1 | | 1/2001 | St. Germain |
| 6,301,854 | B1 | | 10/2001 | Daudet et al. |
| 6,354,055 | B1 | | 3/2002 | Shaw et al. |
| 6,418,694 | B1 | | 7/2002 | Daudet et al. |
| 6,460,297 | B1 | | 10/2002 | Bonds et al. |
| 6,691,478 | B2 | | 2/2004 | Daudet et al. |
| 6,739,105 | B2 | | 5/2004 | Fleming |
| 6,761,005 | B1 | | 7/2004 | Daudet et al. |
| 6,959,515 | B1 | | 11/2005 | Beighton |
| 7,383,665 | B2 | | 6/2008 | Frobosilo |
| 2003/0024174 | A1 | | 2/2003 | Bonds et al. |
| 2004/0074178 | A1 | | 4/2004 | Daudet et al. |
| 2004/0163356 | A1 | * | 8/2004 | Rice ..... 52/720.1 |
| 2004/0200172 | A1 | | 10/2004 | Beck et al. |
| 2006/0016139 | A1 | * | 1/2006 | Beck et al. ..... 52/289 |
| 2006/0185267 | A1 | * | 8/2006 | Tonyan et al. ..... 52/90.1 |
| 2007/0294974 | A1 | * | 12/2007 | Tonyan et al. ..... 52/481.1 |
| 2008/0028702 | A1 | * | 2/2008 | Daudet ..... 52/210 |
| 2008/0060288 | A1 | * | 3/2008 | Frobosilo ..... 52/204.1 |
| 2010/0037546 | A1 | | 2/2010 | Beck et al. |

FOREIGN PATENT DOCUMENTS

| | | | |
|---|---|---|---|
| CA | 2077170 | | 3/1994 |
| GB | 2128219 | A | 4/1984 |
| GB | 2171731 | A | 9/1986 |
| GB | 2192916 | A | 1/1988 |
| JP | 6-49908 | | 2/1994 |
| JP | 9-4067 | | 1/1997 |

OTHER PUBLICATIONS

International Search Report for PCT/US05/18266, Aug. 21, 2008 (4 pages).
Steel Framing Systems, Technical Information, Unimast Corporation, 1991 (13 pages).
Light Gage Steel Framing Typical Construction Details, Dietrich Industries, Inc., 1994 (36 pages).
Stud-Rite™ Lightweight Steel Framing, Marino Industries Corporation, MIAD 82 (2 pages).
"Prescriptive Method for Residential Cold-formed Steel Framing," Second Edition, U.S. Department of Housing and Urban Development, Office of Policy Development and Research, Sep. 1997 (108 pages).
Builder's Guide to Lightweight Zinc-Coated Steel, Residential Steel Frame Construction, 1982 (29 pages).
Cemco Steel Framing Systems, 1996 (60 pages).
Clark Structural Framing, Clark Steel Framing Systems, Mar. 1995 (15 pages).
Angeles Metal Systems, Steel Frame Program (4 pages).
Angeles Metal Systems, Technical Data Sheet, 1984 (12 pages).
Monex Corporation, Monex Steel Framing (19 pages).
E.N. Lorre, Residential Steel Framing Construction Guide, Aegean Park Press, 1993 (80 pages).
Low-Rise Residential Construction Details, Technical Data, Publication RG-934, Jun. 1993 (50 pages).
Builders' Guide to Residential Steel Floors, U.S. Department of Housing and Urban Development, Office of Policy Development and Research, Dec. 1999 (42 pages).
Final Office Action mailed on Sep. 1, 2009 in U.S. Appl. No. 10/823,449.
Amendment filed Feb. 22, 2010 along with Request for Continued Examination in U.S. Appl. No. 10/823,449.
Notice of Allowance was mailed on Feb. 26, 2010 in U.S. Appl. No. 10/823,449.
Non-Final Office Action was mailed on Jun. 25, 2010 in U.S. Appl. No. 12/548,694.

* cited by examiner 1410
1411
1412
1414
1416
1420
1430
1432
1434
1436
1438
1440
1450
1452
1454
1456
1460
1462
1464
1466
1470
1472
1474
1478
1480
1482
1484
1486
1490
1499
1500
1502
1504
1508
1590
40
41
42
42A

CONDITION 1

CONDITION 2

CONDITION 3

WALL AND FLOOR CONSTRUCTION ARRANGEMENTS AND METHODS

CROSS-REFERENCE TO RELATED APPLICATIONS

This application is a continuation-in-part application of U.S. patent application Ser. No. 10/823,449, filed Apr. 13, 2004, now U.S. Pat. No. 7,716,899, entitled Building Construction Systems and Methods which claims priority and benefit under 35 U.S.C. §119(e) from U.S. Provisional Patent Application Ser. No. 60/462,770, filed Apr. 14, 2003, the disclosures of which are herein incorporated by reference.

BACKGROUND

1. Field of the Invention

The various embodiments of the subject invention relate to building components, building systems and construction methods and, more particularly, to floor systems, wall framing and panelization arrangements, details and methods used to construct buildings.

2. Description of the Invention Background

In the past, the construction materials of choice for new residential and commercial building construction have been, for example, wood, concrete blocks, structural tubes and frames, etc. In recent years, in an effort to address problems commonly associated with wood (i.e., inadequate supplies of desired lengths and sizes of wood beams, insect damage, fire damage, etc.), various alternative building materials and construction methods have been developed. For example, so-called cold-formed or "light gauge" steel framing components have been developed to replace wood joists, studs, etc. In many cases, however, regardless of the compositions of the components employed, the framing methods were generally the same. Thus, while the development of steel components effectively addressed the above-mentioned problems often associated with wood, the framing methods employed when using steel components still contained various inefficiencies associated with prior wood framing methods.

For example, one wood framing method that was commonly employed in the past is known as "balloon framing". In balloon framing applications, long continuous framing members extend from the sill to eave line with intermediate floor structures being nailed to them. FIGS. 1 and 2 illustrate a prior balloon frame arrangement for a two-story structure 1 wherein wood studs 2 extend from a mud sill plate 3 that is fastened to the foundation 4. A series of wood floor joists 5 are nailed to the inside surfaces of corresponding studs 2. Sheathing materials 6 may then be nailed to the exterior sides of the studs 2. Insulation material (not shown) is also typically placed in the spaces between the studs and then lath boards and plaster or drywall, etc. is attached to the studs to form the interior wall surfaces. Floor decking material 7 such as plywood may be attached to the top surfaces of the joists to form the floor surface or in other applications, the floor surface may be formed by pouring concrete over decking material or using pre-stressed concrete slabs, etc. Because such framing arrangement resulted in relatively unobstructed passageways between the studs through which fire may pass from the lower floor to the upper floors, present fire codes typically require that fire blocks be installed between the studs to interrupt those passages. FIG. 2 illustrates such a fire block which may comprise a board 8 and a fire blocking board 9 that are nailed to adjacent studs 2 and extend therebetween to block the passageway.

FIG. 3 illustrates a section of a balloon-framed wall 10 fabricated from cold-formed steel framing members. As can be seen in that Figure, the upper ends of C-shaped studs 11 forming the wall associated with the lower story area are received and affixed to a C-shaped upper track 12. C-shaped floor joists 14 are then attached to the web portions 13 of the studs 11 as shown to support floor decking material (not shown). A ledger angle 15 may be used to support the floor joists 14 during erection. To form the wall for the next story, a lower track 16 is placed in back-to-back fashion over the upper track 12 and the lower ends of C-shaped studs 17 are attached to the lower track as shown. As can be seen in that Figure, the upper studs 17 are aligned with the lower studs 11. In addition, L-shaped angles 18 may be affixed to the adjacent flange portions of the upper and lower tracks for receiving the ends of the floor substrate materials (not shown).

Another type of framing method that originated with wood building construction is "platform-type" framing. In platform-type construction, each floor acts as a working platform for the construction of the next story. FIG. 4 illustrates an example of a prior "platform-framed" two-story building 20 fabricated from lightweight steel framing components. As can be seen in that Figure, the lower wall 21 is formed from spaced steel studs 22 that extend between and are fastened to an upper C-shaped track 23 and a lower C-shaped track 24. A C-shaped rim member 25 is supported on the web of the upper track 23. A plurality of floor joists 29 are supported by the lower wall 21 below and attached to the rim 25 with C-shaped clip angles. If necessary, separate web stiffeners are used as shown to prevent the web of the rim from crippling under load. Other joist rims, such as those disclosed in U.S. Pat. No. 6,301,854 to Daudet et al. could also be employed.

FIG. 5 depicts a "load bearing" exterior wall which could be employed in the structure 20 of FIG. 4. As can be seen FIG. 5, the tops of the vertically extending studs 22 are received in and attached to the upper track 23. The C-shaped rim 25 is supported on and attached to the web of the upper track 23 as shown. The rim 25 has a web 26 and a lower flange 27 and an upper flange 28. The C-shaped floor joists 29 are affixed to the web 26 of the rim 25 with a corresponding clip angles (not shown). In addition to prevent the web of the rim 25 from crippling under load, a web stiffener 31 is attached to the web 26 of the rim 25 and the web 30 of the corresponding joist 29. The wall for the second story is formed from a plurality of studs 33 that extend between another lower track 32 that is attached to the upper flange 28 of the rim 25 and an upper track 34. In addition, L-shaped angles 36', commonly referred to as "pour stops" may be affixed to the lower track 32 and joists 29 for receiving the ends of a concrete slab 35 poured over metal decking 35' or the like. Lateral bridging members 37, such as those disclosed in U.S. Pat. No. 5,784,850 to Elderson or U.S. Pat. No. 6,021,618 to Elderson or other known lateral bridging member arrangements may extend through openings in the studs 22 and 33 and engage the webs thereof to provide lateral support to the studs 22 and 33. See FIG. 4. Lateral bridging members 37 of the types mentioned above may extend through openings 36 in the studs 33.

FIG. 6 depicts a prior load bearing interior wall configuration. As can be seen in that Figure, the top ends of vertical load bearing studs 40 are received in a top track 41. A pair of C-shaped rims 42, 43 are arranged in back-to-back fashion and are attached to the top track 41 as shown. A bottom track 44 for the next story wall is affixed to the top flanges of the rims 42, 43 and the bottoms of vertically extending studs 45 are aligned with corresponding studs 40 and are affixed to the bottom track 44 as shown. Joists 46 are attached to the rims 42, 43 via clip angles (not shown). As can be seen in this Figure, web stiffeners 47 are attached to the webs of the joists 46 and oriented as shown to prevent crippling of the rims. Concrete 48 is then poured over steel decking material or precast concrete slabs may be installed to form the floor. In other arrangements, depending upon the loading characteristics, web stiffeners may not be employed. Other arrangements may employ joist rims of the type described above, wherein joist attachment tabs are integrally formed in the web of the joist rim.

FIG. 6A depicts another prior framing arrangement wherein a rim track 25' is attached to the flanges of upstanding studs 22'. The tops of the studs 22' are attached to an upper track 23'. As can be seen in that Figure, the upper flange of the rim track 25' is offset below the web of the upper track 23' to form a ledge for abutting the floor decking material 31' against it. An upper wall is formed from a lower track 32' that has a plurality of upper studs 33' attached thereto. A plurality of C-shaped floor joists 29' are affixed to the web of the rim 25' with conventional clip angles 34'.

FIG. 6B depicts yet another prior framing arrangement wherein a C-shaped floor joist 29" is attached to the flanges of upstanding studs 22". The tops of the studs 22" are attached to an upper track 23". As can be seen in that Figure, the upper flange of the floor joist 29" is offset below the web of the upper track 23" to form a ledge for abutting the floor decking material 31" against it. An upper wall is formed from a lower track 32" that has a plurality of upper studs 33" attached thereto.

FIG. 7 depicts a prior load bearing wall arrangement 50 that has a window opening 51 therein. As can be seen in FIGS. 7, 8 and 9, the wall 50 has a lower track 52 that is attached to a foundation or other support structure (not shown) and an upper track 53 that supports a plurality of joists 54 thereon. A plurality of vertically extending studs 55 extend between the upper and lower tracks 52, 53 and are attached thereto. Lateral bridging members 56 of the types described above or the like extend through openings in the studs 55 and engage the stud webs thereof to provide lateral support to the studs. The window opening 51 is formed by a pair (or other arrangements) of jack studs 57 on each side of the opening 51. A sill track 58 (formed from a C-shaped track) or other built-up arrangement extends between the jack studs 57 and is attached thereto to define the lower end of the window opening 51. A plurality of lower cripple studs 59 extend between the lower track 52 and the sill track 58. A head track 60 (which may be provided as shown or which may comprise a built-up arrangement) extends between the top portions of the jack studs 57 to define the upper end of the opening 51 as shown in FIGS. 7 and 10. A plurality of cripple studs 61 are installed between the head track 60 and a header track 62. The header track 62 may comprise a C-shaped track or other built-up arrangement. A C-shaped lintel member 63 or rim may be supported on its lower flange on the upper flange of the header track 62. The upper wall track 53 is attached to the upper portion of the lintel 63. An alternative box beam header arrangement is depicted in FIGS. 11 and 12. As can be seen in those Figures, the lintel is formed by a pair of C-shaped beam members 70 that extend between the upper wall track 53 and intermediate header track 62. Those of ordinary skill in the art will appreciate that, regardless of which header arrangements are employed, they take considerable time to construct and install. They are also difficult and time consuming to insulate.

FIG. 12A illustrates another header arrangement wherein two C-shaped members 70' are arranged in back to back fashion and are secured to an upper track 53' and a lower track 60' with screws 61' as shown.

Another type of wall found in building structures is known as a "curtain wall". Curtain walls are generally designed to only resist wind loads (external curtain walls) and other lateral loads and the weight of the wall itself (dead loads) and the weight of any finishing materials that are attached to the wall. FIG. 13 depicts a prior curtain wall 80 that has a window opening 81 formed therein. As can be seen in that Figure, the wall 80 extends between floor slabs 82 and includes an upper track 83 and a lower track 84. The bottom of each wall stud 85 is received in the bottom track 84 and the top of each stud 85 is located in the upper track 83 which is received within an outer top track 86, sometimes referred to in the industry as a "slip track". The window opening is 81 defined by a pair of king stud assemblies 87 that extend between the bottom track 84 and the lower top track 83 and a lower sill track 88 and a header track 89. Cripple studs 90 extend between the sill track 88 and the bottom track 84 and between the header track 89 and the lower top track 83.

Depending upon the type of structure, floors for residential structures are commonly fabricated from plywood or similar decking material, whereas, floors for commercial structures may be fabricated from concrete and reinforcing steel. Some concrete floors are poured over decking materials supported on the floor joists and others, such as those depicted in U.S. Pat. No. 5,402,612, employ precast concrete slabs which extend between walls and are supported on top tracks. Other floor assemblies and beam arrangements are disclosed in U.S. Pat. No. 6,301,854 to Daudet et al. and U.S. Pat. No. 5,956, 916 to Liss.

SUMMARY

In accordance with one embodiment of the invention, there is provided a joist end bearing condition for a building that may include a support structure and a bearing wall supported on the support structure. The bearing wall may have a plurality of vertically extending studs. A joist rim may be supported on the support structure adjacent to the vertically extending studs and may be attached to at least some of the vertically extending studs. At least one joist may be coupled to the joist rim.

Another embodiment of the subject invention may comprise a method of constructing a bearing wall and floor structure. The method may include constructing a lower support structure and affixing a bearing wall that has a plurality of vertically extending studs to the lower support structure. The method may further include supporting a joist rim on the lower support structure adjacent to at least some of the vertically extending studs and affixing the joist rim to at least some of the adjacent vertically extending studs. In addition, the method may include affixing a plurality of floor joists to the joist rim and supporting a floor deck on the plurality of floor joists.

Another embodiment of the present invention may comprise a joist end bearing condition for a bearing wall and floor structure that includes a lower track, an upper track having a planar track web and a first and second track flange protruding from the track web, and a plurality of vertically extending studs extending between the upper and lower tracks and being attached thereto. Each vertically extending stud may have a stud web and a first stud flange and a second stud flange protruding from the stud web. A joist rim that has a rim web and a planar upper flange protruding from the rim web is attached to the second stud flanges of a plurality of the vertically extending studs adjacent to the upper track such that the planar upper flange of the joist rim is substantially coplanar with the track web of the upper track. At least one first joist may be coupled to the rim web.

Yet another embodiment of the present invention may comprise a method of constructing a bearing wall and floor structure. The method may include constructing a bearing wall that has an upper track and a lower track and a plurality of vertical studs extending between the upper and lower track and being attached thereto. The upper track may have a planar track web. The method may also include affixing a joist rim to the bearing wall such that a planar rim flange of the joist rim is substantially co-planar with the planar track web of the upper track and affixing a plurality of first floor joists to the joist rim. The method may also include supporting a floor deck on the plurality of first floor joists and the substantially coplanar upper track web and upper rim flange.

Another embodiment of the present invention may comprise a joist end bearing condition for a structure. the joist end bearing condition may comprise a plurality of vertically extending studs forming a bearing wall. The vertically extending studs may each have a top portion. A joist rim that has an upper rim flange is attached to at least some of the vertically extending studs such that the upper rim flange is substantially co-planar with the top portions of said vertically extending studs. At least one floor joist is coupled to the rim web and floor decking material is attached to at least some of the floor joists such that it spans a point of connection between top portions of the vertically extending studs and the rim joist.

Another embodiment of the present invention comprises a joist rim that comprises a top web and a first flange depending from the top web and a second flange depending from the top web in spaced opposing relationship relative to the first flange. A plurality of first joist attachment tabs may be integrally formed in the first flange.

Another embodiment of the present invention comprises a combination joist rim and wall header that may include a top web, a first header flange depending from the top web and a second header flange depending from the top web in spaced opposing relationship relative to the first header flange. A plurality of first joist attachment tabs may be integrally formed in the first header flange at first predetermined intervals, each first joist attachment tab being oriented at a first predetermined angle relative to the first header flange. A first lower flange may depend from the first header flange and a plurality of second joist attachment tabs may be integrally formed in the second header flange at second predetermined intervals. Each second joist attachment tab may be oriented at a second predetermined angle relative to the second header flange. A second lower flange may depend from the second header flange.

Another embodiment of the present invention comprises a wall and floor system that includes a combination joist rim and wall header. The combination joist rim and wall header may comprise a U-shaped header that has a top web, a first header flange depending from the top web and second header flange depending from the top web in spaced opposing relationship relative to the header flange. A plurality of first joist attachment clips may be fastened to the first header flange at first predetermined intervals. The wall and floor system may further include a plurality of vertically extending studs each have a top portion. The top portions may be received between the first and second header flanges of the U-shaped header and are attached thereto. A plurality of first joists may be attached to the plurality of first joist attachment clips.

Another embodiment of the present invention comprises a header arrangement for an opening in a wall of a multi-story structure. The header arrangement may comprise a joist rim that is attached to posts that define the opening and extend therebetween to form a header above the opening. The header arrangement may further include a girder assembly that is attached to the joist rim and is co-extensive therewith. The girder assembly may also be attached to the posts. A plurality of floor joists may be attached to the joist rim.

Another embodiment of the present invention comprises a wall and floor connection that includes a support structure and a plurality of vertically extending first studs that are supported on the support structure. The first studs each have a top end portion that is received in an upper wall track. The first studs define a first wall side and a second wall side. A first joist rim is attached to at least some of the vertically extending first studs on the first wall side. The first joist rim is oriented at a desired distance above the support structure. A plurality of first joists are coupled to the first joist rim. First decking material is supported on the plurality of first joists. A bottom wall track that has a web and two upstanding legs is supported on the upper wall track. The bottom ends of a plurality of vertically extending second are received in the bottom wall track. The ends of the vertically extending second studs are spaced from each other to define open areas between the bottom ends of the spaced second studs and the web and legs of the bottom track. A cementitious material is applied onto the first decking and in the open areas to form a floor surface on the first decking material and a barrier in the open areas.

Another embodiment of the present invention comprises a wall and floor connection that includes a support structure and a plurality of vertically extending first studs that are supported on the support structure. Each first stud has a top end portion and serves to define a first wall side and a second wall side. This embodiment further comprises a header that has a first header flange, a second header flange, and a top header web connected to the first and second header flanges and extending therebetween to define an area for receiving the top end portions of the first studs therein. The top end portions of the first studs are coupled to at least one of the first and second header flanges. A plurality of first joists are coupled to the first header flange and first decking material is supported on the plurality of first joists. A bottom wall track that has a web and two upstanding legs is supported on the top header web of the header. Bottom ends of vertically extending second studs are received in the bottom wall track. The bottom ends of the vertically extending second studs are spaced from each other to define open areas between the bottom ends of the spaced second studs and the web and the upstanding legs of the bottom wall track. Cementitious material is applied onto the first decking material and in the open areas to define a barrier in the open areas and a first floor surface on the first decking materials.

Another embodiment of the present invention comprises a wall and floor connection that includes a support structure and a plurality of vertically extending first studs supported on the support structure. Each first stud has a top end portion and serves to define a first wall side and a second wall side. This embodiment further includes a first joist rim that has a first rim web attached to top portions of at least some of the vertically extending first studs on the first wall side thereof. The first joist rim further has a first bottom rim leg protruding from one the of the first rim web and a first top rim leg protruding from another side of the first rim web and extending over a portion of the top end portions of the first studs. A plurality of first joists are coupled to the first rim web. This embodiment may also include a second joist rim that has a second rim web that is attached to the top end portions of at least some of the vertically extending first studs on the second wall side thereof. The second joist rim may further have a second bottom rim leg protruding from one side of the second rim web and a second top rim leg protruding from another side of the second rim web and extending over another portion of the top end portions of the first studs. A plurality of second joists are coupled to the second rim web. First decking material is supported on the plurality of first joists. A bottom wall track that has a bottom web and two upstanding legs is supported on the first top rim leg and the second top rim leg. The bottom ends of a plurality of vertically extending second studs are received in the bottom wall track. The ends of the vertically extending second studs are spaced from each other to define open areas between the bottom ends of the spaced second studs and the web and legs of the bottom track. Second decking material is supported on the plurality of second joists. A cementitious material is applied onto the first decking material, the second decking material and in the open areas to define coplanar first and second floor surfaces.

Another embodiment of the present invention comprises a method of constructing a wall and floor structure which may include constructing a support structure and a first bearing wall having a first bottom track, a first top track and a plurality of vertically extending first studs supported between the first bottom and top tracks and being attached thereto. The method may further include supporting the first bottom track of the a first bearing wall on the support structure and affixing a first joist rim to a first side of at least some of the vertically extending first studs. The method may also include affixing a plurality of first floor joists to the first joist rim and affixing a second joist rim to a second side of at least some of the first studs. In addition, the method may further comprise affixing a plurality of second floor joists to the second joist rim and supporting first floor decking material on the plurality of first floor joists. The method may also include supporting second floor decking material on the plurality of second floor joists and constructing a second wall having a second bottom track, a second top track and a plurality of vertically extending second studs supported between the second bottom track and the second top track and being coupled thereto. The second studs are spaced from each other to define open areas in the bottom track between the second studs. This embodiment may also include supporting the second bottom track on the first top track and forming floor segments on the first and second decking materials from cementitious material, the cementitious material being received in at least some of the open areas on the second bottom track between the vertically extending second studs.

Accordingly, the present invention provides solutions to the shortcomings of prior building components and floor systems. Those of ordinary skill in the art will readily appreciate, however, that these and other details, features and advantages will become further apparent as the following detailed description of the preferred embodiments proceeds.

BRIEF DESCRIPTION OF THE DRAWINGS

In the accompanying Figures, there are shown present preferred embodiments of the invention wherein like reference numerals are employed to designate like parts and wherein.

DETAILED DESCRIPTION

Various embodiments of the subject invention will be described herein in connection with a multistory structure. As the present Detailed Description proceeds, however, it will be apparent to those of ordinary skill in the art that certain aspects of various embodiments of the present invention may be successfully employed in connection with single-story buildings. Accordingly, the various embodiments of the present invention should not be limited to use solely in multistory applications.

Figure 14:
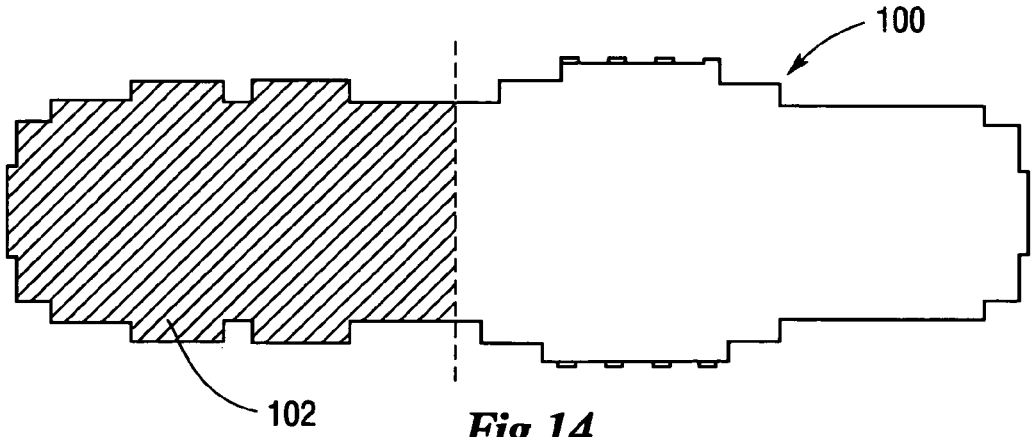
FIG. 14 is a key plan of a multi-story building in which various embodiments of the present invention may be employed.
Figure 15:
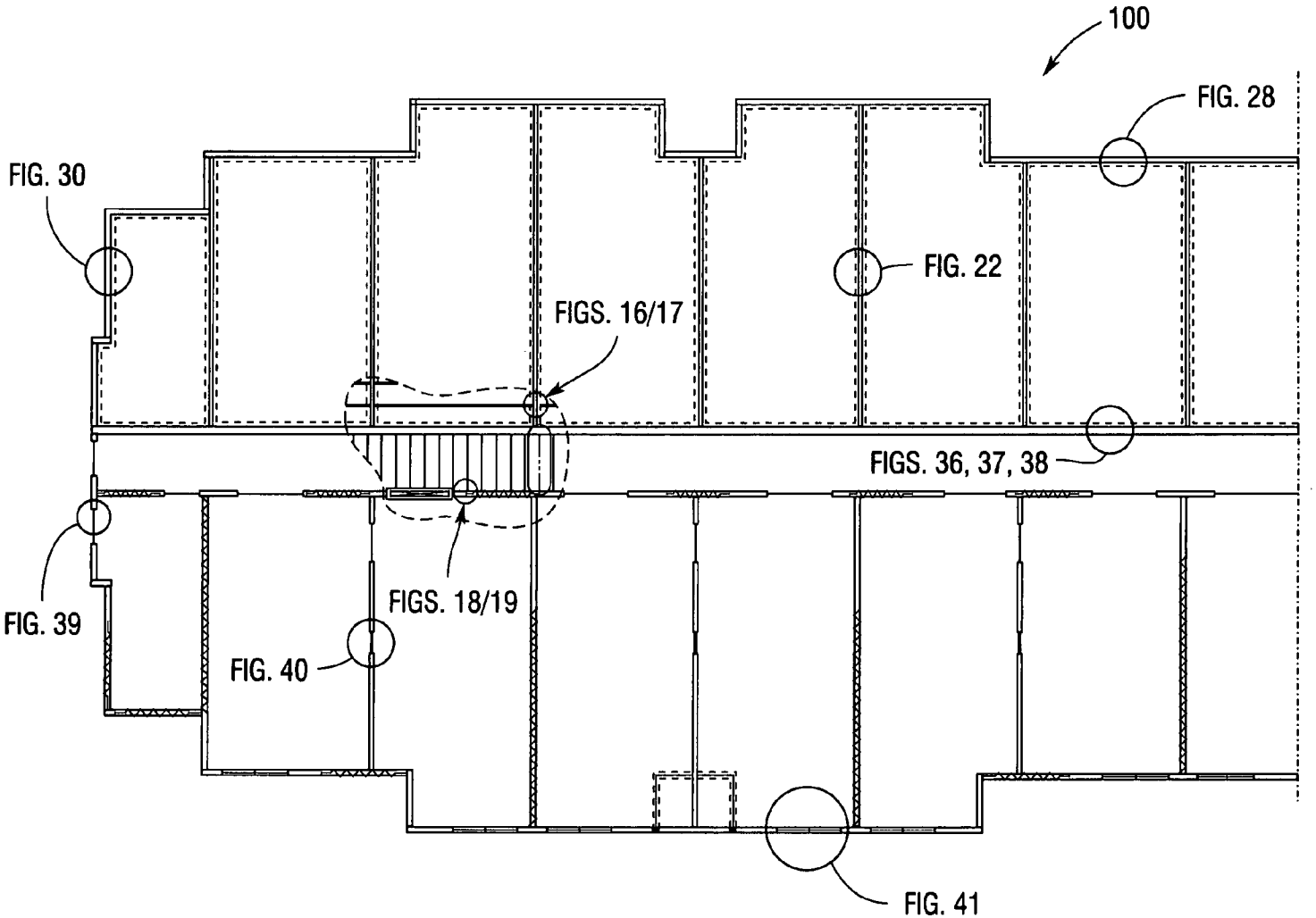
FIG. 15 is a plan view of portions of a sample first floor wall and first floor joist framing plan corresponding to a shaded portion in FIG. 14 and which is illustrative of how certain embodiments of the present invention may be incorporated in such a multi-story structure.

Referring now to the drawings for the purposes of illustrating embodiments of the invention only and not for the purposes of limiting the same, FIG. 14 is a "key plan" of a multi-story building 100. The shaded area 102 of the building 100 illustrates the portion of building 100 depicted in FIG. 15. FIG. 15 depicts portions of a sample first floor wall and first floor joist framing plan that is illustrative of how certain embodiments of the present invention may be incorporated in such a structure.

Figure 16:
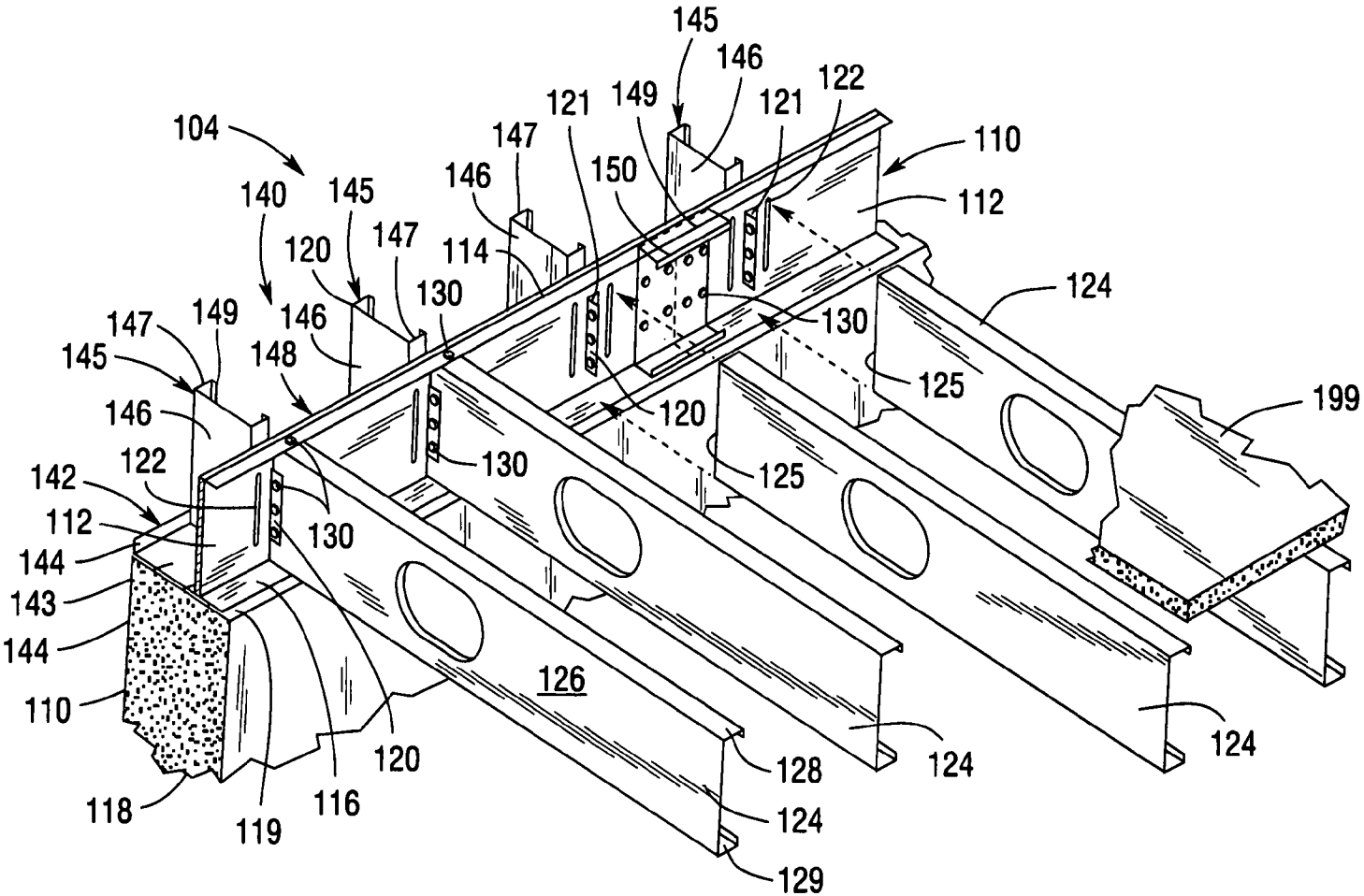
FIG. 16 is a partial perspective view of one embodiment of a joist end bearing arrangement of the present invention.

FIG. 16 illustrates an embodiment of a joist end bearing condition 104 of the present invention that may be employed in portions of the building 100 as shown in FIG. 15. As can be seen in FIG. 16, this embodiment of the present invention includes a joist rim 110 which may be of the type disclosed in U.S. Pat. No. 6,301,854 to Daudet et al., the disclosure of which is herein incorporated by reference. Such a joist rim 110 is commonly fabricated from, for example, cold rolled galvanized steel or other suitable metal, the gauge of which may be dependent upon the amount and types of loads that the floor must support. For example, for a floor system that is designed to support loads of forty pounds per square foot, the joist rim 110 may be fabricated from 16 gauge cold rolled steel. The joist rim 110 may be substantially C-shaped when viewed from the end and have a rim web 112 and an upper rim flange 114 and a lower rim flange 116. The lower rim flange 116 may be longer than the upper rim flange 114 to facilitate easy attachment of the lower rim flange 116 to an upper surface 119 of a support structure such as a concrete wall 118 or other support structure such as a wall, slab, etc., by appropriate fasteners (i.e., bolts, screws, etc.) and fastening methods if required.

As can also be seen in FIG. 16, the joist rim 110 may be provided with a plurality of attachment tabs 120 that are integrally formed in the rim web 112 which are used for affixing the ends 125 of C-shaped metal floor joists 124 to the joist rim 110. The attachment tabs 120 may be punched out of the rim web 112 of the joist rim 110 may bent at a 90° angle relative to the rim web 112. Such arrangement results in the formation of openings 121 through the rim web 112 of the joist rim 110. To provide additional reinforcement to the rim web 112 around the openings 121, reinforcing ribs 122 may be provided on each side of each opening 121 which further permits the attachment tab 120 to function as a structural connection between the joist rim 110 and a corresponding floor joist 124. As can be further seen in FIG. 16, the floor joists 124 may each have a joist web 126, an upper joist flange 128 and a lower joist flange 129 and be fabricated from, for example, cold rolled galvanized steel or other suitable metal, the gauge of which may be dependent upon the amount and types of loads that the floor must support. The attachment tabs 120 may be provided in the joist rim 110 at any desired interval. However, those of ordinary skill in the art will appreciate that it may be advantageous to provide the attachment tabs 120 at intervals of 8", 12", 16", 19.2" or 24" which are generally accepted spacing arrangements for studs and joists within the construction industry.

The joist webs 126 of the floor joists 124 may be attached to corresponding attachment tabs 120 by appropriate fastening methods. For example, mechanical fasteners 130 such as #10-16 screws or the like may be employed in an appropriate number and configuration. However, it is conceivable that other fastening methods such as welding, rivets, bolts, etc. could be employed to affix the joists 124 to the tabs 120. In addition, the upper joist flange 128 of each floor joist 124 may be attached to the upper rim flange 114 of the joist rim 110 by appropriately sized fasteners 130 such as, for example, #10-16 screws or the like.

In this embodiment, the rim web 112 of the joist rim 110 may be attached to studs 145 of a bearing wall 140. The bearing wall 140 may comprise a C-shaped lower track 142 that has a track web 143 and two upstanding track flanges 144. The track web 143 of the lower track 142 may be supported on the upper surface 119 of a support structure 118 and may be attached thereto by suitable conventional fasteners and techniques. In one embodiment, the support structure comprises a concrete wall. The lower track member 142 may be fabricated from, for example, cold rolled galvanized steel or other suitable metal, the gauge of which may be dependent upon the amount and types of loads that the floor must support. The vertically extending studs 145 may be C-shaped and have a stud web 146 and a pair of stud flanges 147 that each has a lip 149 protruding therefrom. The vertically extending studs 145 may also be fabricated from appropriately sized cold rolled galvanized steel or the like. The lower ends of the studs 145 may be received in the lower C-shaped track 142 and the stud flanges 147 of the studs 145 may be attached to the corresponding track flanges 144 of the lower track 142 by fasteners such as, for example #10-16 screws or the like. The skilled artisan will appreciate that the upper end of the studs 145 may be supported in and attached to an upper track (not shown) in a similar manner.

As can be seen in FIG. 16, the rim web 112 of the joist rim 110 may be attached to the stud flanges 147 of studs 145 by, for example, appropriate sized screws, rivets, bolts or other appropriate fastening methods such as welding. In the alternative, the joist rim 110 may be attached to the wall 118 alone or it may be attached to the studs 145 and the wall 118. In this embodiment, however, the rim web 112 is not directly attached to the stud flanges 147. The lower flange 116 is attached to the wall 118 by appropriate concrete fasteners 123. Insulation material 148, such as commercially available rigid insulation board or similar material may be inserted between the studs 145 and the rim web 112 to prevent squeaking caused by relative movement of the studs 145 and the joist rim 110. In addition, the spaces between the studs may be filed with commercially available fiberglass insulation or policyene material. As can also be seen in FIG. 16, the joist rims 110 may be spliced together by a C-shaped splice member 150 that spans the joint 149 between the abutting webs 112 of the joist rims 110 by appropriate fasteners 130 such as, for example, #10-16 screws or the like.

As can also be seen in FIG. 16, the joist rim 110 may be oriented such that the studs 145 may be aligned with the floor joists 124 depending upon the load conditions. It is conceivable, however, that the studs 145 would not have to be aligned with floor joists 124. Also in this embodiment, floor decking material 199 such as, for example, noncombustible board or a poured-in-place cementitious product may be supported on the joists 124 and attached to at least some of the joists 124. In one embodiment, for example, the noncombustible board 199 may comprise that cementitious board supplied by Allied Building Products of 15 east Union Avenue, East Rutherford, N.J. 07073 under the trademark VIROC®. This embodiment of noncombustible board comprises a composite of wood particles and Portland cement. It is generally manufactured in 4'×8' and 4'×10' long panels and purports to combine the strength and flexibility of wood with the durability and resistant qualities of cement. Its properties are non-directional and it may be cut, planed, sanded, drilled, routed, nailed, screwed utilizing conventional woodworking tools. Other noncombustible board products such as the noncombustible sheathing material supplied by U.S. Architectural Products, Inc. of 55 Industrial Circle, Lincoln, R.I. 02865 under the trademark PLYCEM® may also be successfully used. PLYCEM board is comprised of 72% Portland cement with the balance comprised of mineralized cellulose fibers and calcium carbonate and is commonly supplied in 4'×8' or 4'×10' sheets. In the past, PLYCEM board was used over metal decking material to form floor structures. Such metal decking material adds weight and expense to the building. Other noncombustible board materials such as those manufactured by US Gypsum Company of 700 North Highway 45, Libertyville, Ill. 60048-1296 could successfully be used. In one embodiment, the noncombustible board may comprise materials that meet or exceed the non-combustibility requirements of the American Society of Test Materials (ASTM) standards E84, E136 or similar standards and may or may not lack any integral structural components (i.e., rebar, mesh, straps, etc.) that substantially span the length and/or width of the board such that the board has sufficient structural strength and stiffness to span the particular joist spacing arrangement employed (i.e., 8", 12", 16", 19.2", 24", etc.) without requiring the use of an underlayment supporting material such as metal decking or other decking material to achieve acceptable results under the floor loads to be encountered. Other decking materials could, however, be supported on top of the noncombustible board. The noncombustible board embodiments disclosed herein also may or may not have one or more of the following features/characteristics: (i) be of a size that can be safely and repeatedly handled by to individuals without the use assistance from lifting devices such as cranes or the like; (ii) be capable of being cut, drilled, planed, routed, nailed and/or screwed with conventional woodworking tools or the like; (iii) be made of materials that are mold-resistant (i.e., impervious to certain strains of mold).

Figure 17:
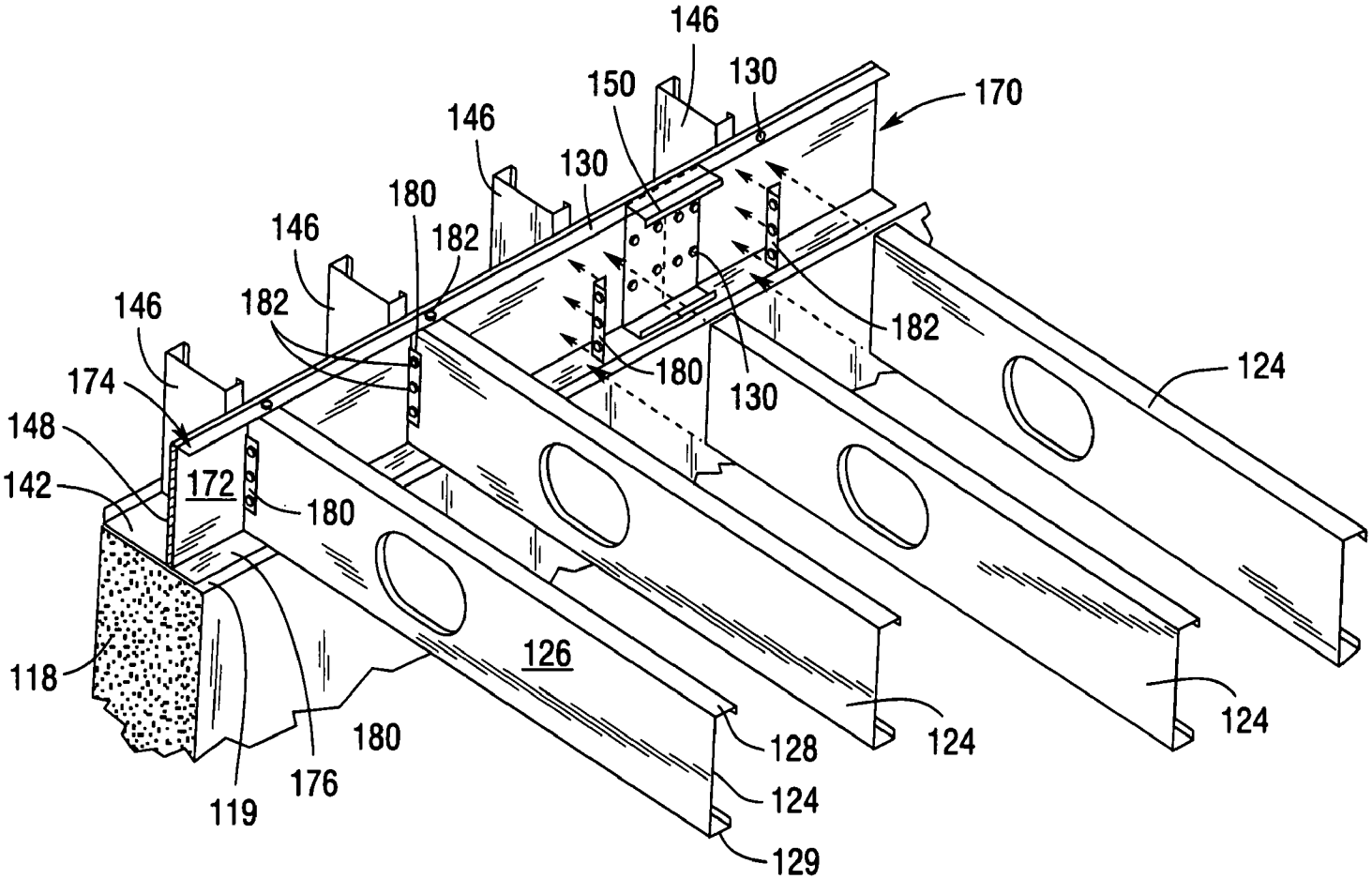
FIG. 17 is a partial perspective view of another embodiment of a joist end bearing arrangement of the present invention.

FIG. 17 illustrates an alternative joist end bearing condition embodiment wherein the joists 124 are attached to a C-shaped joist rim 170 that has a web 172 and an upper flange 174 and a lower flange 176 by L-shaped clip angles 180. The clip angles 180 may be attached to the web 172 of the joist rim 170 and the joist web 126 of the joists by, for example, appropriately sized screws or bolts 182 or by welding, etc. The remaining details of the system and components depicted in FIG. 17 may otherwise be as described above for the system and components depicted in FIG. 16.

The unique and novel aspects of the various components, arrangements and methods of the present invention provide vast improvements over prior floor arrangements. In particular, the floor decking material is noncombustible and can eliminate the need to install separate fire blocking between floors. Another advantage of one or more embodiments of the present invention is that the noncombustible panels may be formed in common module sizes that are similar or equivalent to common module sizes employed in the construction industry (i.e., 4'×8' sheets, etc.). The noncombustible panels employed in one or more embodiments may generally be handled by two workers without the need of crane assistance. The floor system arrangement can be constructed without the use of special tools. For example, in one or more embodiments, the noncombustible boards may be cut, drilled, sanded, etc. with common woodworking tools or the like. In addition, because various embodiments of the present invention do not require decking materials or employ precast concrete slabs that contain steel or other reinforcing members or utilize poured slabs with steel or other reinforcing members, the floors are lighter in weight. Thus, taller buildings may be constructed utilizing various floor systems and methods of the present invention.

Figure 18:
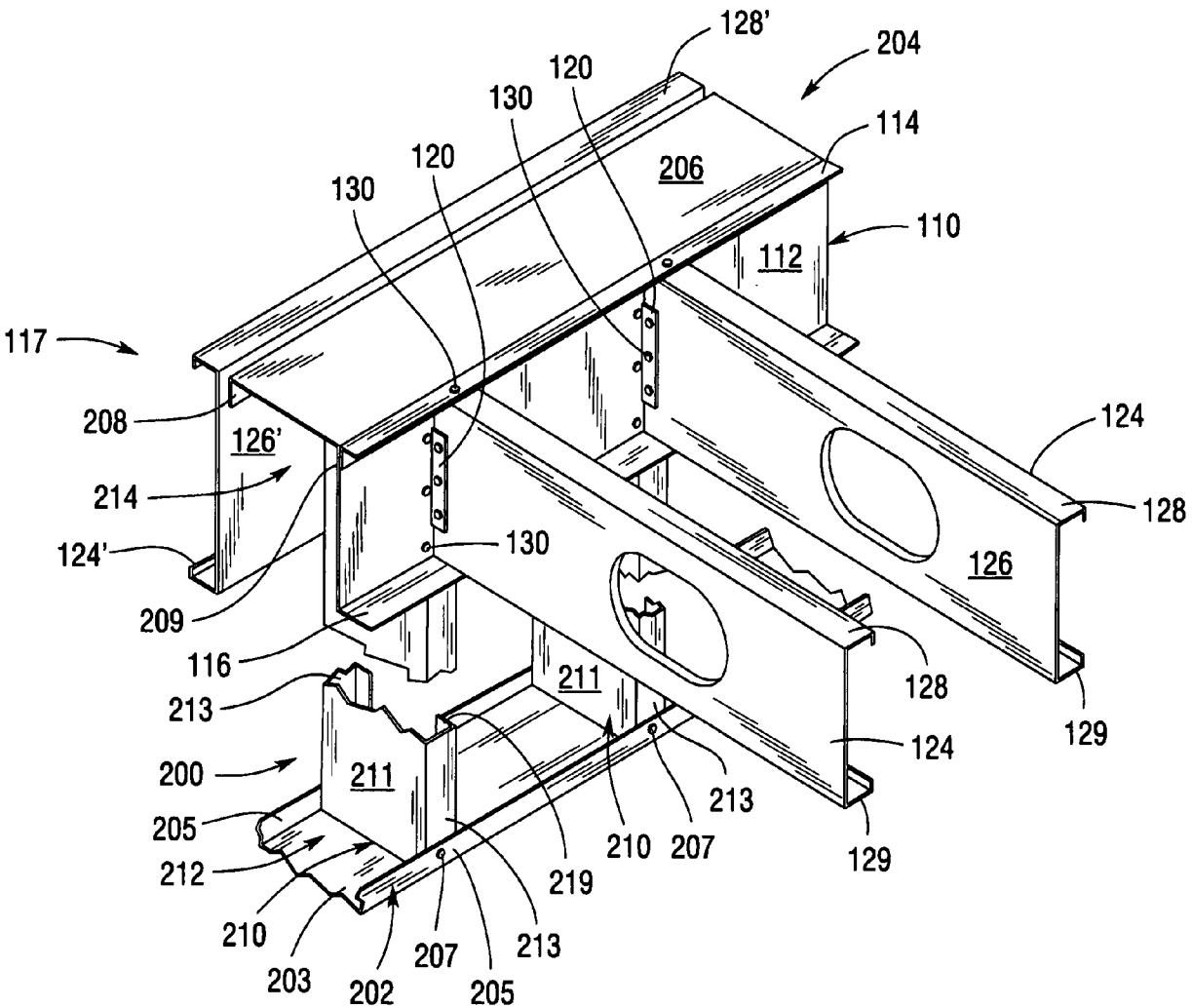
FIG. 18 is a partial perspective view of yet another embodiment of a joist end bearing arrangement of the present invention.

FIG. 18 illustrates another embodiment of a joist end bearing condition of the present invention that may be employed in the portion of building 100 as shown in FIG. 15. As can be seen in FIG. 18, this embodiment of the present invention may also employ a joist rim 110 of the type and construction described above. This arrangement serves to provide flush support surfaces between the top of the wall and the floor joists for receiving a floor deck thereon which could, if desired, extend onto another adjoining floor joist arrangement for forming another adjacent floor area. It may also permit direct bearing of upper story loads to the wall and floor which results in more load capacity through a substrate than prior arrangements. In this embodiment, the joist rim 110 may be attached to a bearing wall 200 that may be supported on a another wall or floor structure (not shown) and may include a lower C-shaped track 202 of the type described above. For example, the lower track 202 has a track web 203 and two upwardly extending track flanges 205. The bearing wall 200 may further include an upper C-shaped track 204 of similar construction as the lower C-shaped track 202 and has a track web 206 and two downwardly projecting flanges (208, 209). A plurality of C-shaped studs 210 of the type and construction described above which each have, for example, a stud web 211 and two depending stud flanges 213, may extend between the lower track 202 and upper track 204. Each stud 210 may be fabricated from, for example, cold rolled galvanized steel or other suitable metal, the gauge of which may be dependent upon the amount and types of loads to be encountered. The stud flanges 213 of each stud 210 may be affixed to the track flanges 205 of the lower track 202 and the first and second track flanges 208, 209 of the upper track 204 by fasteners 207. In one embodiment, fasteners 207 may comprise #10-16 screws or the like. However, studs 210 may be attached to the lower track 202 by other appropriate fasteners and fastening methods such as welding, bolting, etc.

The rim web 112 of the joist rim 110 may be attached to the stud flanges 213 of each of the vertically extending studs 210, by an appropriate number of appropriately sized fasteners 130 such as, for example, #10-16 screws. The connection of the joist rim 110 to the wall 200 through the use of fasteners 130 or the like serves to transfer the load from the joist to the walls. As will be discussed in further detail below, such transferring of loads in this manner can provide significant advantages over prior construction arrangements and methods. As can be seen in FIG. 18, in this embodiment, the upper flange 114 of the joist rim 110 is substantially coplanar with the track web 206 of the upper track 204.

In other embodiments, depending upon the specific composition of the components, the rim web 112 may not be attached to every stud 210. A collection of "first" floor joists 124 of the type and construction described above may be attached to corresponding connection tabs 120 integrally formed in the rim web 112 of the joist rim 110 in the manners described above such that the joists 124 may be substantially aligned with the studs 210, if desired or required. For example, "substantially aligned" in this context may mean, for example, that the centerline of a stud is not more than ¾" offset from the centerline of a joist. Again, however, depending upon the specific load characteristics, the studs may not be substantially aligned with the joists. Also, as shown in FIG. 18, the upper flanges 128 of the joists 124 may be affixed to the upper rim flange 114 of the joist rim 110 by, for example, fasteners 130. Fasteners 130 may comprise, for example #10-16 screws or the like. However, other fasteners and fastening methods (bolting, welding, etc.) could conceivably be employed.

In one embodiment, the joist web 126' of another or "second" C-shaped joist 124' which forms a portion of an adjoining floor structure, generally represented by 117, may be attached to the first depending track flange 208 of the upper track 204 by fasteners (not shown) that extend through the joist web 126' into the track flange 208. For example, the second joist 124' may be attached to the flange 208 with a plurality of appropriately sized screws such as, for example, #10-16 screws or the like such that the second joist 124' is substantially transverse to the first joists 124. However, other types of fasteners and fastening methods could conceivably be used. As can be seen in FIG. 18, the second joist 124' may be attached to the upper track 204 such that the upper joist flange 128' of the second joist 124' is substantially coplanar with the track web 206 of the upper track 204 as shown in FIG. 18. It will be understood that second joist 124' may be of the same or similar construction and composition as the first joists 124 as was described above depending upon the loading requirements of the floor 117.

Figure 19:
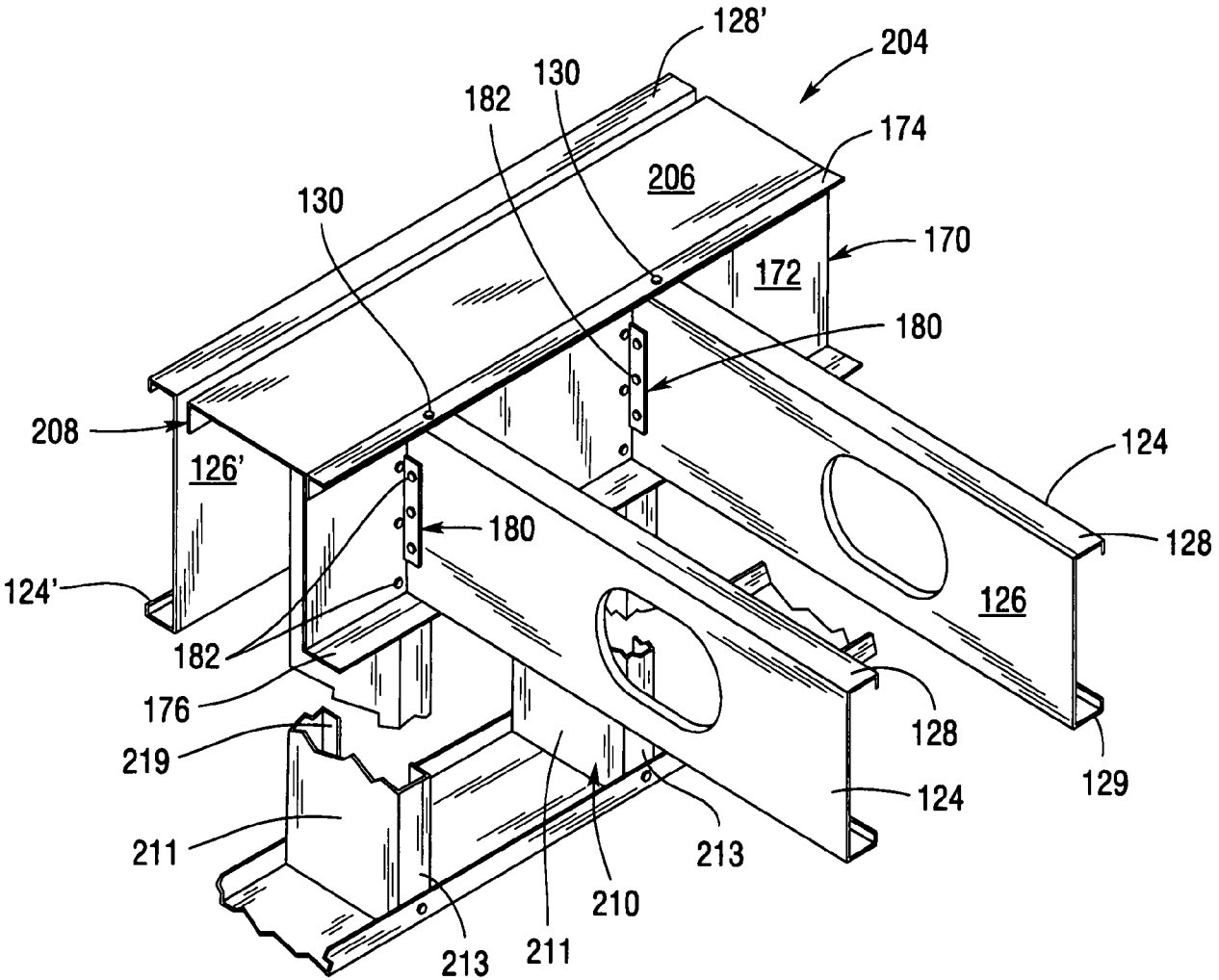
FIG. 19 is a partial perspective view of another embodiment of a joist end bearing arrangement of the present invention.

FIG. 19 illustrates an alternative embodiment of the present invention wherein the first joists 124 are attached to a C-shaped joist rim 170 that has a rim web 172 and an upper rim flange 174 and a lower rim flange 176 by L-shaped clip angles 180. The clip angles 180 may be attached to the rim web 172 of the joist rim 170 and the joist web 126 of the first joists 124 by, for example, appropriately sized screws or bolts 182 or by welding, etc. It is conceivable that the clip angles 180 may be attached to the joist web 126 of the joists 124 with the same screws, rivets, bolts, etc. that attach the rim web 176 to the studs 210. As shown in FIG. 19, the upper joist flanges 128 of the first joists 124 may be affixed to the upper rim flange 174 of the joist rim 170 by, for example, fasteners 130 such as screws, bolts, rivets or by welding. The remaining details of the system and components depicted in FIG. 19 may otherwise be as described above for the system and components depicted in FIG. 18.

As can be seen from the forgoing, in one embodiment, the joist rim is framed into the flanges of the load bearing studs, making the top flange of the joist rim flush with the top track. The joist rim may be attached to the joist with self-drilling screws through the rim tab to the joist web or other fastener/fastener arrangements may be employed. The top and bottom flanges of the joist rim may also be attached with self-drilling screws to the joist flanges. Such added screws give the rim-to-joist connection additional strength since the bearing strength of the rim flanges are activated. Without the flange screws, the joist rim strength is solely dependent upon the shear capacity of the tab. The joist rim may be attached to the stud flanges using self-drilling screws through the web of the joist rim or other fastener arrangements may be employed. The joists do not have to line up with the wall studs. In one embodiment, because the joist rim is a load distribution device, the joist rim can carry joist loads to the adjacent studs via the bending and shear capacity of the joist rim. This may be possible because the rim tab hole size may be specifically designed to permit enough unpunched material for adequate bending and shear strength.

Figure 1:
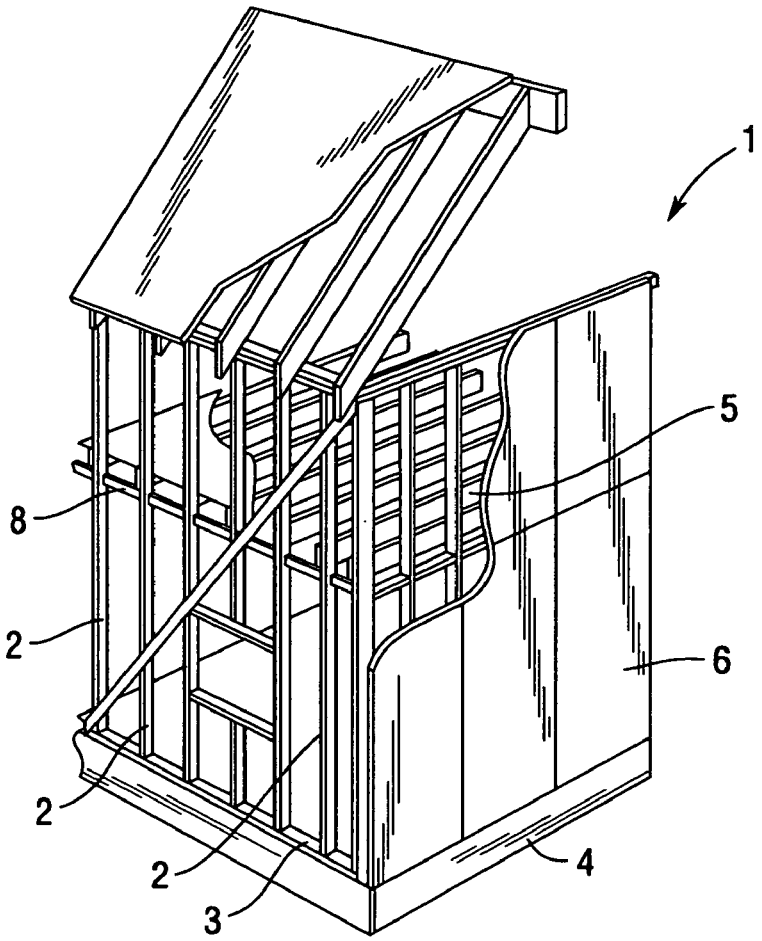
Prior Art Fig.1
FIG. 1 is a perspective view of a two-story structure formed from wood components arranged utilizing prior balloon framing techniques.
Figure 2:
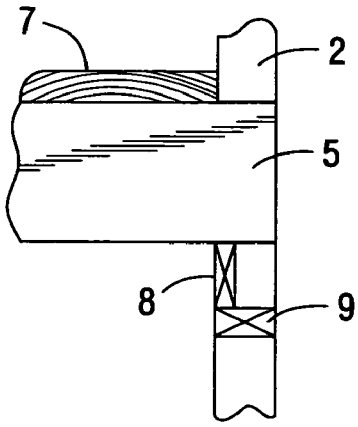
Prior Art Fig.2
FIG. 2 is an enlarged view of a point of connection between a floor joist and a stud of the structure depicted in FIG. 1 and illustrating use of a prior fire block.
Figure 3:
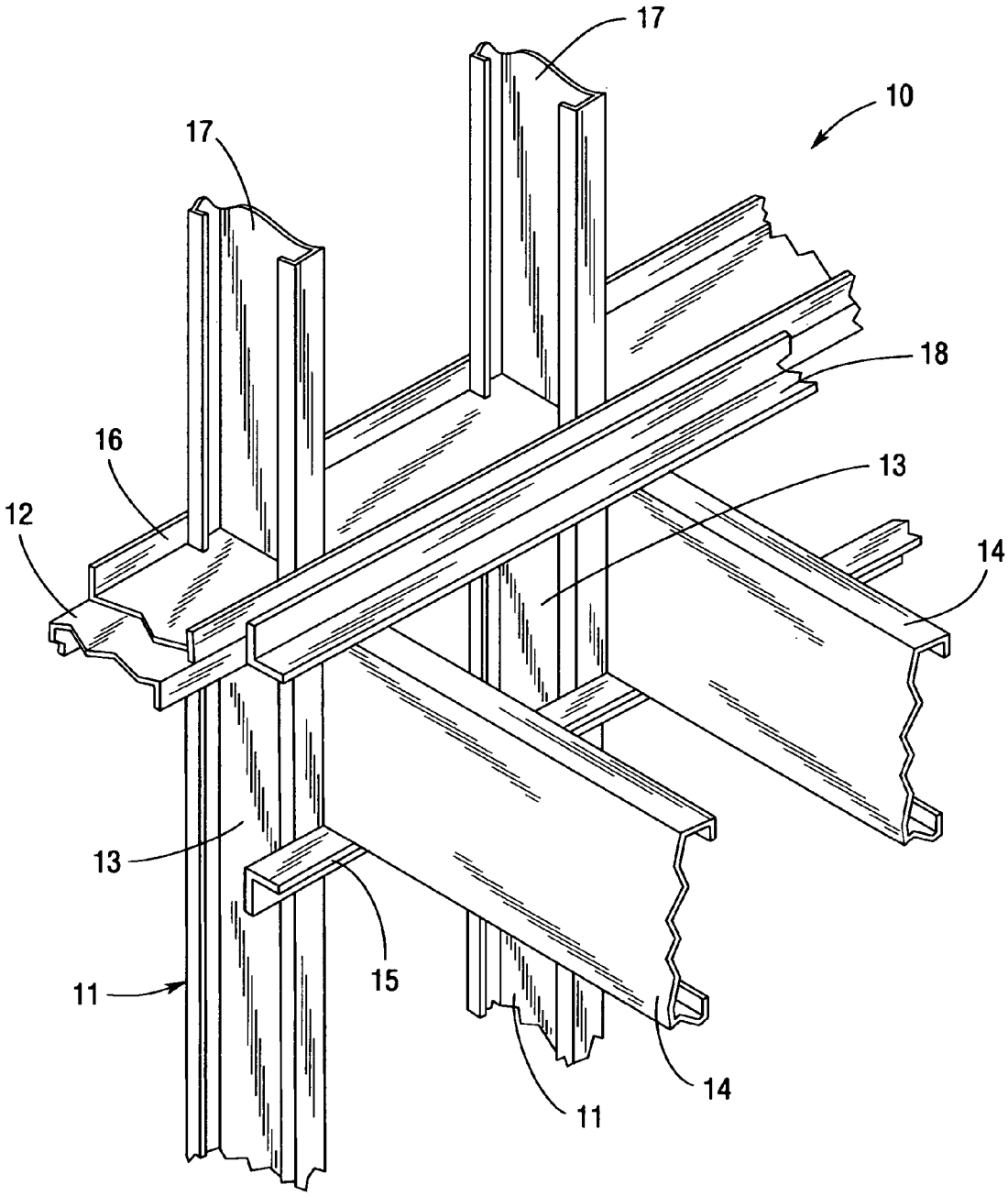
Prior Art Fig.3
FIG. 3 is a perspective view of a portion of a multi-story wall arrangement fabricated from lightweight steel components utilizing prior balloon framing techniques.
Figure 4:
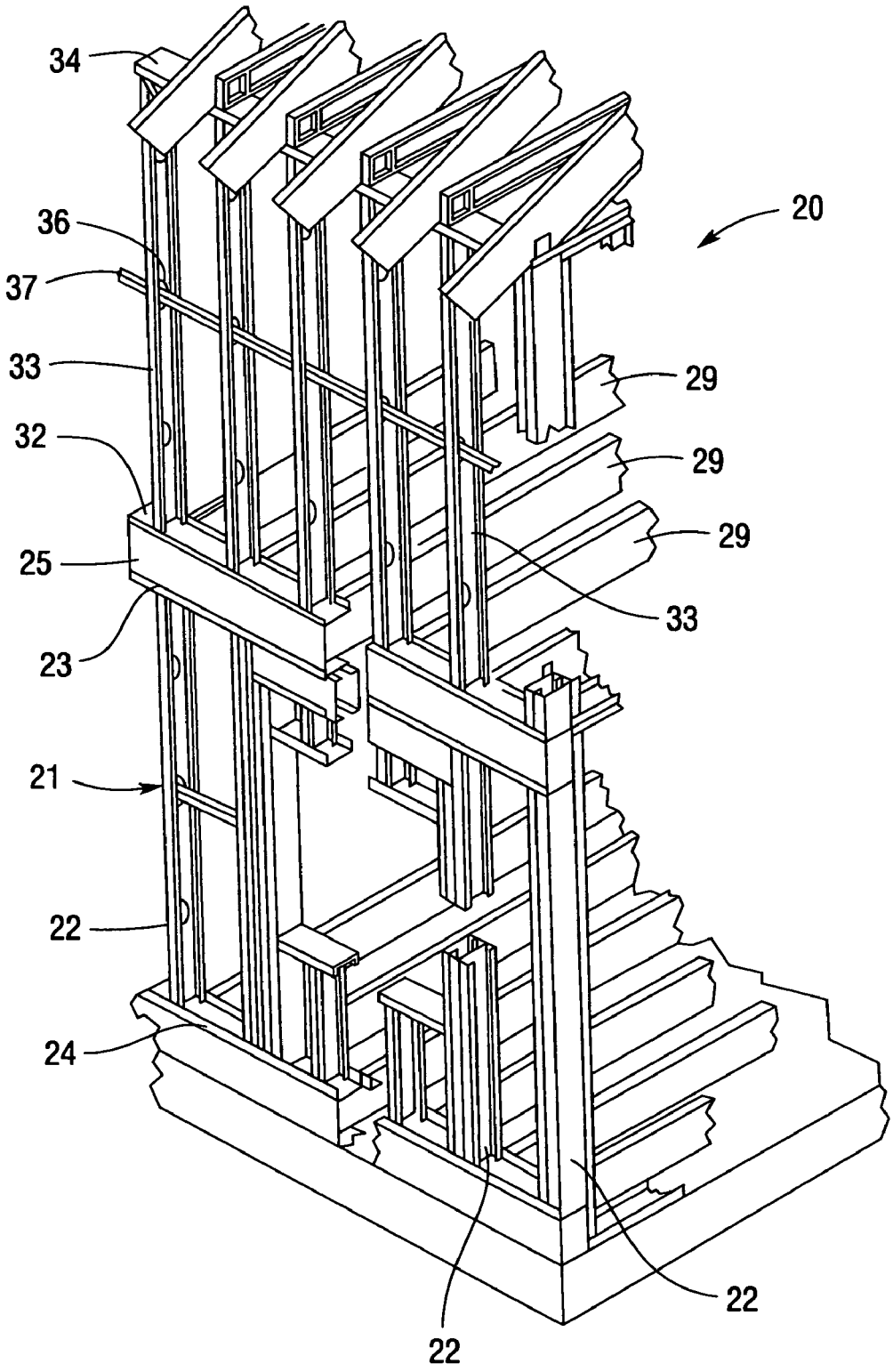
Prior Art Fig.4
FIG. 4 is a perspective view of a two-story structure fabricated from lightweight steel components utilizing prior platform framing techniques.
Figure 5:
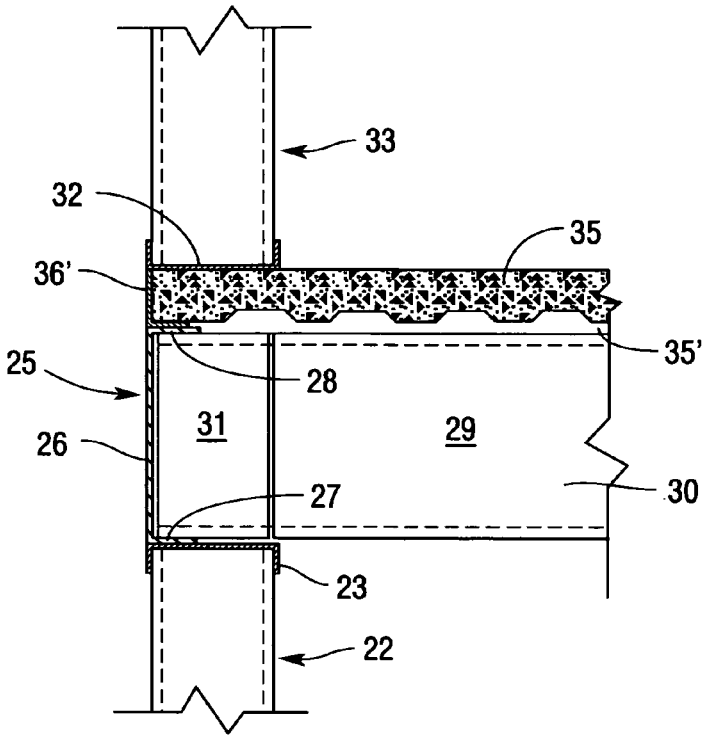
Prior Art Fig.5
FIG. 5 is a partial cross-sectional view of a multi-story load bearing exterior wall which may be employed in the structure of FIG. 4.
Figure 6:
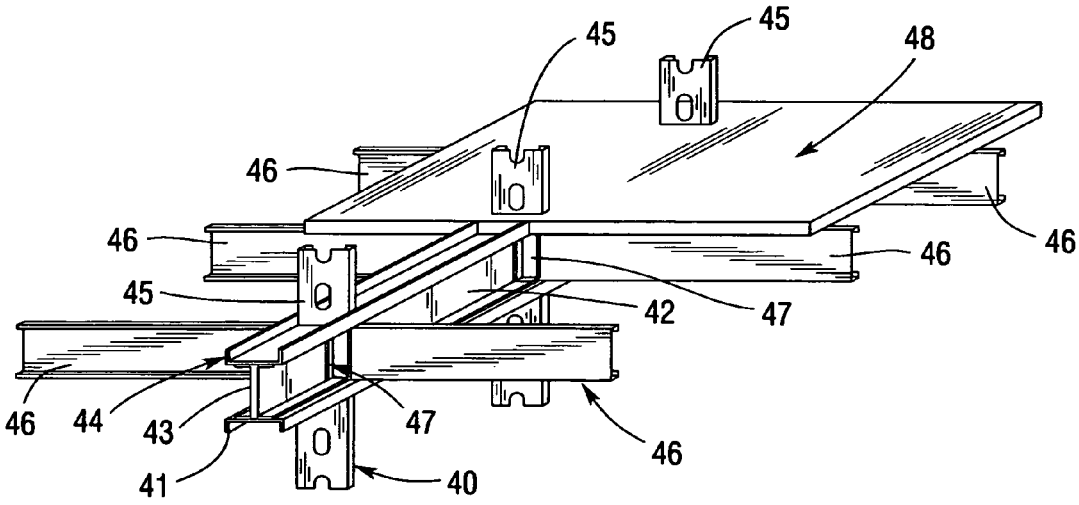
Prior Art Fig.6
FIG. 6 is a partial perspective view of a multi-story exterior load bearing wall fabricated from lightweight steel components utilizing prior platform framing techniques.
Figure 6A:
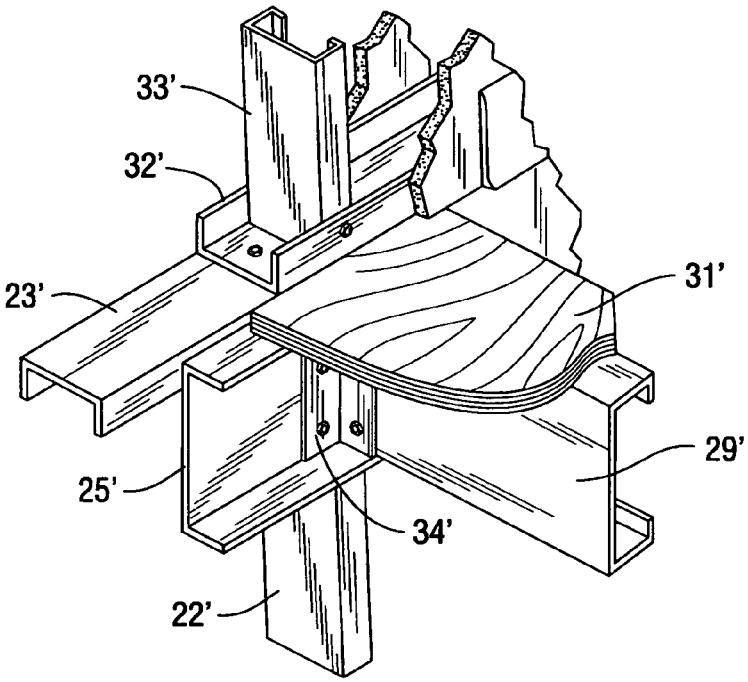
Prior Art Fig.6A
FIG. 6A is a partial perspective view of another prior multi-story wall farming arrangement.
Figure 6B:
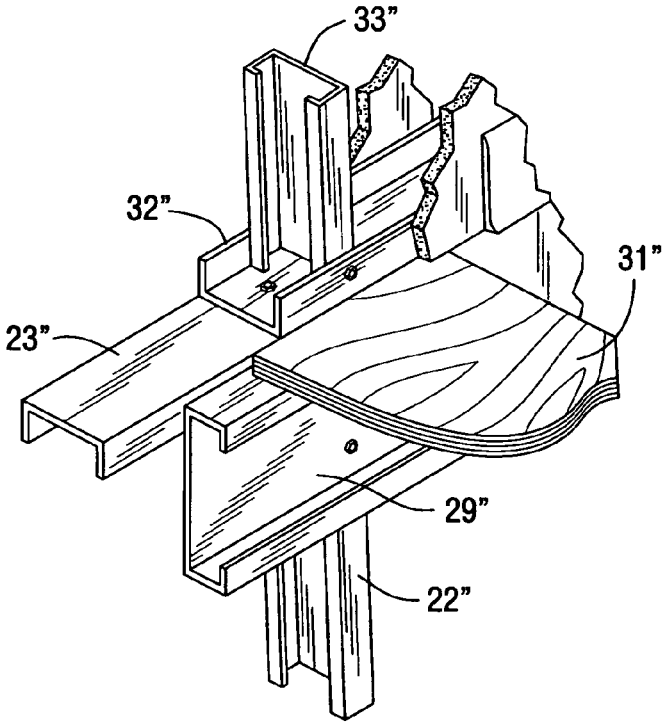
Prior Art Fig.6B
FIG. 6B is a partial perspective view of another prior multi-story wall farming arrangement.
Figure 7:
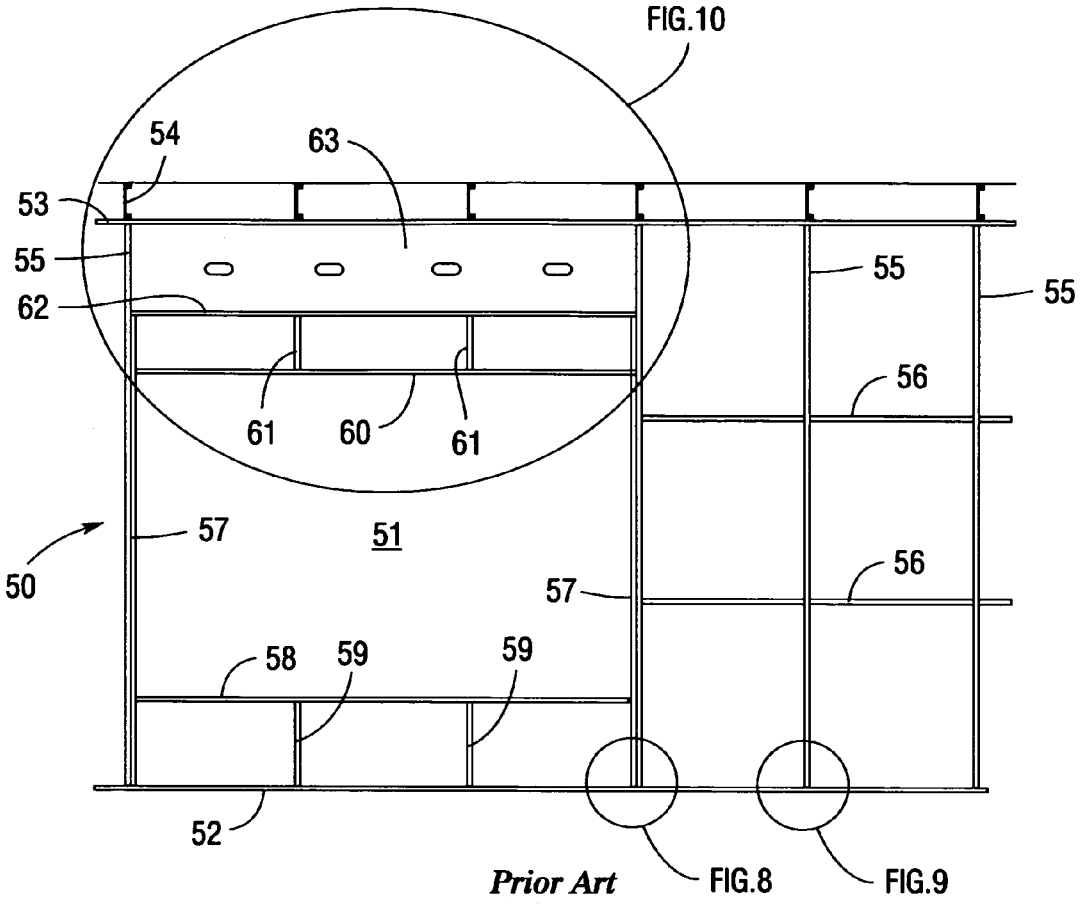
Prior Art Fig.7
FIG. 7 is an elevational view of a portion of a prior load bearing wall arrangement that has a window opening therein.
Figure 8:
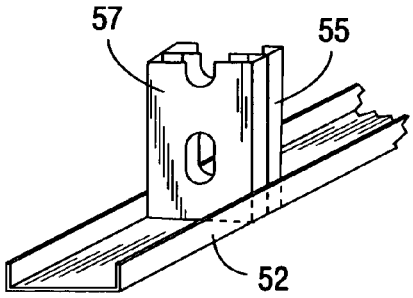
Prior Art Fig.8
FIG. 8 is a partial perspective view of a portion of the load bearing wall of FIG. 7.
Figure 9:
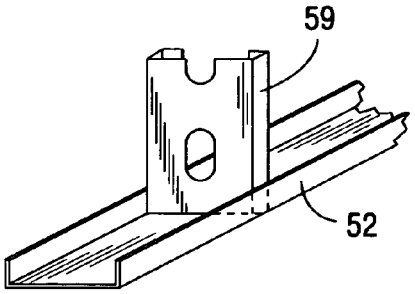
Prior Art Fig.9
FIG. 9 is a partial perspective view of another portion of the load bearing wall of FIG. 7.
Figure 10:
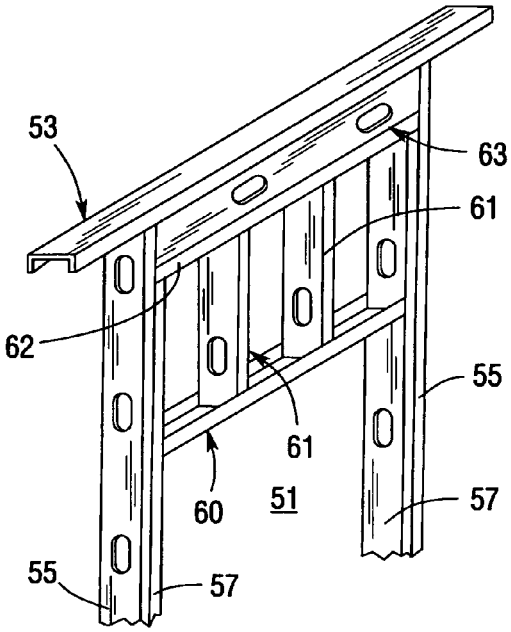
Prior Art Fig.10
FIG. 10 is a partial perspective view of yet another portion of the load bearing wall of FIG. 7.
Figure 11:
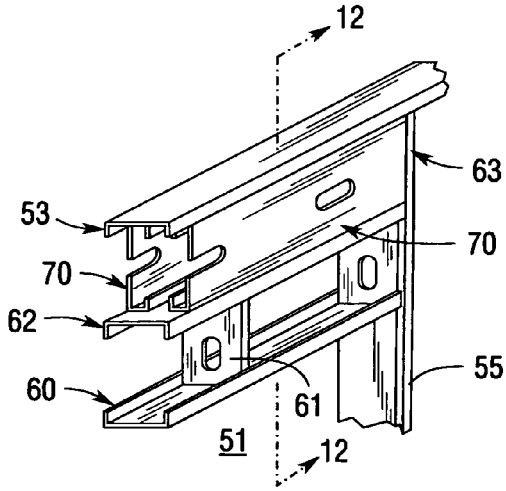
Prior Art Fig.11
FIG. 11 is a partial perspective view of a prior header arrangement employing lightweight steel framing components.
Figure 12:
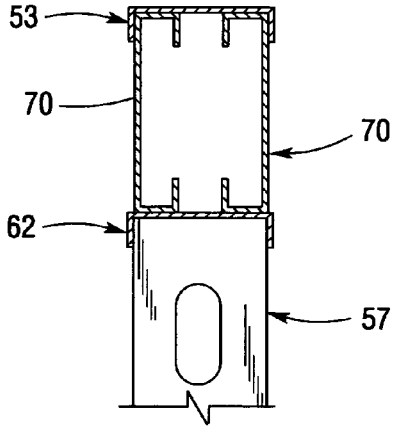
Prior Art Fig.12
FIG. 12 is a cross-sectional view of the prior header arrangement of FIG. 11 taken along line 12-12 in FIG. 11.
Figure 12A:
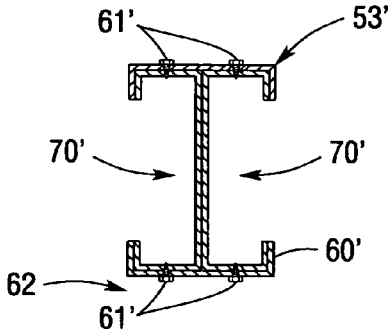
Prior Art Fig.12A
FIG. 12A is a cross-sectional view of another prior header arrangement.
Figure 13:
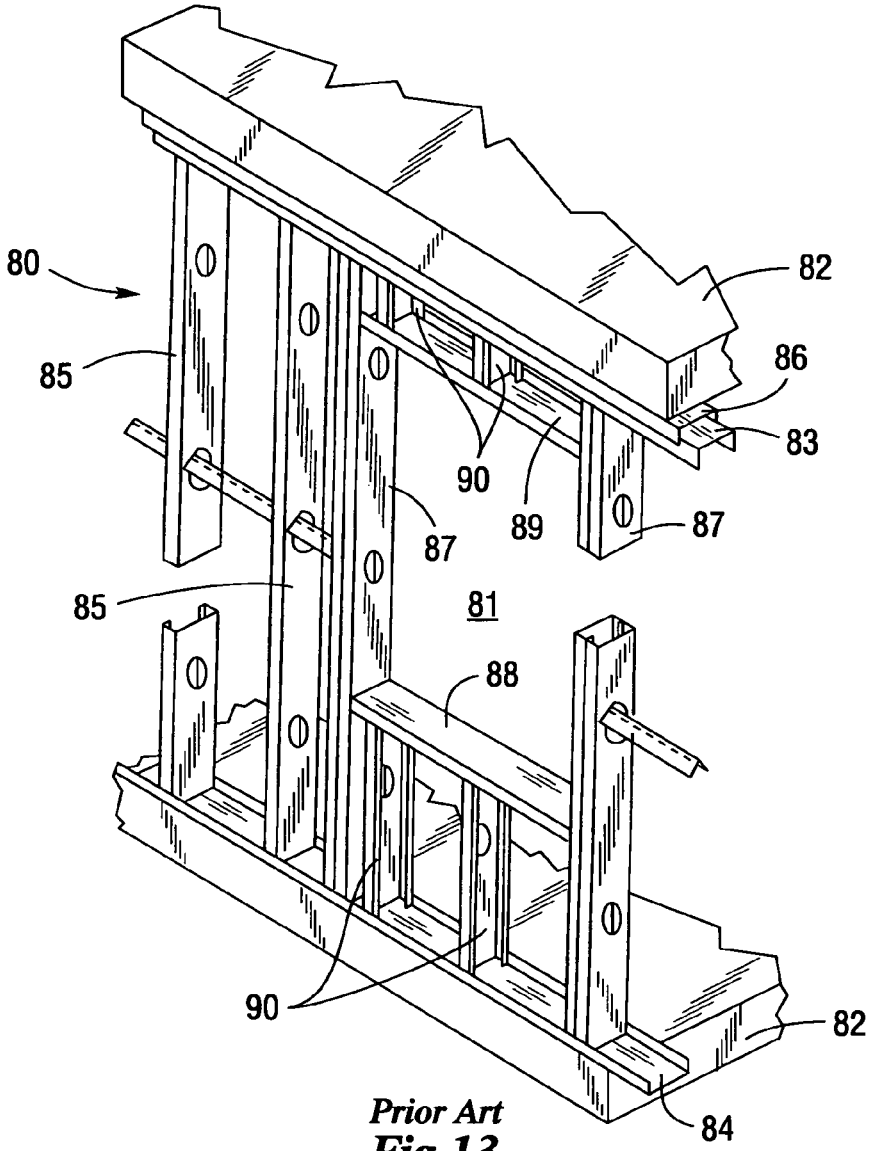
Prior Art Fig.13
FIG. 13 is a perspective view of a portion of a curtain wall fabricated from lightweight steel framing components utilizing prior framing techniques.

The embodiments depicted in FIGS. 18 and 19 provide vast improvements and advantages over prior art framing arrangements. For example, one advantage that may be provided by using these embodiments is that separate web stiffeners and/or "squash blocks" are not required to prevent the web of the joist rim from crippling. Thus, these embodiments of the present invention may result in lower material and labor costs when compared to prior systems that employ web stiffeners to prevent crippling of the web of the joist rim. Yet another advantage of these embodiments is that sufficient structural support may be achieved without the need for "building up" members (for example arranging joist rims in back to back fashion as employed in the prior art framing arrangement of FIG. 6) which also leads to lower material and labor costs. Also, this embodiment serves to keep all of the story walls in vertical alignment making it easier to transfer loads from the upper floors to the lower floors. It also permits the construction of taller buildings without the need for a primary iron frame. It also eliminates the need to install separate fire/smoke barriers between the studs.

Yet another advantage enjoyed by the embodiments described above is that the floor diaphragm can be connected directly to the "drag strut" of a shear wall. This eliminates the requirement for the very labor-intensive operation of adding joist blocking between joists when platform framing is used at the shear walls.

Figure 20:
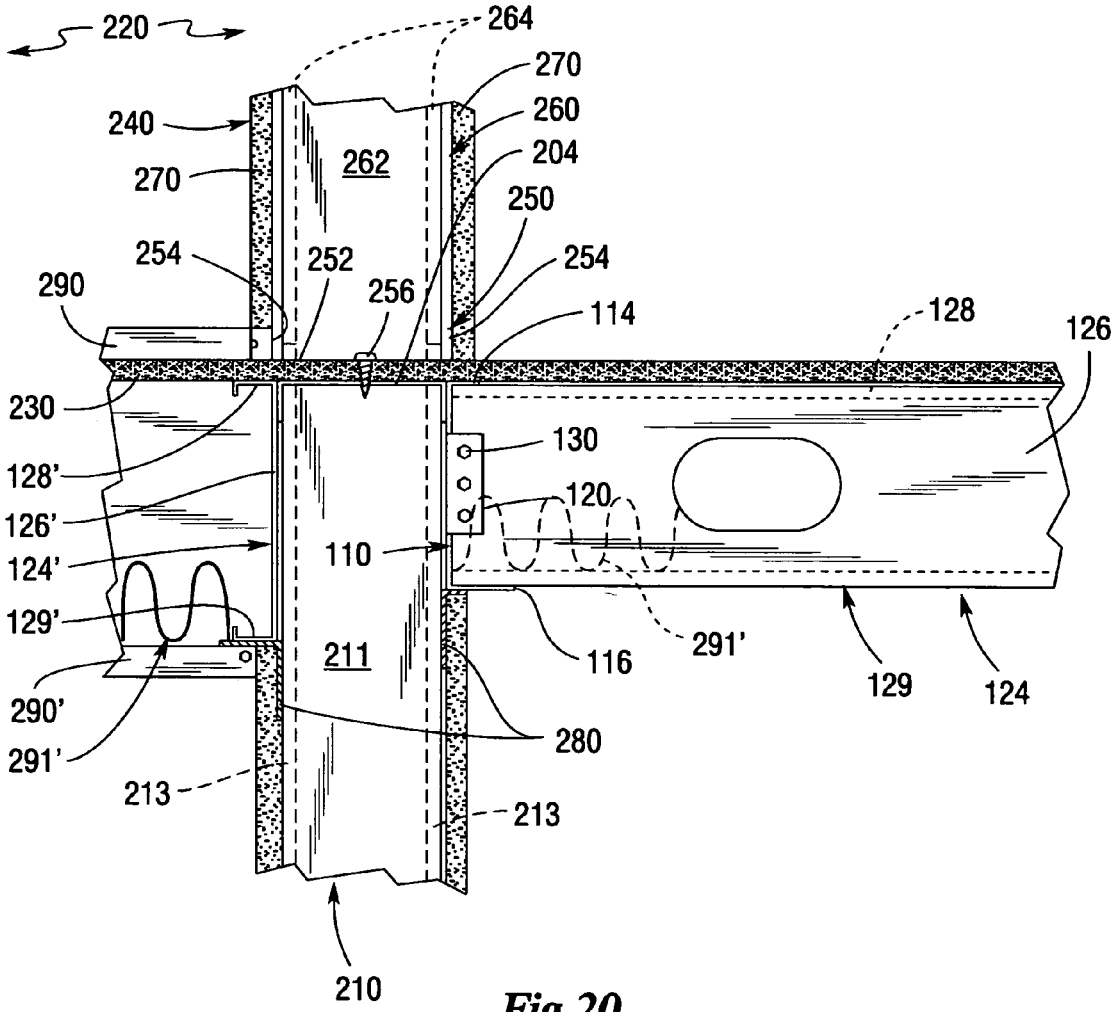
FIG. 20 is a partial elevational view of the joist end bearing arrangement of FIG. 18 wherein a second or upper story wall is attached thereto and wherein some components are shown in cross-section.

FIG. 20 depicts a possible use of the embodiments depicted in FIGS. 18 and 19. More specifically and with reference to FIG. 20, the floor surface for the next story (generally represented by 220) may be formed from commercially available noncombustible board 230 of the types and compositions described above. As can be seen in FIG. 20, the noncombustible board 230 may be installed such that it completely spans and extends across the corresponding portion of upper track 204 and the corresponding points where the joist rim 110 adjoins the first joists 124 and the second joist 124'. Such arrangement provides further strength to the wall system and provides a complete fire and smoke barrier between the floors.

A second story (or other upper story) wall 240 may then be constructed on top of the noncombustible board 210. The second (upper) story wall 240 may comprise, for example, a lower track 250 that has a track web 252 and two upstanding track flanges 254. The track web 252 of the lower track 250 may be attached to the noncombustible board 210 and the upper track 204 by an appropriate number and arrangement of appropriate sized fasteners 256 such as, for example, #10-16 screws. The second story 240 wall may further include a plurality of vertically extending studs 260 that each have a stud web 262 and a pair of stud flanges 264 which may be attached to the upstanding track flanges 254 of the lower track 250 by, for example, mechanical fasteners (not shown) such as appropriately sized screws or by welding, etc. Appropriate wall finishing materials such as gypsum sheathing 270 or the like may be attached to the stud flanges 254 of the vertically extending studs 250 in a known manner to form the desired wall surfaces. In one embodiment, a commercially available gypsum slurry 290 may be applied over the noncombustible board. Other floor surfaces or floor covering materials may also be used. Likewise, commercially available gypsum board 290' may be attached to the lower flanges 129' of the joists 124'. To further support the gypsum board 290', cross strips for furring strips (not shown) may be attached to the flanges 129' in a transverse direction thereto to provide additional fastening and support surfaces for the gypsum board 290'. In addition, conventional insulation 291' may be installed between the joists 124'.

As can also be seen in FIG. 20, in shear wall applications, an angle 280 may be attached to the lower flange 116 of the joist rim 110 by an appropriate number and arrangement of appropriately sized fasteners (not shown) and also attached to the flange 213 of the upstanding vertical studs 210 by an appropriate number and arrangement of appropriately sized fasteners. For example, depending upon the design loads that this particular connection arrangement must support, the angle 280 may comprises a 2"×2"×16 gauge, 50 ksi continuous angle with (1) #10-16 screw to flange 116 of joist rim 110 at 6" on center and (1) #10-16 screw to the stud flange 213 at each stud 210. Angle 280 may serve to transfer load from the shear wall diaphragm thru the joist/rim.

Figure 21:
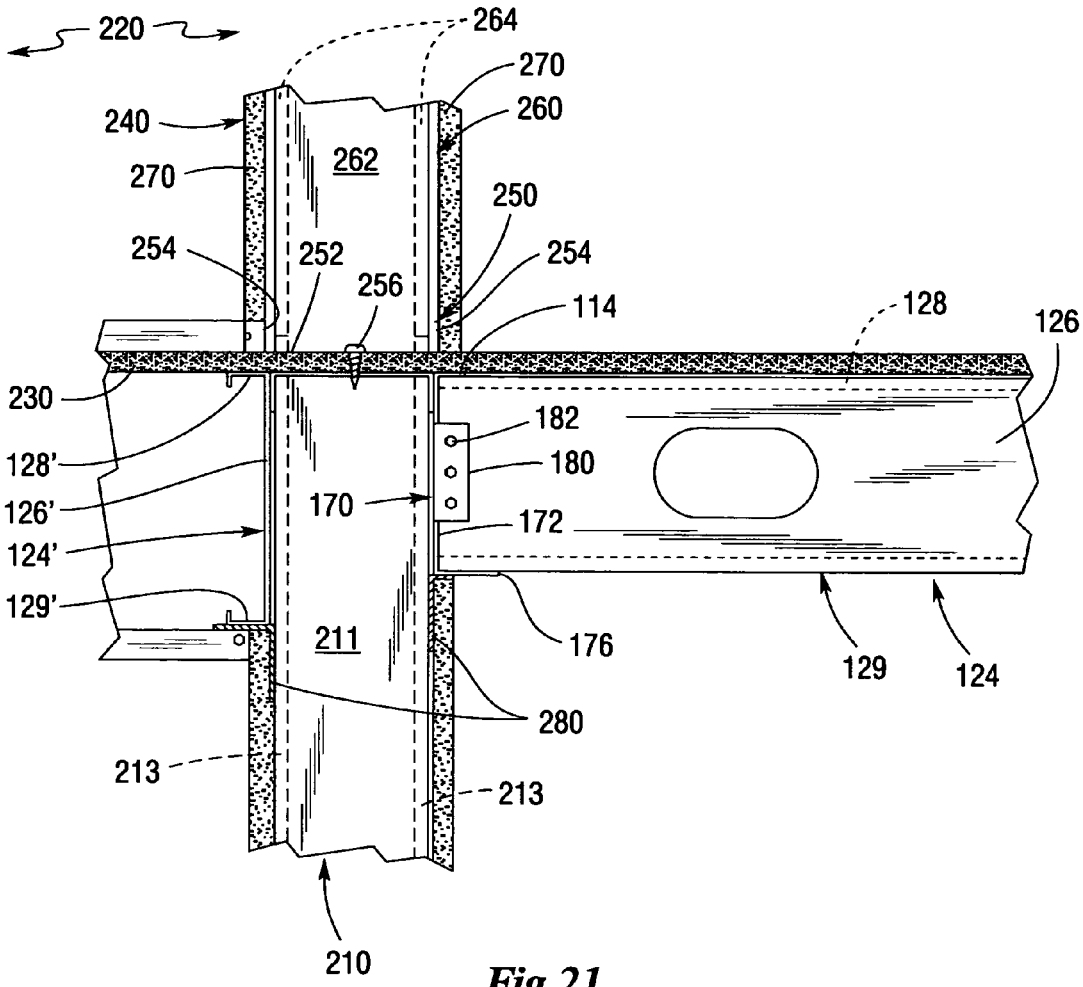
FIG. 21 is a partial elevational view of the joist end bearing arrangement of FIG. 19 wherein a subsequent upper story wall is attached thereto and wherein some components are shown in cross-section.

While this embodiment has been described in connection with use of a joist rim 110 that is provided with connection tabs 120 that are integrally formed in the rim web 112 thereof, it will be appreciated that a joist rim 170 of the type and construction described with respect to the embodiment depicted FIG. 19 may be employed in place of the joist rim 110. More particularly and with reference to FIG. 21, the C-shaped joist rim 170 has a rim web 172 and an upper rim flange 174 and a lower rim flange 176. The first joists 124 are attached to the web 172 by L-shaped clip angles 180. The clip angles 180 may be attached to the web 172 of the joist rim 170 and the joist web 126 of the first joists 124 by, for example, appropriately sized screws or bolts 182 or by welding, etc. In an alternative embodiment, the screws, rivet, bolts, etc. that attach the clip angles 180 to the web 172 of the joist rim 170 can also serve to attach the web 172 to the flanges of the studs 210. The upper joist flanges 128 of the first joists 124 may be affixed to the upper rim flange 174 of the joist rim 170 by appropriate fasteners such as screws, rivets, bolts, welding, etc. (not shown). The remaining details of the system and components depicted in FIG. 21 may otherwise be as described above for the arrangements and components depicted in FIG. 20.

The use of noncombustible boards as floor decking in the manners described above provide a vast improvement over prior floor systems employing floor arrangements that employ concrete floor slabs that are either poured in place or are precast. For example, to employ poured concrete slabs, forms must be prepared prior to pouring. Then the concrete must be poured and then finished by hand. If the floor is located on an elevated floor, pumps must often be used to pump the concrete to the desired location. Such activities require additional labor and time to complete. Moreover, while the use of precast concrete slabs purport to address such problems, they often require the use of rebar and grouting to be used to adjoin abutting slabs which adds to the time and labor required to complete an installation. In addition, noncombustible board of the types described above may generally be lighter and less bulky to handle and install than prior precast concrete slabs. It will be further appreciated that the noncombustible board arrangements depicted above also serve to create effective fire and smoke barriers between floors without the need to add separate fire blocking members in the frame structure. Furthermore, the noncombustible board reduces the overall weight of each respective floor, thus enabling taller buildings to be built. Such lightweight structures also reduce the costs associated with providing adequate bearing support often need when utilizing prior floor construction methods. In addition, when employing poured concrete floors, separate tradespersons are often used to conduct the pouring of the floor. With various embodiments of the present invention, the framing crews can also be used to install the floor materials. This can be very advantageous in simplifying the scheduling process when leads to shorter construction times, fewer missed deadlines, and lower construction costs.

Figure 22:
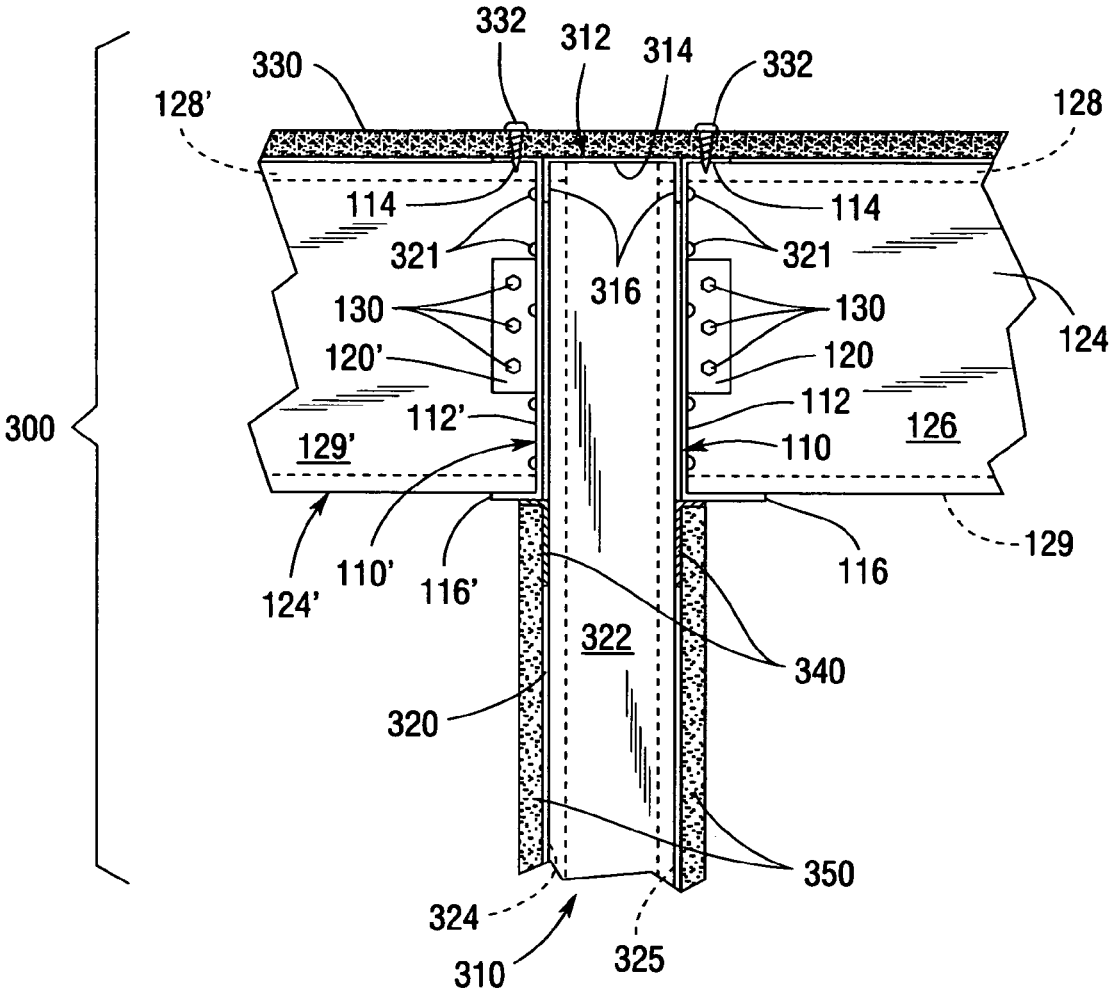
FIG. 22 is a partial elevational view of another floor connection arrangement of the present invention showing some components in cross-section.

Another floor connection arrangement 300 of the present invention is depicted in FIG. 22. This connection may be employed to form an interior bearing wall of a single or multi-story structure. For example, this embodiment may be employed in the structure depicted in FIG. 15 as shown and may employ a first joist rim 110 and a second joist rim 110'. Joist rims 110 and 110' may be of the type and construction described above. As can be seen in FIG. 22, the joist rims 110 and 110' may be attached to a lower wall generally designated as 310 and which may include a C-shaped upper track 312 of the type and construction described above and which has a track web 314 and two downwardly extending track flanges 316. A plurality of C-shaped studs 320 of the type and construction described above and each having a stud web 322 and a first stud flange 324 and a second stud flange 325 may extend between a lower track (not shown) and the upper track 312. Each stud 320 may be fabricated from, for example, cold rolled galvanized steel or other suitable metal, the gauge of which may be dependent upon the amount and types of loads that must be supported. The stud flanges 324 and 325 of each stud 320 may be affixed to the flanges 316 of the upper track 312 by fasteners 321. In one embodiment, fasteners 321 may comprise #10-16 screws or the like. However other fasteners and fastening methods may be employed. In this embodiment, the first rim web 112 of the first rim 110 may be attached to the first stud flanges 324 of the studs 320 by an appropriate number of appropriately sized fasteners 321 such as, for example, #10-16 screws. Depending upon the loading characteristics, however, the rim may not be attached to each stud. Likewise, the second rim web 112' of the second rim 110' may be attached to the second stud flanges 325 of the studs 320 by an appropriate number of appropriately sized fasteners 321. The first rim 110 may be attached to the studs 320 such that the first joists 124 may be substantially aligned with the studs 320 and the upper rim flange 114 of the first joist rim 110 is substantially coplanar with the track web 314 of the upper track 312. The upper joist flanges 128 of the first joists 124 may be affixed to the upper rim flange 114 of the first joist rim 110 in the manners described above. The second joist rim 110' may be attached to the studs 320 such that the second joists 124' may be substantially aligned with the studs 320 and the upper rim flange 114' of the second joist rim 110' is substantially coplanar with the track web 314 of the upper track 312. The upper joist flanges 128' of the second joists 124' may be affixed to the upper rim flange 114' of the second joist rim 110' in the manners described above.

To form a floor deck surface, noncombustible board 330 of the types described above may be placed on the upper joist flanges 128, 128' of the joists 124, 124' and the track web 314 of the upper track 312 as shown. It will be appreciated by the reader that the noncombustible board 330 may be so arranged so as to continuously and uninterruptedly span across the points of connection between the joist rims 110 and the upper track 312 such that no seam between adjoining pieces of noncombustible board 330 fall on the connection 300. The noncombustible board 330 may be attached to the upper flanges 114 of the joist rims 110 as shown by an appropriate number and arrangement of fasteners 332. For example, fasteners 332 may comprise #10-16 screws at 6" on center spacing. However other fastener arrangements may be employed to affix the noncombustible board 330 to the connection 300.

As can also be seen in FIG. 22, in shear wall applications, a corresponding angle 340 may be attached to the lower rim flanges 116 and 116' of each joist rim 110, 110' by an appropriate number and arrangement of appropriately sized fasteners (not shown) and also attached to the stud flanges 324 of the upstanding vertical studs 320 by an appropriate number and arrangement of appropriately sized fasteners. For example, depending upon the design loads that this particular connection arrangement must support, the angles 340 may each comprise a 2"×2"×16 gauge, 50 ksi continuous angle and be attached to the flange 116 of joist rim 110 and the stud flange 324 at each stud 320 with appropriate fasteners such as screws, rivets, bolts, welding, etc. In addition, appropriate wall finishing materials such as gypsum sheathing 350 or the like may be attached to the flanges 324 of the vertically extending studs 320 in a known manner to form the desired wall surfaces on wall 310. In an alternative embodiment, sheathing manufactured by CEMCO of 263 Covina Lane, City of Industry, Calif. 91744 under the trademark Sure-Board™ may be attached to the flanges 324 of the vertically extending studs 320 in applications where shear walls are required to resist in plane racking forces created from wind, earthquakes and the like.

While this embodiment has been described in connection with the use of joist rims 110 that each have connection tabs 120 that are integrally formed in their respective rim webs 112, it will be appreciated that a first joist rim 170 and a second joist rim 170' of the type and construction described above may also be effectively employed in place of the joist rims 110, 110'. More particularly and with reference to FIG. 23, each C-shaped first joist rim 170 has a rim web 172 and an upper rim flange 174 and a lower rim flange 176. The first joists 124 are attached to the rim web 172 of the first joist rim 170 by L-shaped clip angles 180. The clip angles 180 may be attached to the rim web 172 of the first joist rim 170 and the joist webs 126 of the first joists 124 by, for example, appropriately sized screws or bolts 182 or by welding, etc. In another embodiment, the rim web 172 may be attached to the stud flanges by the fasteners that attach the clip angles 180 to the rim web 172. The upper joist flanges 128 of the first joists 124 may be affixed to the upper rim flange 174 of the first joist rim 170 by appropriate fasteners (not shown). Likewise, each C-shaped second joist rim 170' has a rim web 172' and an upper rim flange 174' and a lower rim flange 176'. The second joists 124' are attached to the rim web 172' of the second joist rim 170' by L-shaped clip angles 180. The clip angles 180 may be attached to the rim web 172' of the second joist rim 170' and the joist webs 126 of the second joists 124' by, for example, appropriately sized screws or bolts 182 or by welding, etc. The remaining details of the system and components depicted in FIG. 23 may otherwise be as described above for the arrangements and components depicted in FIG. 22.

Figure 23:
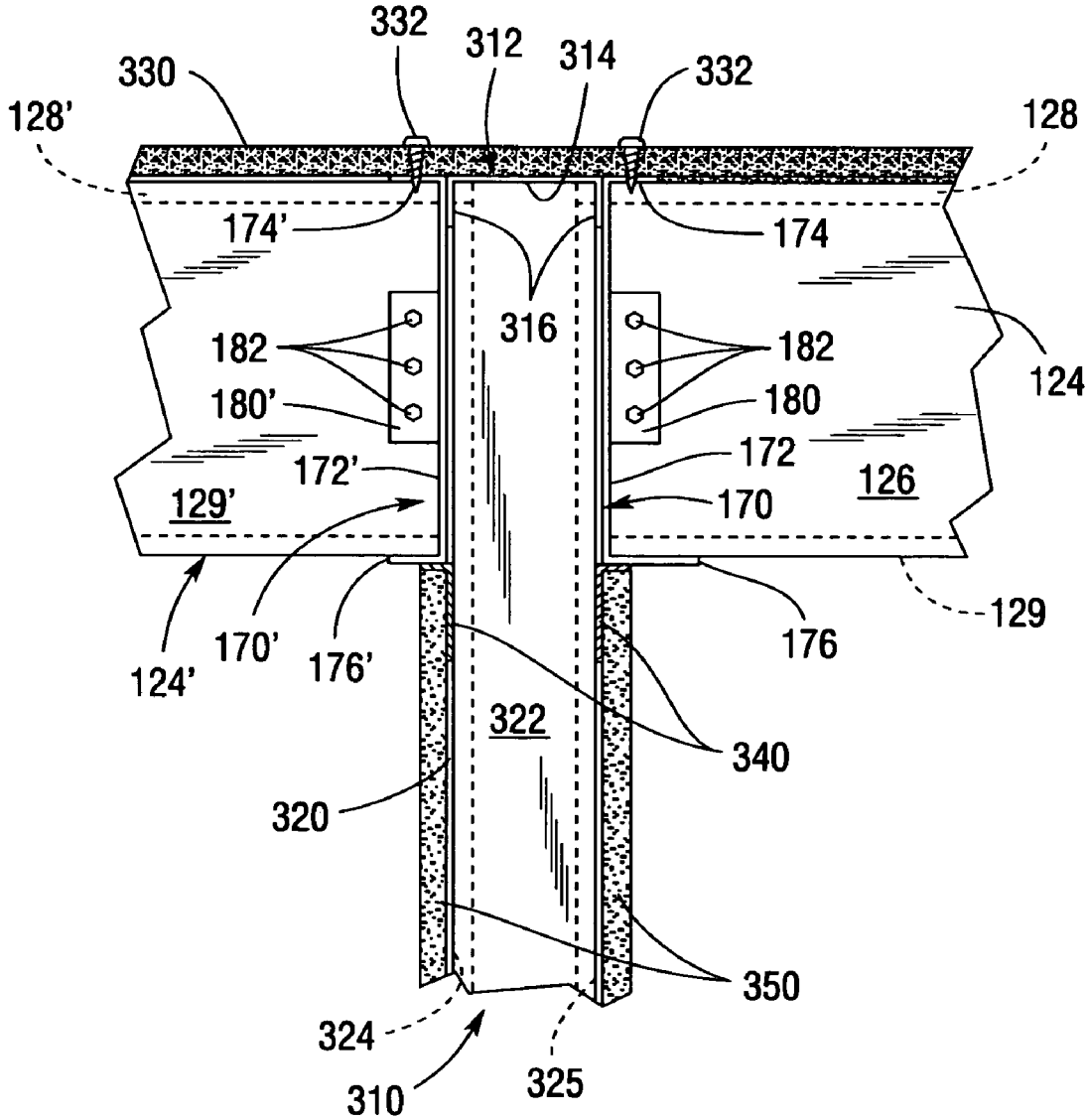
FIG. 23 is a partial elevational view of another floor connection arrangement of the present invention showing some components in cross-section.
Figure 24:
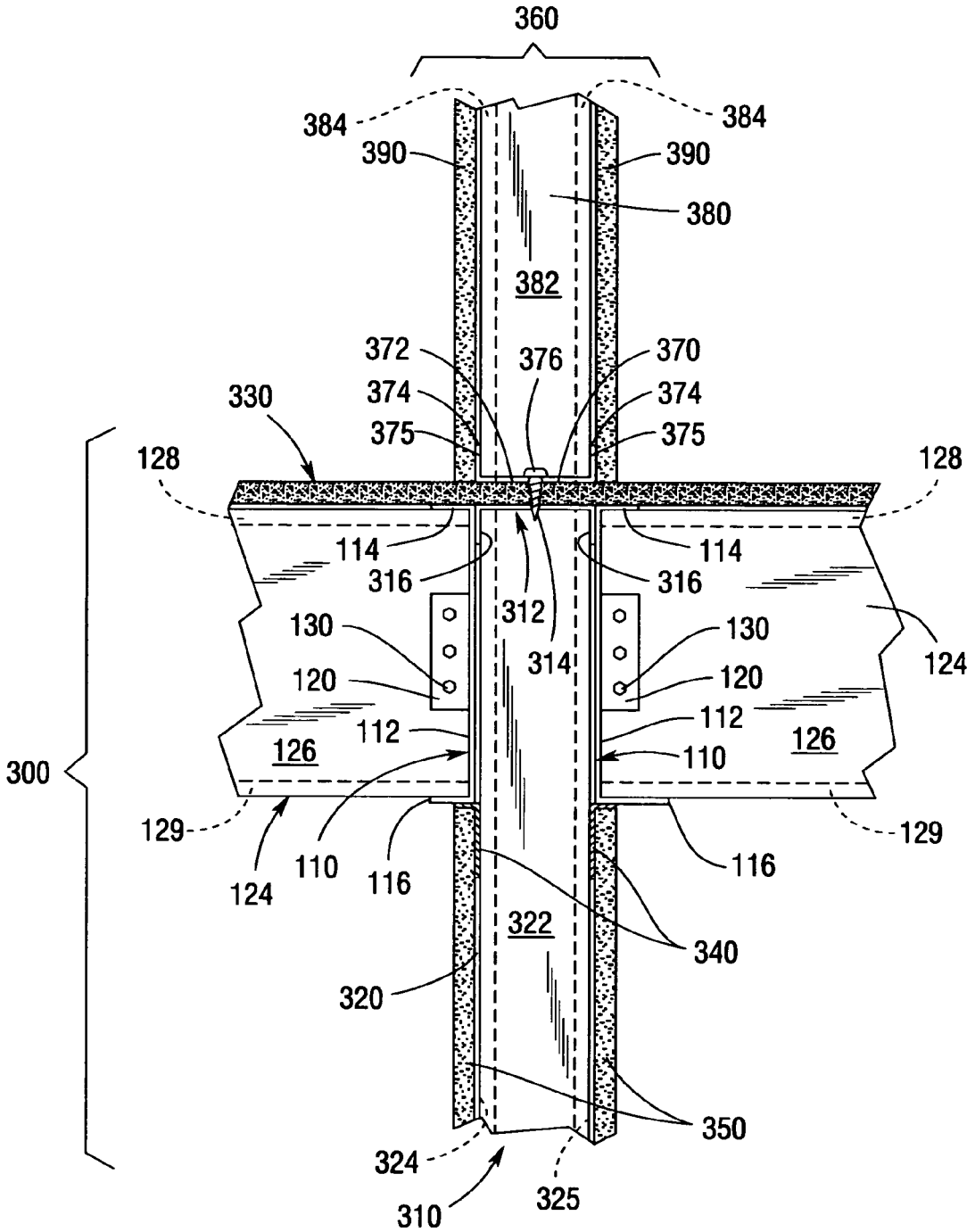
FIG. 24 is a partial elevational view of the floor connection arrangement of FIG. 22 wherein a subsequent upper story wall is attached thereto.
Figure 25:
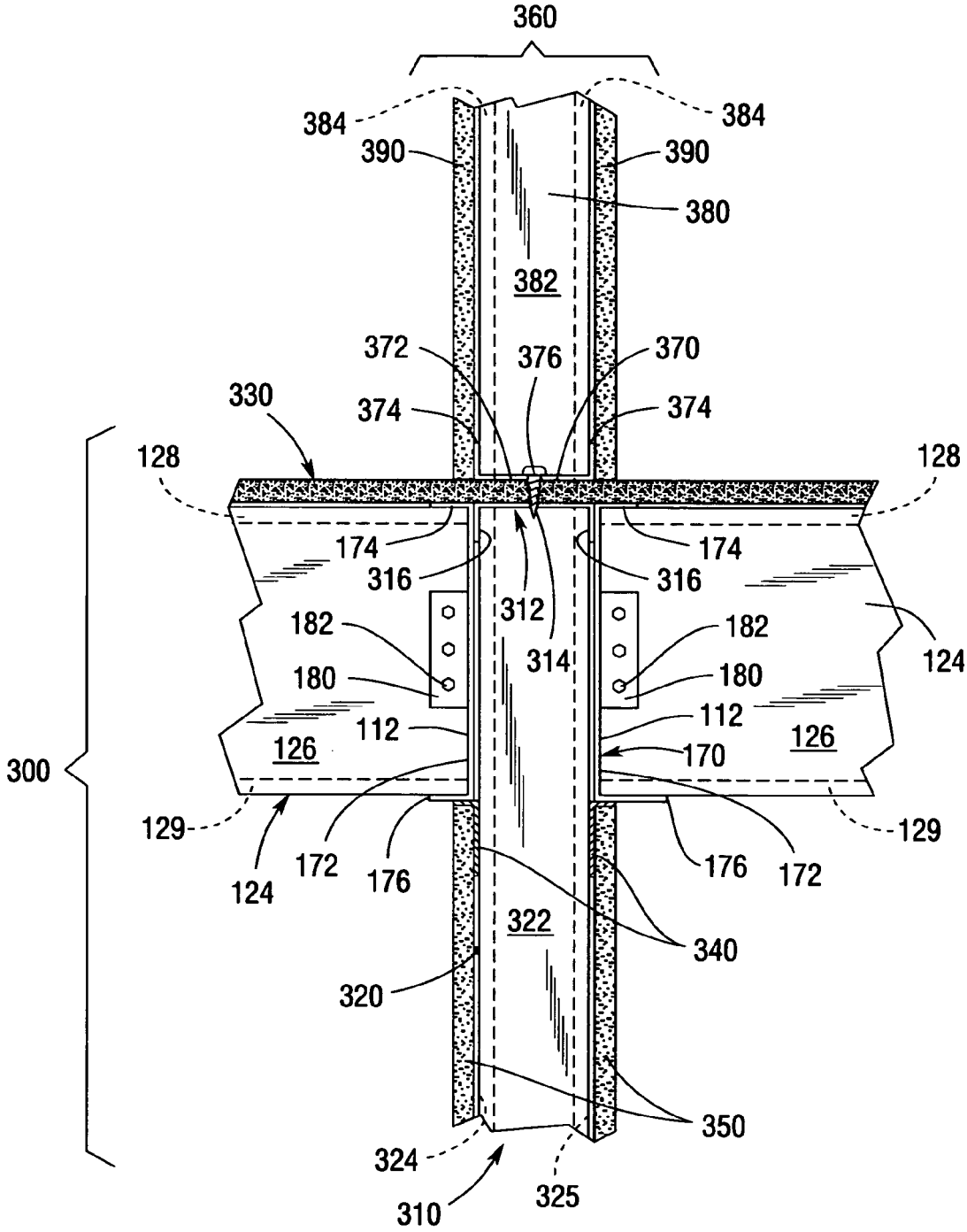
FIG. 25 is a partial elevational view of the floor connection arrangement of FIG. 23 wherein a subsequent upper story wall is attached thereto.

FIGS. 24 and 25 illustrate the addition of a second story (or other upper story) wall 360 attached to the floor connection arrangements 300 depicted in FIGS. 22 and 23, respectively. As can be seen in those Figures, the second story wall 360 may comprise, for example, a lower track 370 that has a track web 372 and two upstanding track flanges 374. The track web 372 of the lower track 370 may be attached to the noncombustible board 330 and the track web 314 of the upper track 312 by an appropriate number, size and configuration of fasteners 376. For example, fasteners may comprise #10-16 screws or rivets, bolts, etc. The second story wall 360 may further include a plurality of vertically extending second studs 380 that each have a stud web 382 and a pair of stud flanges 384 which are attached to the upstanding track flanges 374 of the lower track 370 by, for example, mechanical fasteners 375 such as appropriately sized screws or by welding, etc. For example, fasteners 375 may comprise #10-16 screws or the like. Appropriate wall finishing materials such as gypsum sheathing 390 or the like may be attached to the flanges 374 of the vertically extending second studs 370 in a known manner to form the desired wall surfaces.

While this embodiment has been described in connection with use of joist rims 110 and 110' that have connection tabs 120 and 120' integrally formed in their respective webs 112, 112' it will be appreciated that joist rims 170, 170' of the type and construction described above may also be effectively employed in place of the joist rims 110, 110' as shown in FIG. 25 or combinations of joist rims 110 and 170 could conceivably be employed.

The embodiments depicted in FIGS. 18-25 provide numerous significant advantages over prior construction components and methods. One significant advantage provided by these various embodiments is the method in which the load from the floor assembly (joist) is transferred to the walls. By designing the end reactions (load from the floor) of the joist to transfer through the joist rims to the wall studs, various significant benefits may be attained. For example, one advantage that may be realized by using these embodiments is that separate web stiffeners are not required to prevent crippling of the joist rim. Thus, these embodiments of the present invention may result in lower material and labor costs when compared to prior systems that employ web stiffeners for preventing web crippling. Yet another advantage of these embodiments is that sufficient structural support may be achieved without the need for "building up" members (for example arranging joist rims in back to back fashion as employed in the prior art framing arrangement of FIG. 6) which also leads to lower material and labor costs. Furthermore, use of the noncombustible board 330 provides further strength to the wall system and provides a complete fire barrier between floors. In addition, the embodiments depicted in FIGS. 22-25 serve to remove vertical loads in the joists. That is, these embodiments do not carry the cumulative loads of all of the walls and floors above. Also these embodiments enjoy improved lateral connection characteristics when compared to prior connection arrangements because the connection between upper and lower walls is directly adjacent to each other. If the joist is in between as in platform framing, the connection and load path are complicated by an 8" or 14" through cavity. Still another advantage that may be gained from these various embodiments is that the need to align the joists with the wall studs is eliminated.

Figure 26:
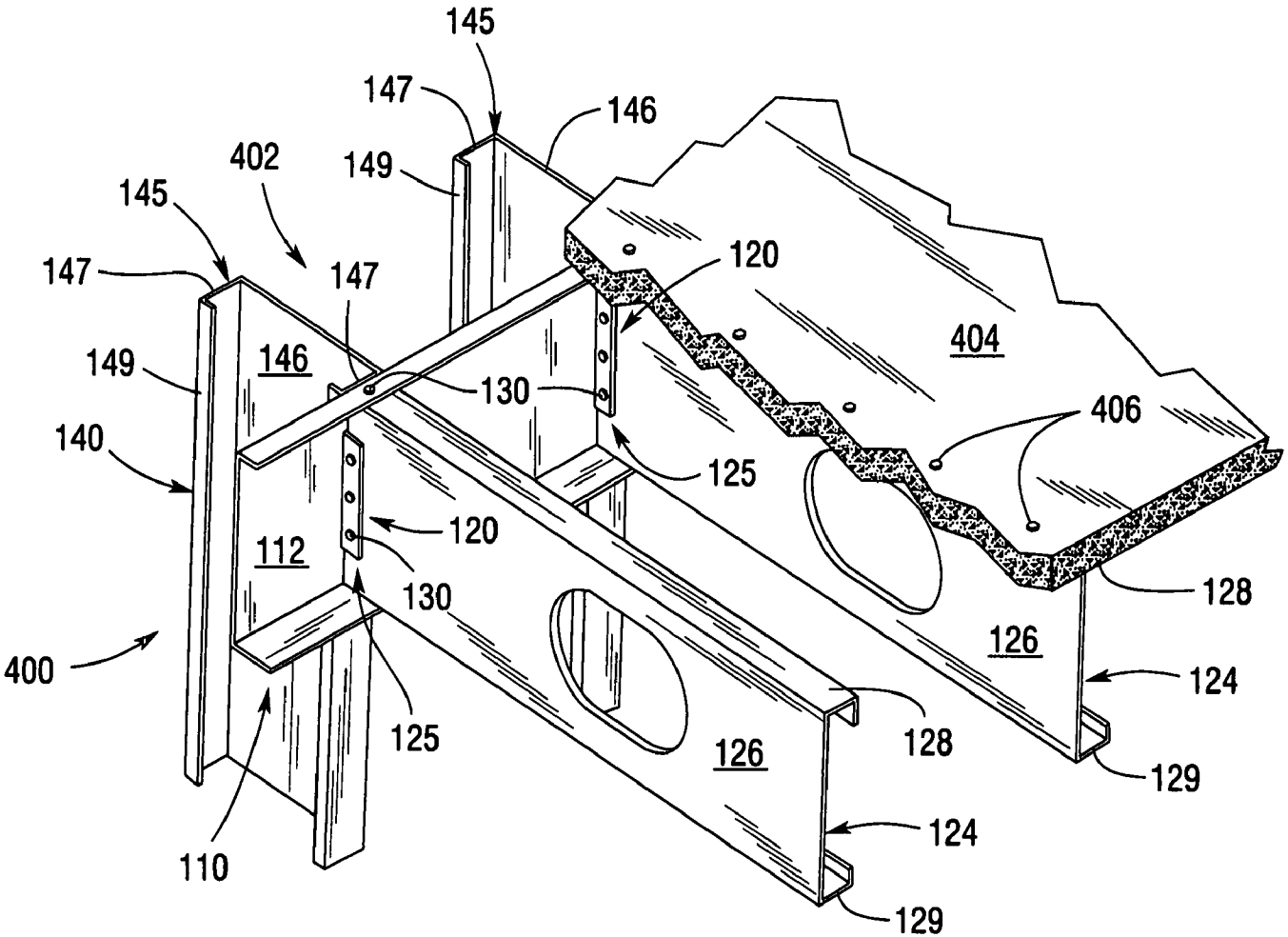
FIG. 26 is a partial perspective view of another embodiment of a floor connection arrangement of the present invention.
Figure 27:
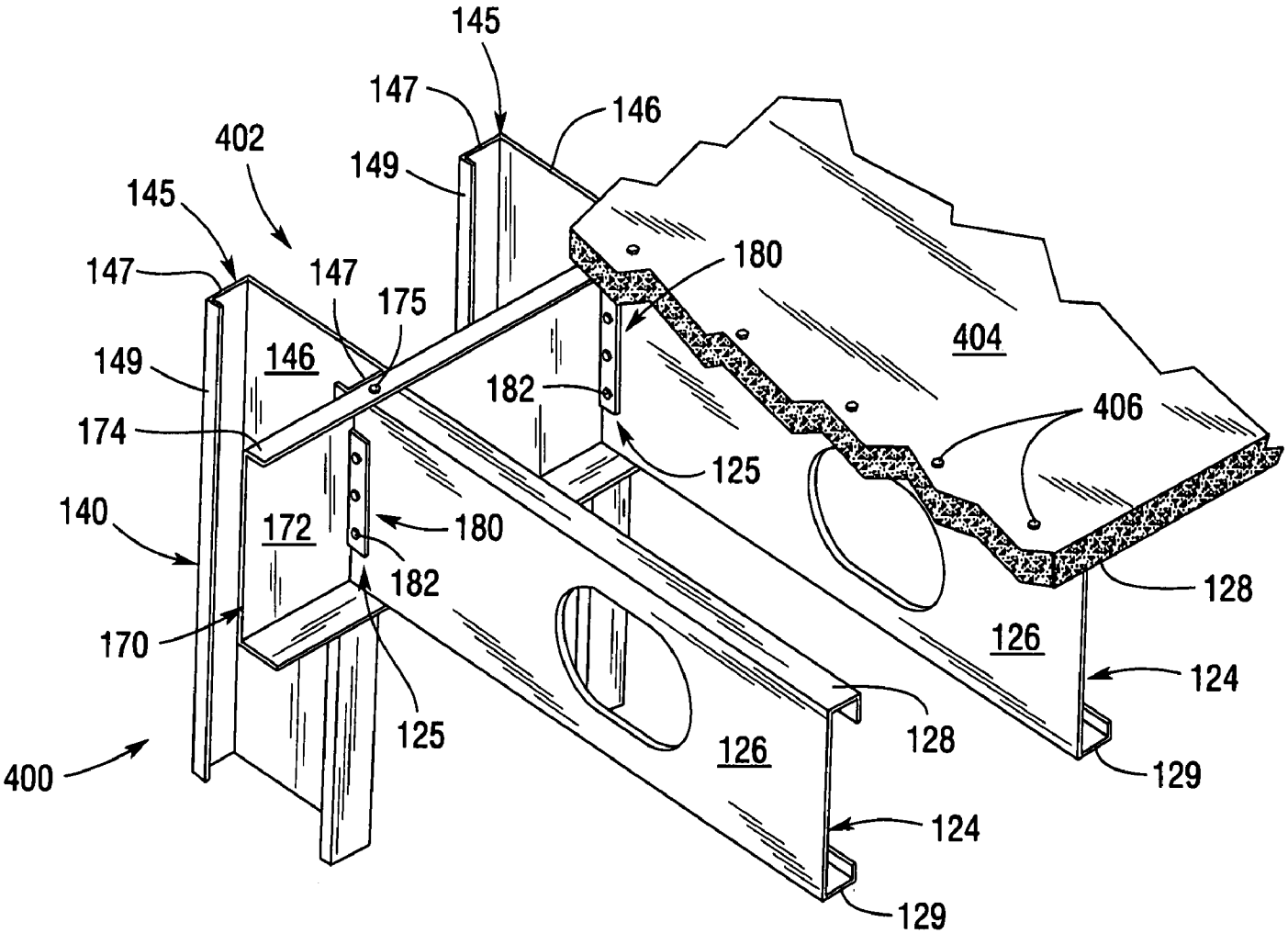
FIG. 27 is a partial perspective view of another embodiment of a floor connection arrangement of the present invention.

FIGS. 26 and 27 depict a wall/floor connection arrangement 400 for a subsequent story. For example, the connection arrangement 400 may be employed for the story or stories above the embodiments depicted in FIGS. 16 and 17 such that the subsequent floor arrangement 400 is affixed to the top of the bearing wall 140. As was described above, the bearing wall 140 may include a plurality of C-shaped vertically extending studs 145 that each has a stud web 146 and a pair of stud flanges 147 that have a lip 149 protruding therefrom. The vertically extending studs 145 may be fabricated from, for example, cold rolled galvanized steel or other suitable metal, the gauge of which may be dependent upon the amount and types of loads involved.

As can also be seen in FIG. 26, a joist rim 110 of the type and construction described above may be attached to the stud flanges 147 of the studs 145 for coupling a plurality of floor joists 124 of the type and construction as described above. The rim web 112 of the joist rim 110 may be attached to the stud flanges 147 of studs 145 by, for example, #10-16 screws, bolts, rivets, welding, etc. The joist rim 110 has a plurality of attachment tabs 120 integrally formed in the rim web 112 for affixing the ends 125 of C-shaped metal floor joists 124 thereto. The attachment tabs 120 may be punched out of the rim web 112 of the joist rim 110 and may be bent at a 90° angle relative to the rim web 112. Such arrangement results in the formation of openings (not shown) through the rim web 112 of the joist rim 110. To provide additional reinforcement to the web 112 around the openings, reinforcing ribs 122 may be provided on each side of each opening and which further permits the attachment tab 120 to function as a structural connection between the joist rim 110 and a corresponding floor joist 124. The floor joists 124 may each have a joist web 126, an upper joist flange 128 and a lower joist flange 129 and may be fabricated from, for example, cold rolled galvanized steel or other suitable metal, the gauge of which may be dependent upon the amount and types of loads that the floor must support. The attachment tabs 120 may be provided in the joist rim 110 at any desired interval, however, those of ordinary skill in the art will appreciate that it may be advantageous to provide the attachment tabs 120 at intervals of 8", 12", 16", 19.2" or 24" which are generally accepted spacing schemes for studs and joists within the construction industry. Thus, the tabs 120 may be so oriented such that the joists 124 attached thereto are aligned with corresponding studs 145. The webs 126 of the floor joists 124 may be attached to corresponding attachment tabs 120 by appropriate fastening methods. For example, mechanical fasteners 130 such as #10-16 screws or the like may be employed in an appropriate number and configuration. However, it is conceivable that other fastening methods such as welding could be employed to affix the joists 124 to the tabs 120. In addition, the upper joist flange 128 of each floor joist 124 may be attached to the upper rim flange 114 of the joist rim 110 by appropriately sized fasteners 130 such as, for example, #10-16 screws or the like. The connection of the joist rim 110 to the wall 200 through the use of fasteners 130 or the like serves to transfer the load from the joist to the walls.

The joist rim 110 may be attached to the stud flanges 147 of the studs 145 such that the upper rim flange 114 of the joist rim 110 is substantially co-planar with the ends 149 of the studs 149 and the upper flanges of the joists 124 to form a substantially coplanar frame arrangement, generally designated as 402, for receiving floor decking material 404. In one embodiment, the floor decking material 404 may comprise noncombustible board material of the types described above. The floor decking material 404 may be attached to the joists by an appropriate number and appropriate orientation of fasteners 406 such as, for example, #10-16 screws or the like.

While this embodiment has been described in connection with the use of a joist rim 110 that has connection tabs 120 that are integrally formed in the rim web 112, it will be appreciated that a joist rim 170 of the type and construction described above may also be effectively employed in place of the joist rim 110 or combinations of joist rims 110 and 170 could be used. More particularly and with reference to FIG. 27, the C-shaped joist rim 170 has a web 172 and an upper flange 174 and a lower flange 176. The joists 124 are attached to the rim web 172 of the joist rim 170 by L-shaped clip angles 180. The clip angles 180 may be attached to the rim web 172 of the joist rim 170 and the joist web 126 of the joists 124 by, for example, appropriately sized screws or bolts 182 or by welding, etc. In another embodiment, the rim web 172 may be attached to the flanges of the studs by the same fasteners that attach the clip angle 180 to the rim web 172. Also, the upper joist flanges 128 of the joists 124 may be affixed to the upper rim flange 174 of the joist rim 170 by appropriate fasteners 175 such as, for example, #10-16 screws or the like. The remaining details of the system and components depicted in FIG. 27 may otherwise be as described above for the arrangements and components depicted in FIG. 26.

Figure 28:
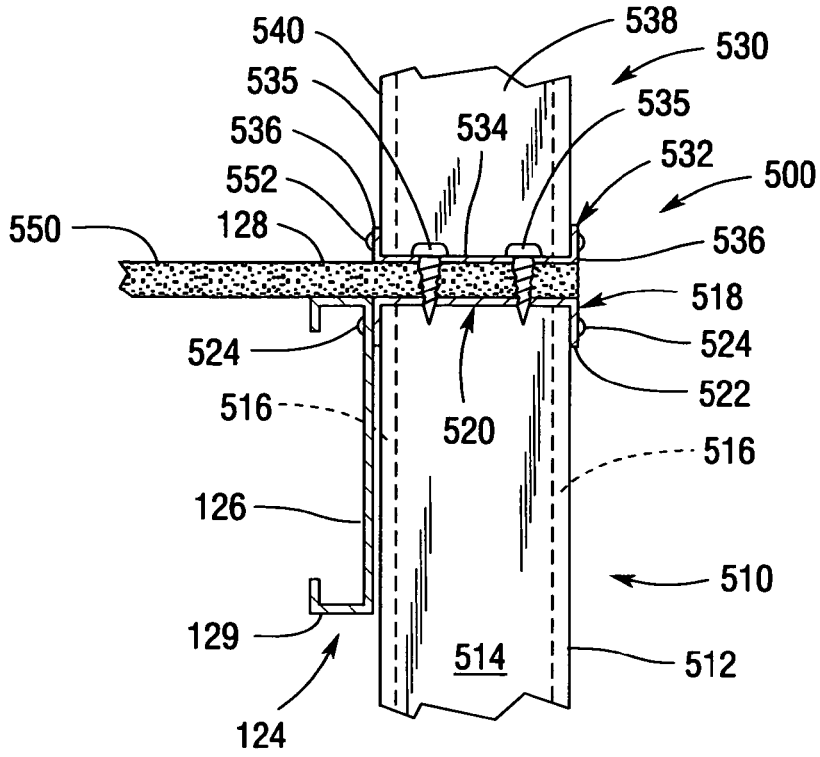
FIG. 28 is a partial elevational view of another floor connection arrangement of the present invention showing some components in cross-section.

FIG. 28 depicts yet another multi-story floor/wall connection arrangement 500 of the present invention. This connection arrangement 500 may, for example, be used in the multi-story building of depicted in FIG. 15 as shown. As can be seen in FIG. 28, a lower wall 510 is aligned with an upper wall 530. Lower wall 510 may include a plurality of vertically extending studs 512 that each has a web 514 and a pair of flanges 516. The upper ends of the studs 512 are received in a C-shaped upper track 518 that has a web 520 and a pair of flanges 522. The flanges 516 may be attached to the flanges 522 of the upper track 518 by an appropriate number and arrangement of appropriate fasteners 524. As can also be seen in FIG. 28, a floor joist 124 of the type and construction described above may be attached to the flanges 516 of the studs 512 as shown. The joist 124 may have a joist web 126 and an upper joist flange 128 and a lower joist flange 129. The joist 124 may be attached to the flanges 516 of the studs 512 with appropriate sized fasteners 524. For example, fasteners 524 may comprise #10-16 screws or the like and the joist 124 may be attached to the studs 512 by, for example, two #10-16 screws per stud flange 516 and four #10-16 per jamb post (not shown). However, other fastener arrangements could conceivably be employed to affix the joist 124 to the lower wall 510. As can be seen in FIG. 28, the joist 124 may be attached to the lower wall 510 such that the upper leg 128 of the joist is substantially co-planar with the web of the upper track such that a floor deck 550 may be received thereon. In one embodiment, the floor deck 550 may comprise noncombustible board of the type described above.

The upper wall 530 may be installed on the floor deck 550 and comprise a C-shaped lower track 532 that has a web 534 and a pair of flanges 536. The lower ends of a plurality of vertically extending studs 538 are received in the lower track 532 and flanges 540 of the studs are attached to the flanges 536 of the lower track 532 by, for example, fasteners 552. Fasteners 552 may comprise #10-16 screws or the like. However, other fasteners and fastening methods may be used. The lower track may be attached to the floor decking by fasteners 535. Fasteners 535 may comprise, for example, #10-16 screws that extend through the track web 534 of the lower track 532, the floor deck 550 and the track web 520 of the upper track 518. Those of ordinary skill in the art will appreciate that the noncombustible board serves to effectively block fire and smoke from passing from one story to the next through the spaces between the wall studs.

Figure 29:
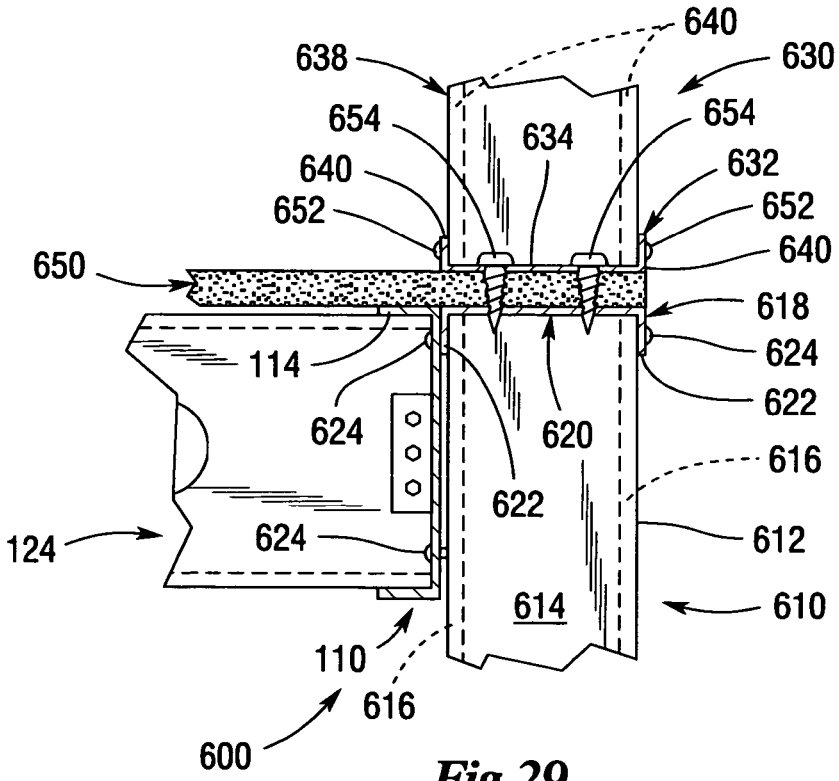
FIG. 29 is a partial elevational view of another floor connection arrangement of the present invention showing some components in cross-section.

FIG. 29 depicts yet another embodiment of a multi-story floor/wall connection arrangement 600 of the present invention. For example, this connection arrangement may be used in a portion of a multi-story structure of the type depicted in FIG. 15. As can be seen in FIG. 29, a lower wall 610 may be aligned with an upper wall 630. Lower wall 610 may include a plurality of vertically extending studs 612 that each has a stud web 614 and a pair of stud flanges 616. The upper ends of the studs 612 may be received in a C-shaped upper track 618 that has a track web 620 and a pair of track flanges 622. The stud flanges 616 may be attached to the track flanges 622 of the upper track 618 by an appropriate number and arrangement of appropriate fasteners 624. As can also be seen in FIG. 29, a joist rim 110 of the type and construction described above may be attached to the stud flanges 616 of the studs 612 as shown. The joist rim 110 may have a rim web 112 and an upper rim flange 114 and a lower rim flange 116. The joist rim 110 may be attached to the stud flanges 616 of the studs 612 with appropriate sized fasteners 624 or by other fastening methods such as welding. Fasteners 624 may comprise, for example, #10-16 screws, rivets or bolts. Joist rim 110 may be attached to the studs 612 by, for example, screws, bolts, rivets, and welds. However, other fastener arrangements could conceivably be employed to affix the joist rim 110 to the lower wall 610. As can be seen in FIG. 29, the joist rim 110 may be attached to the lower wall 610 such that the upper rim flange 114 of the joist rim 110 is substantially co-planar with the track web 620 of the upper track 618. In addition, a plurality of joists 124 of the type and construction described above, may be attached to the tabs 120 on the joist rim 110 in the manners described above such that a floor deck 650 may be received thereon as shown. In one embodiment, the floor deck 650 may comprise noncombustible board of the types described above.

The upper wall 630 may be installed on the floor deck 650 and comprise a C-shaped lower track 632 that has a track web 634 and a pair of track flanges 636. The lower ends of a plurality of vertically extending studs 638 are received in the lower track 632 and stud flanges 640 of the studs 638 are attached to the track flanges 636 of the lower track 632 by, for example, fasteners 652. Fasteners 652 may comprise #10-16 screws or the like. The lower track 638 may be attached to the floor decking 650 and the upper track 618 by fasteners 654. Fasteners 654 may comprise, for example, #10-16 screws that extend through the track web 634 of the lower track 634, the floor decking 650 and the track web 620 of the upper track 618. Those of ordinary skill in the art will appreciate that the noncombustible floor decking board serves to form an effective fire and smoke barrier between the upper wall 630 and the lower wall 610.

Figure 30:
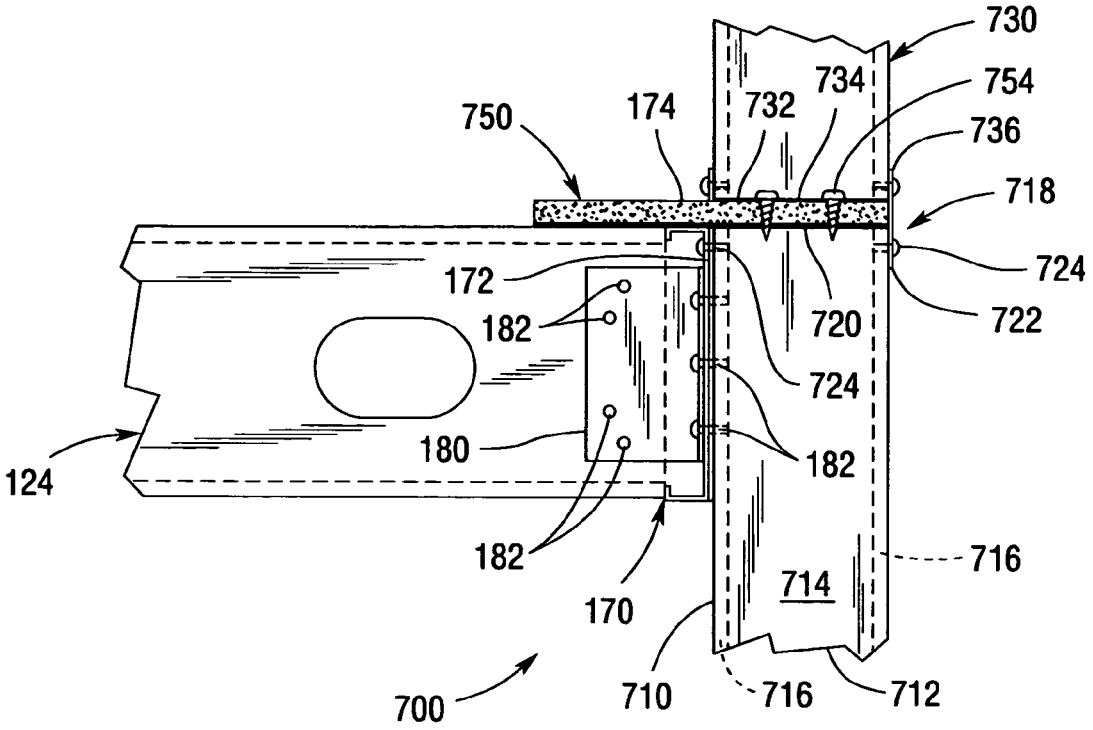
FIG. 30 is a partial elevational view of another floor connection arrangement of the present invention showing some components in cross-section.
Figure 31:
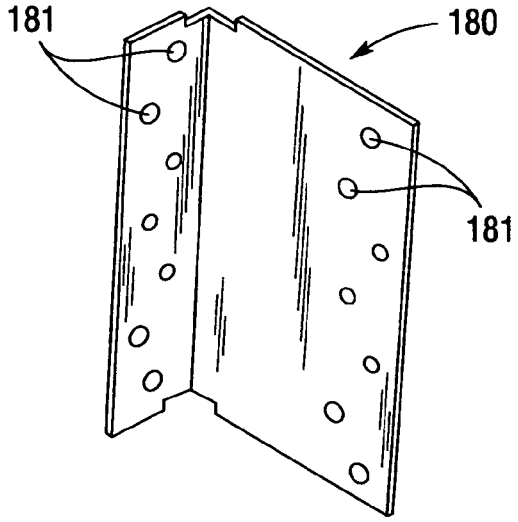
FIG. 31 is a perspective view of a clip that may be used to affix a joist to a joist rim of the type depicted in FIG. 30.

FIG. 30 depicts yet another multi-story floor/wall connection arrangement 700 of the present invention. FIG. 15 illustrates one example wherein the arrangement 70 may be used in a portion of a multi-story building. As can be seen in that Figure, a lower wall 710 is aligned with an upper wall 730. Lower wall 710 may include a plurality of vertically extending studs 712 that each has a stud web 714 and a pair of stud flanges 716. The upper ends of the studs 712 are received in a C-shaped upper track 718 that has a track web 720 and a pair of track flanges 722. The stud flanges 716 may be attached to the track flanges 722 of the upper track 718 by an appropriate number and arrangement of appropriate fasteners 724. In one embodiment, fasteners 724 may comprise #10-16 screws or the like. As can also be seen in FIG. 30, a joist rim 170 of the type and construction described above may be attached to the stud flanges 716 of the studs 712 as shown. The joist rim 170 may have a rim web 172 and an upper rim flange 174 and a lower rim flange 176. The joist rim 170 may be attached to the stud flanges 716 of the studs 612 with appropriate sized fasteners 724. For example, fasteners 724 may comprise #10-16 screws or the like and the joist rim 170 may be attached to the studs 712 and jamb posts by, for example, by an appropriate number of #10-16 screws. However, other fastener arrangements could conceivably be employed to affix the joist rim 170 to the lower wall 710. As can be seen in FIG. 30, the joist rim 170 may be attached to the lower wall 710 such that the upper rim flange 174 of the joist rim 170 is substantially co-planar with the track web 720 of the upper track 718. In addition, a plurality of joists 124 of the type and construction described above, may be attached to the joist rim 170 by a plurality of corresponding L-shaped clips 180 of the type and construction shown in FIG. 31. Clips 180 may be fabricated from, for example, 16 or other gauge steel have a variety of different leg lengths such as, for example, 2"×2", 4"×4", 2"×4", etc. and have a plurality of holes 181 therethrough for receiving the appropriate number of fasteners 182 therethrough to affix the clips 180 to the webs 126 of the corresponding joists 124 and the web 172 of the joist rim 170. In one embodiment, fasteners 182 may comprise, for example, #10-16 screws. However other fasteners and fastening methods could be employed. As can also be seen in FIG. 30 a floor deck 750 is received on the web 720 of the upper track 718, the upper flange 174 of the joist rim 170 and the upper flanges 128 of the joists 124. In one embodiment, the floor deck 750 may comprise noncombustible board of the types described above.

The upper wall 730 may be installed on the floor deck 750 and comprise a C-shaped lower track 732 that has a track web 734 and a pair of track flanges 736. The lower ends of a plurality of vertically extending studs 738 are received in the lower track 732 and stud flanges 740 of the studs 738 are attached to the track flanges 736 of the lower track 732 by, for example, fasteners 752. Fasteners 752 may comprise #10-16 screws or the like or other appropriate fasteners or fastening arrangements. The lower track 738 may be attached to the floor decking 750 by fasteners 754. Fasteners 754 may comprise, for example, #10-16 screws that extend through the track web 734 of the lower track 7732, the floor decking 750 and the track web 720 of the upper track 718. Those of ordinary skill in the art will appreciate that the noncombustible floor decking board 750 serves to form an effective fire and smoke barrier between the upper wall 730 and the lower wall 710.

Figure 32:
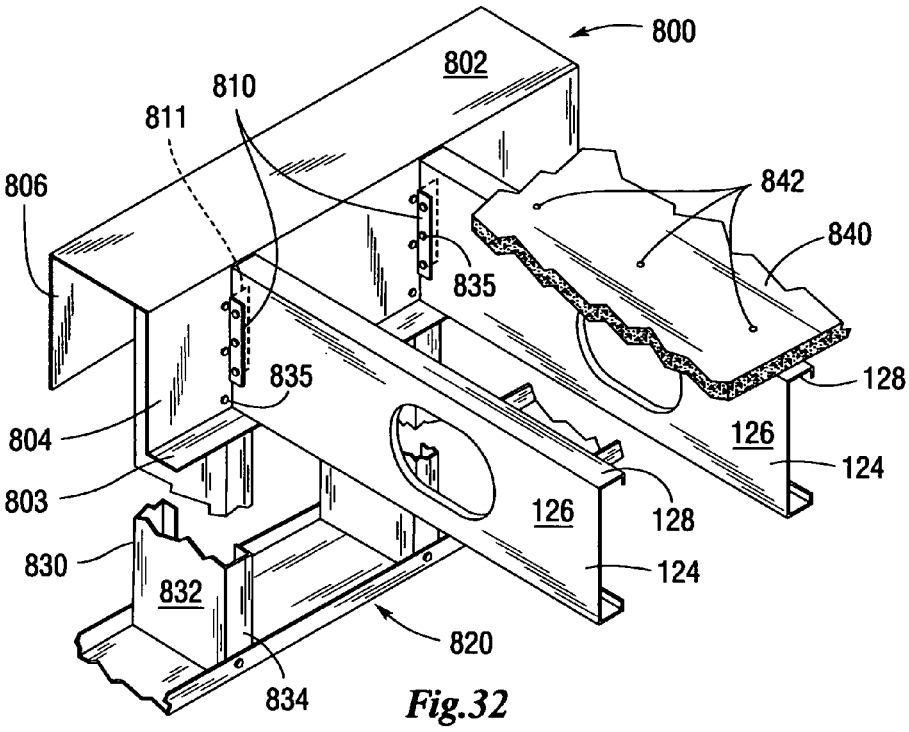
FIG. 32 is a partial perspective view of another joist end bearing arrangement of the present invention utilizing a combination header/joist rim of the present invention.
Figure 33:
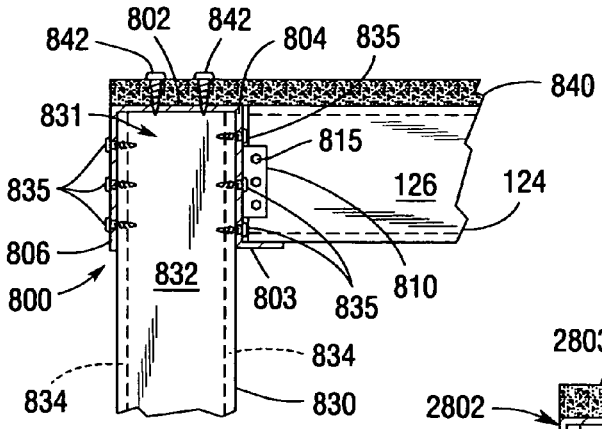
FIG. 33 is a partial cross-sectional elevational view of the joist end bearing arrangement of FIG. 32.

FIGS. 32 and 33 depict a unique and novel combination joist rim and wall header 800 of the present invention used in connection with a floor connection arrangement of the present invention. As can be seen in those Figures, the joist rim/header 800 may have a first header flange 804 and a second header flange 806 that depend from a header web 802 in a spaced opposing relationship. The joist rim/header 800 may be fabricated from, for example, cold rolled galvanized steel or other suitable metal, the gauge of which may be dependent upon the amount and types of loads that the floor must support. The first header flange 804 may be provided with a plurality of integrally formed first attachment tabs 810 for affixing the ends 125 of C-shaped first metal floor joists 124 thereto. The first attachment tabs 810 may be punched out of the first header flange 804 of the joist rim/header 800 at first predetermined intervals and may bent at a first predetermined angle relative to the first header flange 804. In one embodiment, the first predetermined intervals may be, for example, intervals of 8", 12", 16", 19.2" or 24" and the first predetermined angle may be, for example, 90°. Such arrangement also may result in the formation of first openings 811 through the first header flange 804 of the joist rim/header 800. The first floor joists 124 may be of the type and construction described above. The joist webs 126 of the first floor joists 124 may be attached to corresponding first attachment tabs 810 by appropriate fastening methods. For example, mechanical fasteners 815 such as #10-16 screws or the like may be employed in an appropriate number and configuration. However, it is conceivable that other fastening methods such as welding or bolting could be employed to affix the first floor joists 124 to the first attachment tabs 810. Joist rim/header 800 may also be provided with a lower rim flange 803 as shown in FIGS. 32 and 33.

In this embodiment, the first header flange 804 of the joist rim/header 800 may be attached to studs 830 of a bearing wall 820. The bearing wall 820 may be constructed as described above and include a plurality of studs 830 that each have a top portion 831 that are each are coupled to the first header flange 804 and the second header flange 806 of the joist rim/header 800. Thus, the joist rim/header 800 also functions as the header for the wall 820. The studs 830 may each have a stud web 832 and a pair of stud flanges 834 protruding from the stud web 832. The stud webs 804 and 806 may be attached to the stud flanges 834 of the studs 830 by fasteners 835 which may for example comprise #10-16 screws or the like. However, other fastener arrangements and methods may also be employed. As can also be seen in FIG. 32, the studs 830 may be attached to the joist rim/header 800 such that the studs 830 are aligned with the first floor joists 124. To complete the installation, floor decking material 840 may be attached to the upper header flange 802 of the joist rim/header 800 and the joist flanges 128 of the first floor joists 124. Floor decking material 840 may comprise, for example, the noncombustible board material described above and be attached to the top header flange 802 and the upper joist flanges 128 by an appropriate number of fasteners 842. Fasteners 842 may comprise, for example, #10-16 screws or the like. However, other fasteners and fastening methods may also be employed.

Figure 32A:
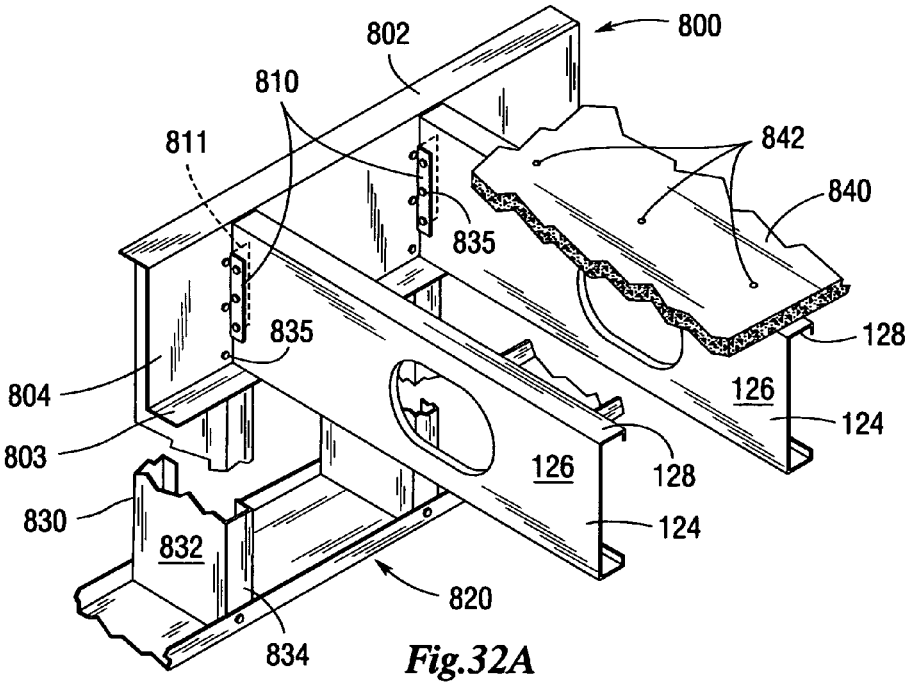
FIG. 32A is a partial perspective view of another joist end bearing arrangement of the present invention utilizing a joist rim of the present invention.

FIG. 32A depicts the use of an alternative joist rim 800' that is substantially "Z"-shaped when viewed from one of its ends.

The joist rim 800' has a web 804', a lower leg 803' and an upper leg 802'. As can be seen from that Figure, upper leg 802' is shorter than leg 802 in the embodiment depicted in FIG. 32. However, the rim 800' is employed in the same manner as described in detail above with respect to use of the joist rim 800, except that it lacks a leg portion 806.

Figure 33A:
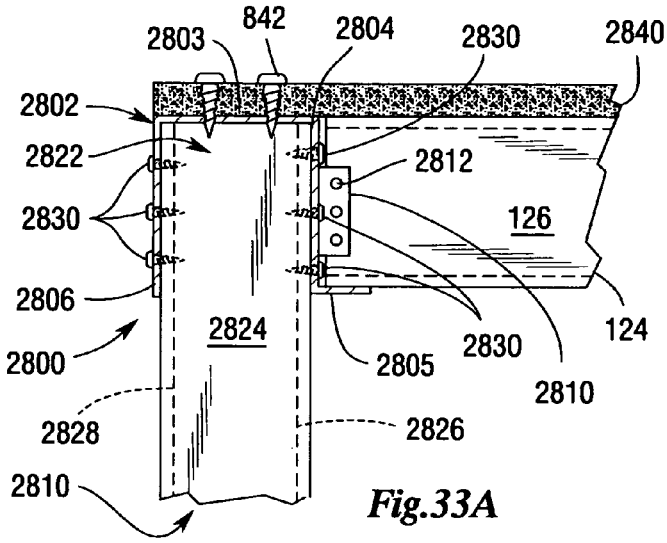
FIG. 33A is a partial cross-sectional elevational of another joist end bearing arrangement of the present invention employing another combination header/joist rim of the present invention.

An alternative embodiment of a combined joist/rim header arrangement 2800 of the present invention is depicted in FIG. 33A. In this embodiment, a U-shaped header 2802 is employed. U-shaped header 2802 may have a first header flange 2804 and a second header flange 2806 that depend from a header web 2803 in a spaced opposing relationship and be fabricated from, for example, cold rolled galvanized steel or other suitable metal, the gauge of which may be dependent upon the amount and types of loads that must be supported. The first header flange 2804 may also have a lower flange 2805 formed at its lower end if desired. The U-shaped header 2802 may serve as the top header track for a bearing wall 2810 that is formed from a plurality of vertically extending studs 2820 that each has a top end 2822. Each stud 2820 may further have a web 2824, a first stud flange 2826 and a second stud flange 2828. The U-shaped header may be placed over the top ends 2822 of the studs 2820 and the first header flange 2804 may be attached to the first stud flanges 2826 and the second header flange 2806 may be attached to the second stud flanges 2828 with appropriate fasteners 2830. For example, fasteners 2830 may comprise #10-16 screws or the like. However other fasteners and fastening methods could be employed.

The lower flange 2805 may serve as a support surface for supporting ends of joists 124 to be attached directly to the first header flange 2804 of the U-shaped header 2802. The joists 124 may be attached to the first header flange 2804 utilizing separate L-shaped clips 2810 to affix the joists 124 to the first header flange 2804 in desired intervals. The clips 2810 may be attached to the first header flange 2804 and to the web 126 of a corresponding joist 124 by an appropriate arrangement of fasteners 2812. For example, fasteners 2812 may comprise #10-16 screws or the like. However, other fasteners or fastening methods such as welding, etc. may be employed to affix the L-shaped clips 2810 to the first header flange 2804 and the web 126 of a corresponding joist 124. Floor decking material 2840 may be attached to the header web 2803 and the upper joist flanges 128 of the joists 124 in the manner described above. Such floor decking material 2840 may comprise, for example, noncombustible board material of the types and construction described above. However, it is conceivable that other types of decking material such as, for example, plywood, concrete, etc. could also be successfully employed.

Figure 35A:
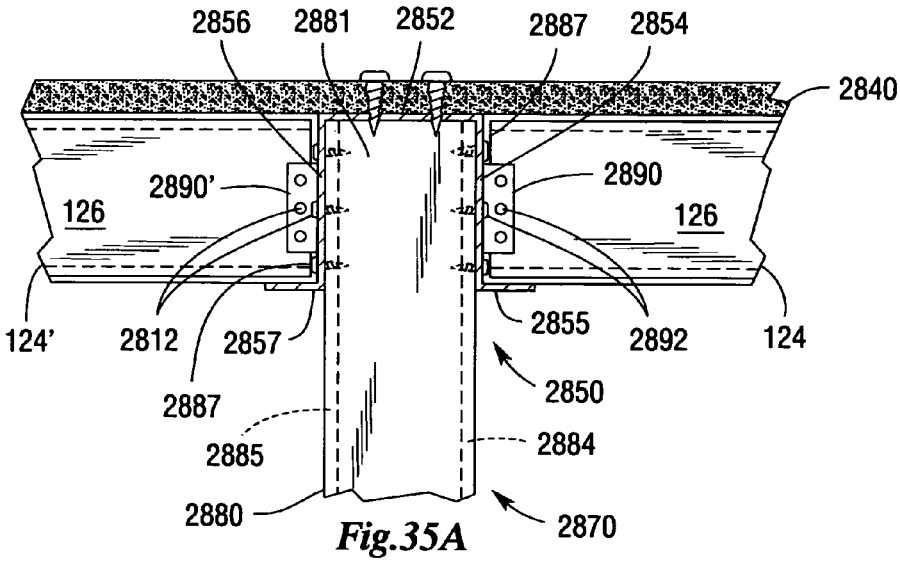
FIG. 35A is a partial cross-sectional elevational of another joist end bearing arrangement of the present invention employing another combination header/joist rim of the present invention.
Figure 34:
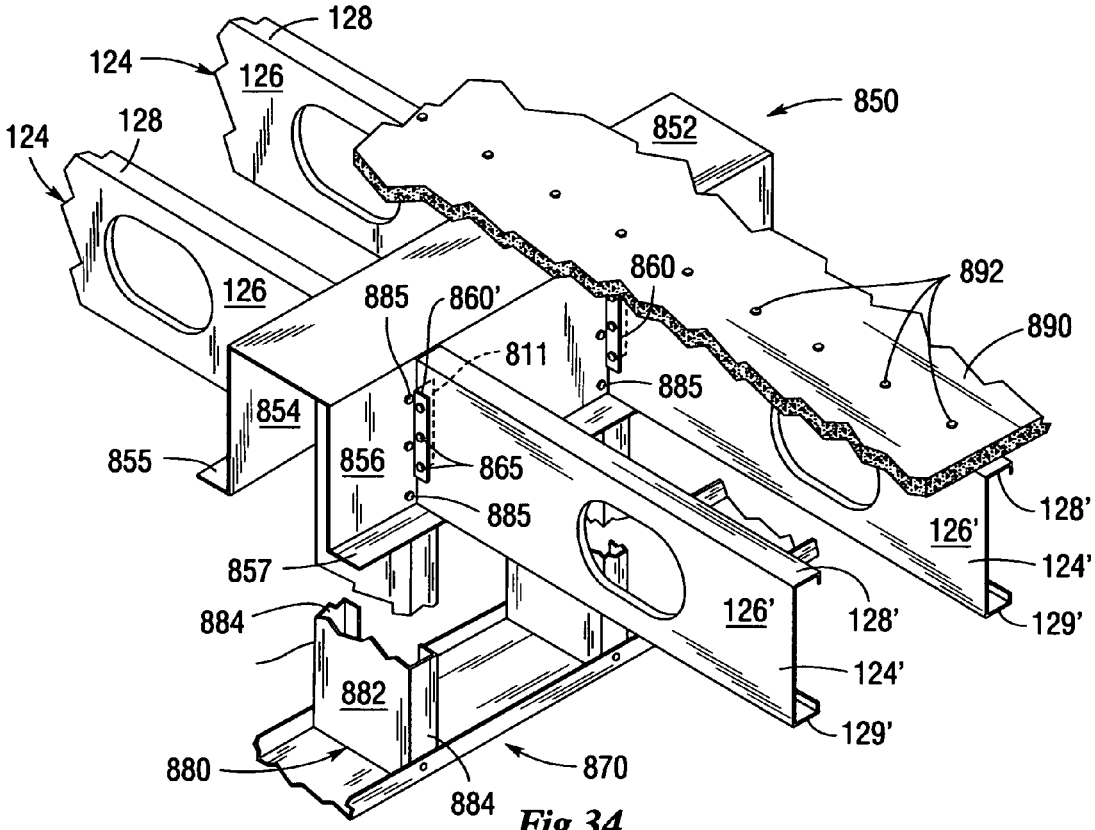
FIG. 34 is a partial perspective view of another joist end bearing arrangement of the present invention employing another combination header/joist rim of the present invention.
Figure 35:
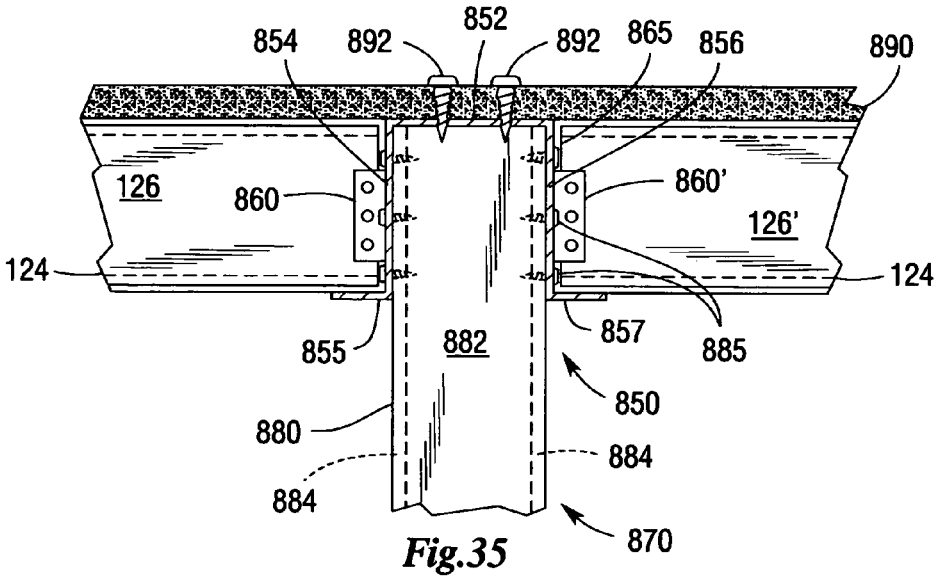
FIG. 35 is a partial cross-sectional elevational view of the joist end bearing arrangement of FIG. 34.

FIGS. 34 and 35 depict another unique and novel joist rim/header 850 of the present invention used in connection with a floor connection arrangement of the present invention. As can be seen in those Figures, the joist rim/header 850 may have a first header flange 854 and a second header flange 856 that depend from a header web 852 in spaced opposing relationship. The joist rim/header 850 may be fabricated from, for example, cold rolled galvanized steel or other suitable material, the gauge of which may be dependent upon the amount and types of loads that the floor connection must support. The first header flange 854 may be provided with a plurality of integrally formed first attachment tabs 860 for affixing the ends 125 of C-shaped first floor joists 124 thereto. Likewise, the second header flange 856 may be provided with a plurality of integrally formed second attachment tabs 860 for affixing the ends 125' of C-shaped second floor joists 124' thereto. The first attachment tabs 860 may be punched out of the first header flange 854 and the second attachment tabs 860 may be punched out of the second header flange 856 of the joist rim/header 850 such that the first attachment tabs 860 in the first header flange 854 are substantially aligned with the second attachment tabs 860 in the second header flange 856. The first attachment tabs 860 may be bent a first predetermined angle relative to the first header flange 854 and the second attachment tabs 860' may be bent at second predetermined angles relative to the second header flange 856. In one embodiment, each first predetermined angle and each second predetermined angle are substantially 90°. Such arrangements result in the formation of first openings 861 through the first header flange 854 and second openings 861' through the second header flange 856 of the joist rim/header 850. A first lower flange 855 may protrude from the first header flange 854 and a second lower flange 857 may protrude from the second header flange 856. The lower flanges 855 and 857 may serve to provide support surfaces for supporting floor joists 124, 124' during installation.

The first floor joists 124 and the second floor joists 124' may be of the type and construction described above. The first attachment tabs 860 may be provided in the first header flange 854 at a first predetermined interval and the second attachment tabs may be provided in the second header flange 856 at a second predetermined interval. The first predetermined intervals may be, for example, intervals of 8", 16", 19.2" or 24" and the second predetermined intervals may be intervals of 8", 16", 19.2" or 24". In one embodiment, the first predetermined interval is the same as the second predetermined interval such that the first joists 124' and the second joists 124' are substantially aligned with each other and may also be aligned with the studs 880 as will be further described below. The webs 126 of the first floor joists 124 may be attached to the first attachment tabs 860 by appropriate fastening methods. For example, mechanical fasteners 865 such as #10-16 screws or the like may be employed in an appropriate number and configuration. However, it is conceivable that other fastening methods such as welding could be employed to affix the first joists 124 to the first tabs 860. Likewise, the webs 126' of the second floor joists 124' may be attached to the second attachment tabs 860' by appropriate fastening methods. For example, mechanical fasteners 865 such as #10-16 screws or the like may be employed in an appropriate number and configuration. However, it is conceivable that other fastening methods such as welding could be employed to affix the second joists 124' to the second tabs 860'.

In this embodiment, the header flanges 854 and 856 of the joist rim/header 850 may be attached to studs 880 of a bearing wall 870. The bearing wall 870 may be constructed as described above and include a plurality of studs 880 that are coupled to the header flanges 854 and 856 of the joist rim/header 850. Thus, it will be appreciated that the joist rim/header 850 also functions as the header track for the wall 870. The studs 880 may each have a stud web 882 and a pair of stud flanges 884 protruding from the stud web 882. The header flanges 854 and 856 may be attached to the stud flanges 884 of the studs 880 by fasteners 885 which may for example comprise #10-16 screws or the like. However, other fastener arrangements and methods may also be employed. As can also be seen in FIG. 34, the studs 880 may be attached to the joist rim/header 850 such that the studs 880 are aligned with the floor joists 124, 124'. To complete the installation, floor decking material 890 may be attached to the upper web 852 and the flanges 128, 128' of the floor joists 124, 124'. Floor decking material 890 may comprise, for example, noncombustible board material described above and be attached to the top web 852 and the upper joist flanges 128, 128' by an appropriate number of fasteners 892. Fasteners 892 may comprise, for example, #10-16 screws or the like. However, other fasteners and fastening methods may also be employed.

FIG. 35A depicts an alternative embodiment of a combined joist/rim header arrangement 2850 of the present invention. In this embodiment, a substantially U-shaped header 2850 is employed. U-shaped header 2850 may have a first header flange 2854 and a second header flange 2856 that depend from a header web 2852 in a spaced opposing relationship and be fabricated from, for example, cold rolled galvanized steel or other suitable metal, the gauge of which may be dependent upon the amount and types of loads that must be supported. The first header web 2854 may also have a lower flange 2855 formed at its lower end if desired. Likewise, the lower end of the second header flange 2856 may have a second lower flange 2857 formed at its lower end. The U-shaped header 2852 may serve as the top header track for a bearing wall 2870 that is formed from a plurality of vertically extending studs 2880 that each has a top end 2881. Each stud 2880 may further have a web 2882, a first stud flange 2884 and a second stud flange 2885. The U-shaped header 2850 may be placed over the top ends 2881 of the studs 2880 and the first header flange 2854 may be attached to the first stud flanges 2884 and the second header flange 2856 may be attached to the second stud flanges 2885 with appropriate fasteners 2887. For example, fasteners 2887 may comprise #10-16 screws or the like. However other fasteners and fastening methods could be employed.

The lower flange 2855 may serve as a support surface for supporting ends of joists 124 to be attached directly to the first header flange 2854 of the U-shaped header 2850 and that the second lower flange 2857 may serve as a support surface for supporting ends of a series of second joists 124' to be attached directly to the second header flange 2854 of the U-shaped header 2850. The series of first joists 124 may be attached to the first header flange 2854 utilizing separate L-shaped clips 2890 to affix the first joists 124 to the first header flange 2854 in desired intervals. The clips 2890 may be attached to the first header flange 2854 and to the web 126 of a corresponding first joist 124 by an appropriate arrangement of fasteners 2892. For example, fasteners 2892 may comprise #10-16 screws or the like. However, other fasteners or fastening methods such as welding, etc. may be employed to affix the L-shaped clips 2890 to the first header flange 2854 and the web 126 of a corresponding first joist 124. Likewise, a series of second joists 124' may be attached to the second header flange 2856 utilizing separate L-shaped clips 2890' to affix the second joists 124' to the second header flange 2856 in desired intervals such that the first joists 124 may be substantially aligned with the second joists 124' and the studs 2880. The clips 2890' may be attached to the second header flange 2856 and to the web 126' of a corresponding second joist 124' by an appropriate arrangement of fasteners 2892. For example, fasteners 2892 may comprise #10-16 screws or the like. Those of ordinary skill in the art will appreciate, however, that other fasteners or fastening methods such as welding, etc. may be employed to affix the L-shaped clips 2890' to the second header flange 2856 and the web 126' of a corresponding second joist 124'.

Floor decking material 2895 may be attached to the header web 2852 and the upper joist flanges 128, 128' of the joists 124, 124' in the manner described above. Such floor decking material 2895 may comprise, for example, noncombustible board material of the types and construction described above. However, it is conceivable that other types of decking material such as, for example, plywood, concrete, etc. could also be successfully employed.

Figure 36:
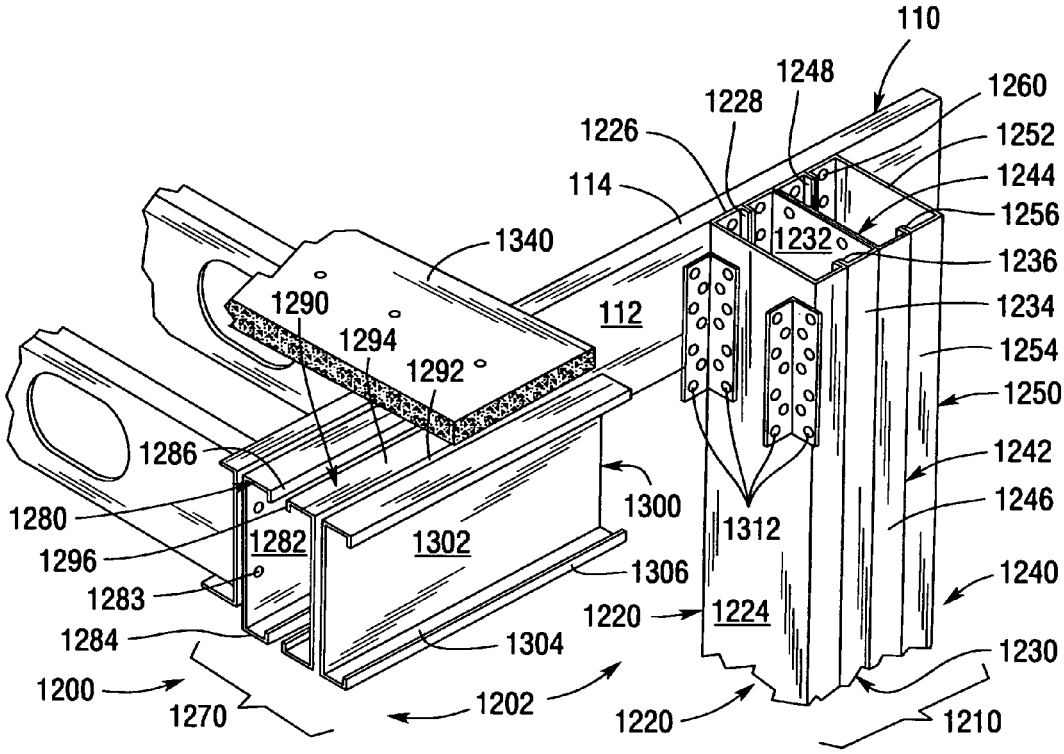
FIG. 36 is a perspective view of a portion of a header connection arrangement of the present invention.
Figure 37:
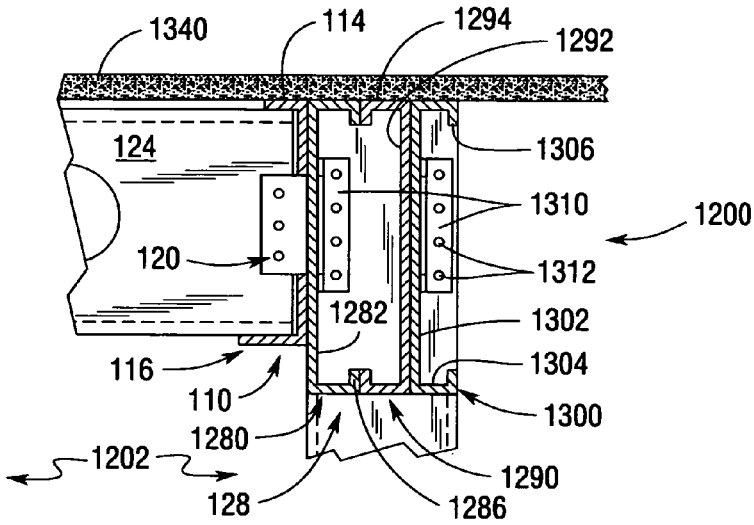
FIG. 37 is a partial cross-sectional view of the header connection arrangement of FIG. 36.

FIGS. 36 and 37 depict a header arrangement 1200 of the present invention that may be used, for example, as a header for a doorway or window opening 1202 which may be located in a multi-story structure and exceeds the design of a rim track as the header as shown in FIG. 15. As can be seen in FIGS. 36 and 37, this embodiment includes a joist rim 110 of the type and construction described above which may be attached to jamb/king posts 1210 located on both sides of the opening 1202. The jamb/king posts 1210 may be fabricated from two interconnected stud posts 1220 and 1240. First stud post 1220 may comprise a first stud 1222 that has a stud web 1224, two stud flanges 1226 and stud lips 1228 that protrude from the flanges 1226 and a second stud 1230 that has a stud web 1232, two stud flanges 1234 and two stud lips 1236 that protrude from the flanges 1234. The first stud 1222 and the second stud 1230 may be arranged such that their respective stud lips 1228 and 1236 abut each other and the stud flanges 1226 and 1234 are then welded together in a known manner to form the first stud post 1220.

Second stud post 1240 comprises a third stud 1242 that has a stud web 1244, two stud flanges 1246 and stud lips 1248 that protrude from the stud flanges 1246 and a fourth stud 1250 that has a stud web 1252, two stud flanges 1254 and two stud lips 1256 that protrude from the stud flanges 1254. The stud web 1244 of the third stud 1242 is oriented in confronting relationship with the stud web 1232 and may be attached thereto by an appropriate number and orientation of fasteners 1243 which may comprise, for example, #10-16 screws or the like. Those of ordinary skill in the art will appreciate, however, that the third stud 1242 and the fourth stud 1250 may be interconnected by other suitable means such as welding, etc. The fourth stud 1250 may be arranged such that the stud lips 1256 are in confronting contact with stud lips 1248 of the third stud 1242 such that they abut each other and the stud flanges 1246 and 1254 may be welded together in a known manner to form the shear wall post 1210.

As can be seen in FIGS. 36 and 37, a joist rim 110 of the type and construction described above may be attached to the jamb/king posts 1210 by an appropriate arrangement and number of fasteners 1260. FIG. 36 only shows one end of the joist rim 110 attached to a corresponding jamb/king post 1210. The other end of the joist rim 110 may also be attached to a jamb/king stud post 1210. It will also be appreciated that the header arrangement 1200 of the present invention may also be successfully employed in walls that are not designed to be shear walls. Thus in those embodiments, the joist rim 110 may be attached to a conventional king stud arrangement.

In one embodiment, fasteners 1260 may comprise, for example, #10-16 screws or the like. However, other fasteners and fastening methods could conceivably be employed to fasten the joist rim 110 to the jamb/king posts 1210. In one embodiment, a girder assembly 1270 may be attached to the rim web 112 of the joist rim 110 as shown. The girder assembly 1270 may comprise, for example, a first girder 1280 that has a web 1282, two flanges 1284 and a lip 1286 that protrudes from each of the flanges 1284. In addition, the girder assembly 1270 may include a second girder 1290 that has a web 1292, two flanges 1294 and a lip 1296 protruding from each joist flange 1294. The web 1282 of the first girder 1280 may be attached to the rim web 112 of the joist rim 110 by an appropriate number and arrangement of fasteners 1283. In one embodiment, fasteners 1283 may comprise, for example, #10-16 screws or the like. However, other fasteners and fastening methods may be employed. The second girder 1290 may be oriented such that the lips 1296 of the second girder 1290 are in confronting relationship with the lips 1286 of the first girder 1280. The flanges 1294 of the second girder 1290 may be welded to the flanges 1284 of the first girder 1280 in a known manner.

Also in this embodiment, the girder assembly may include a third girder 1300 that has a web 1302, two flanges 1304 and a lip 1306 protruding from each flange 1304. The web 1302 of the third girder 1300 may be placed in confronting relationship with the web 1292 of the second girder 1290 and be attached thereto by screws or the like. However, other fasteners and fastening methods may be employed. As can also be seen in FIG. 37, support clips 1310 may be employed to attach the web 1282 of the first girder to the jamb/king post 1210 and the web 1302 of the third girder 1300 to the jamb/king post 1210, via a collection of appropriate fasteners 1312. In one embodiment, the support clip 1312 may comprise, for example, a 1½"×1½"×16 gauge, 50 ksi clip that is 7" long with seven #10-16 screws per leg. However, the skilled artisan will readily appreciate that the support clip 1312 may be fabricated from different materials having different thicknesses and sizes, without departing from the spirit and scope of the present invention. It will be further understood that other fasteners and fastening methods may be employed to fasten the girder assembly 1270 to the shear wall post 1210.

Also in this embodiment floor joists 124 of the type and construction described above may be attached to the connection tabs 120 in the joist rim 110 in the above-described manner. Floor decking material 1340 may be attached to the upper flanges of the joist rim 110 and the girder assembly 1270 by fasteners 1342 of the types and arrangements described above. For example, fasteners 1342 may comprise #10-16 screws or the like. Floor decking 1340 may also comprise noncombustible board material of the type described above.

As described above, when employing the joist rim as a header on the face of a wall, the members at either end of a door or window may be full height i.e., thereby eliminating the need for a shoulder stud. Traditionally, shoulder studs are not full height, meaning they are commonly framed to the underside of the header. A shoulder stud is typically designed to transfer an axial load only and is not designed to transfer a combination of axial and lateral loads. The various embodiments, described above, however, permit the members to be designed for both wind and axial loads without the need to use additional supports (i.e., jamb or king studs) at each end of the opening.

Another feature of the present invention is to provide a unique and novel method of constructing walls. More particularly and with reference to FIGS. 38-42, there is shown a panelized wall assembly 1400 that may be used in a portion of the structure 100' as shown in FIG. 15. Wall assembly 1400 may comprise a first panel section 1410 that is interconnected to a second header panel section 1450 and a third panel section 1480 that is interconnected to the second header panel section 1430.

Figures 39, 40, 40A, 41, 42, 42A:
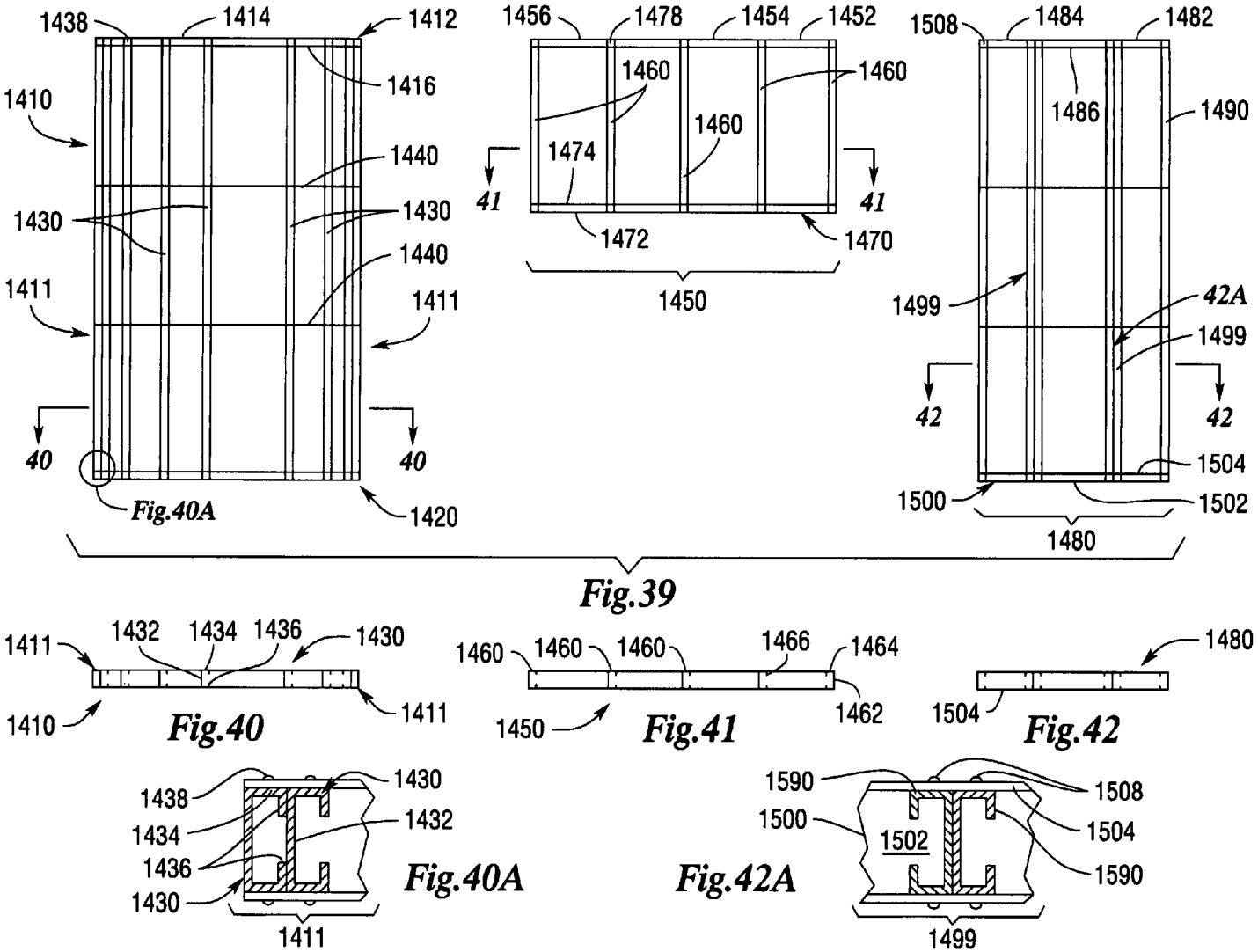
FIG. 39 is an exploded assembly view of the panelized wall assembly of FIG. 38.
FIG. 40 is a cross-sectional view of a first panel section of the panelized wall assembly of FIGS. 38 and 39 taken along line 40-40 in FIG. 39.
FIG. 40A is a partial cross-sectional view of a portion of the first wall panel depicted in FIGS. 38 and 39.
FIG. 41 is a cross-sectional view of a second panel section of the panelized wall assembly of FIGS. 38 and 39 taken along line 41-41 in FIG. 39.
FIG. 42 is a cross-sectional view of a third panel section of the panelized wall assembly of FIGS. 38 and 39 taken along line 42-42 in FIG. 39.
FIG. 42A is a cross-sectional view of a portion of the third wall panel depicted in FIGS. 38 and 39.

As can be seen in FIGS. 39 and 40, the first panel section 1410 may comprise an upper C-shaped track 1412 and a lower C-shaped track 1420. The upper track 1412 and the lower track 1420 may be of the same type and construction as the upper and lower tracks described above. For example, the upper track 1412 may have a web 1414 and two flanges 1416. Likewise the lower track 1420 may have a web 1422 and two flanges 1424. The first wall panel section 1410 may also include a plurality of first studs 1430 of the type and construction described above. Studs 1430 may each have a track web 1432, a pair of flanges 1434 and two lips 1436. The flanges 1434 of the first studs may be connected to the flanges 1416 of the upper track 1412 and the flanges 1424 of the lower track 1420 with appropriate fasteners 1438 as described above. For example, the flanges 1434 of the first studs 1430 may be attached to the flanges 1416 and 1424 by #10-16 screws or the like. It will be appreciated, however, that the first studs 1430 may be attached to the upper track 1412 and the lower track 1420 by other means such as welding, etc.

As can be seen in FIGS. 40 and 40A, the lateral end posts 1411 of the first panel 1410 may each be formed from a pair of first studs 1430. For example, one stud 1430 may be arranged such that its track web 1432 is in confronting relationship with the lips 1436 of the other stud 1430 making up the lateral end post 1411. The two studs 1430 may then be attached together by, for example, welding their respective flanges 1434 together. Also in this embodiment, each first stud 1430 may have one or more openings (not shown) through its track web 1432 as is known in the art. The openings in the studs 1430 would be substantially aligned such that a bracing member 1440 may extend therethrough to engage and support each track web 1432. Bracing member 1440 may comprise one of the spacer braces described above. However, other known lateral bracing arrangements may also be employed.

As can be seen in FIGS. 39 and 41, the second panel section 1450 may comprise an upper C-shaped track 1452 and a lower C-shaped track 1470. The upper track 1452 and the lower track 1470 may be of the same type and construction as the upper and lower tracks described above. For example, the upper track 1452 may have a web 1454 and two flanges 1456. Likewise the lower track 1470 may have a web 1472 and two stud flanges 1474. The second wall panel assembly 1450 may also include a plurality of second studs 1460 of the type and construction described above. Studs 1460 may each have a stud web 1462, a pair of flanges 1464 and two lips 1466. The flanges 1464 of the second studs 1460 may be connected to the flanges 1456 of the upper track 1452 and the stud flanges 1474 of the lower track 1470 with appropriate fasteners 1478 as described above. For example, the flanges 1464 of the second studs 1460 may be attached to the flanges 1456 and 1474 by #10-16 screws or the like. It will be appreciated, however, that the second studs 1460 may be attached to the upper track 1452 and the lower track 1470 by other means such as welding, etc.

As can be seen in FIGS. 39 and 42, the third panel assembly 1480 may comprise an upper C-shaped track 1482 and a lower C-shaped track 1500. The upper track 1482 and the lower track 1500 may be of the same type and construction as the upper and lower tracks described above. For example, the upper track 1482 may have a web 1484 and two flanges 1486. Likewise, the lower track 1500 may have a web 1502 and two flanges 1504. The third wall panel assembly 1480 may also include a plurality of third studs 1490 of the type and construction described above. Studs 1490 may each have a web 1492, a pair of flanges 1494 and two lips 1496. The flanges 1494 of the third studs 1490 may be connected to the flanges 1486 of the upper track 1482 and the flanges 1504 of the lower track 1500 with appropriate fasteners 1508 as described above. For example, the flanges 1494 of the third studs 1490 may be attached to the flanges 1486 and 1504 by #10-16 screws or the like. It will be appreciated, however, that the third studs 1590 may be attached to the upper track 1482 and the lower track 1500 by other means such as welding, etc.

Figure 38:
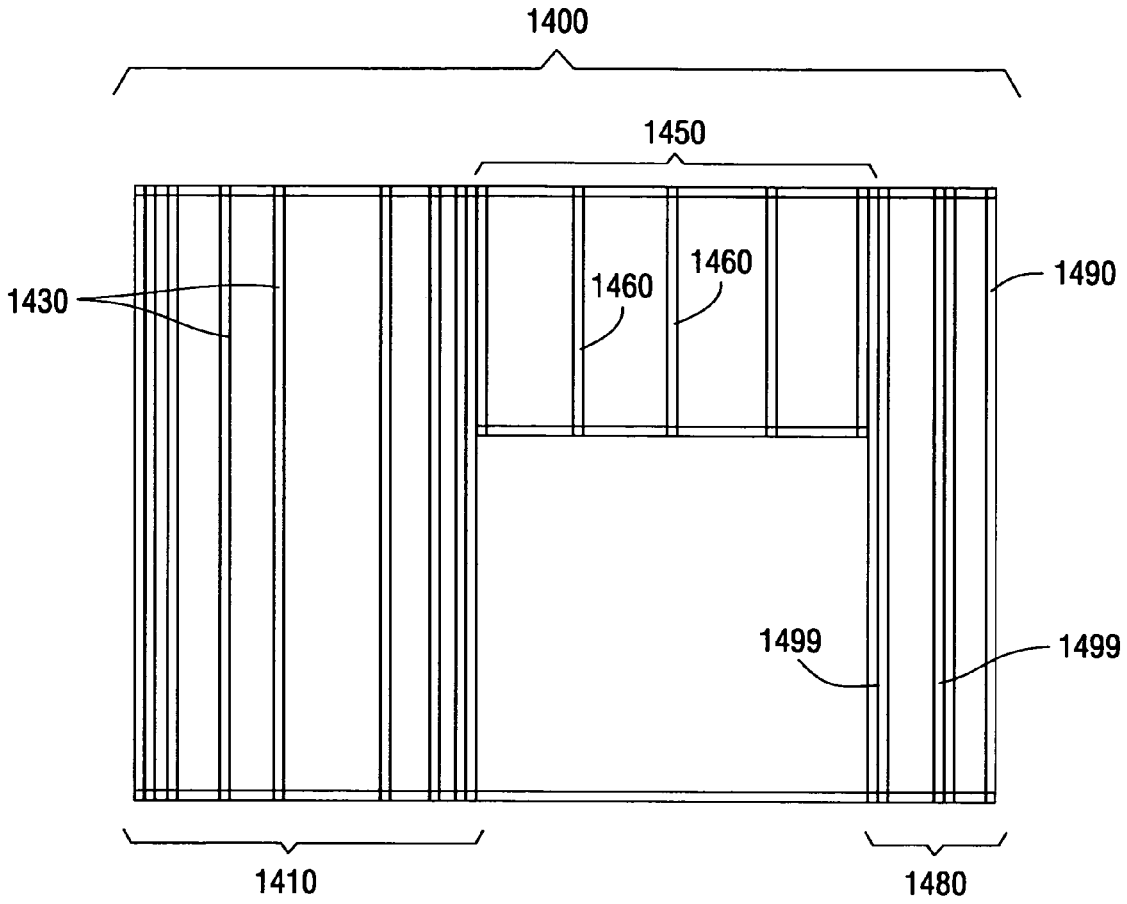
FIG. 38 is an elevational view of a panelized wall assembly of the present invention.
Figure 38A:
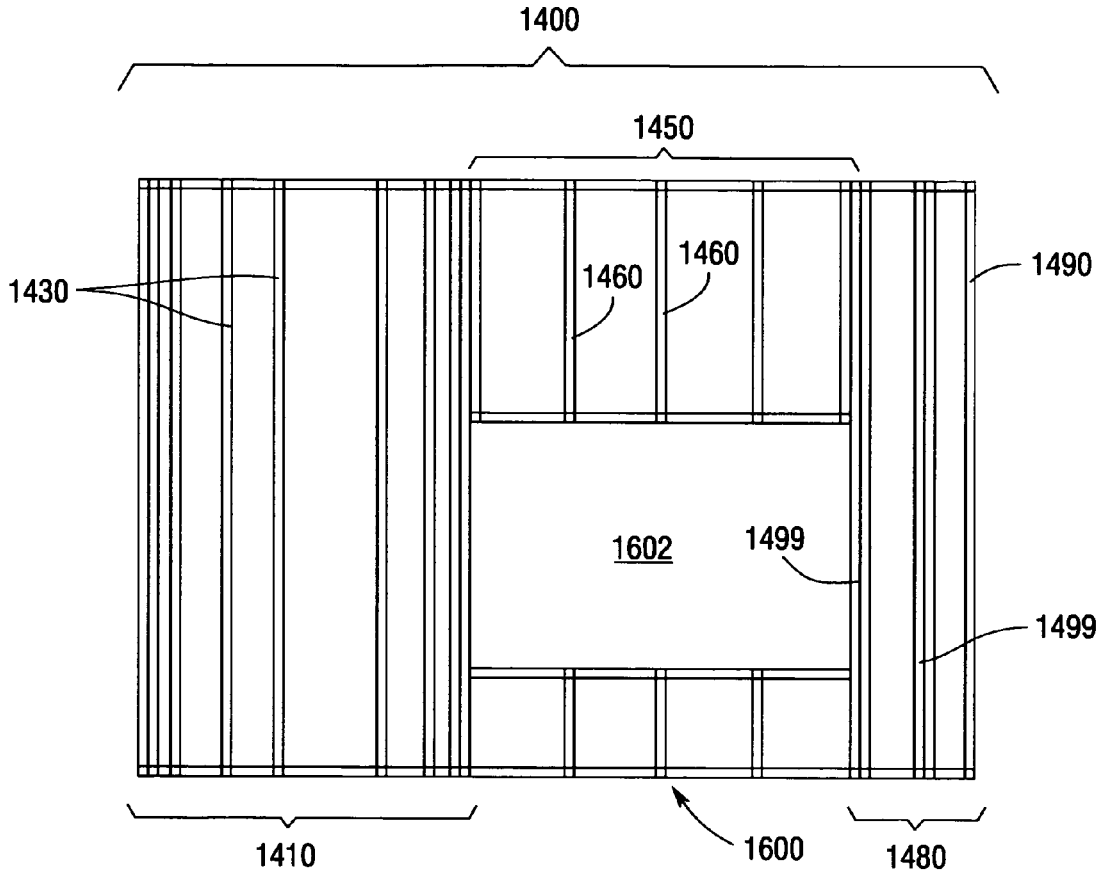
FIG. 38A is an elevational view of another panelized wall assembly of the present invention.

As can be seen in FIGS. 39 and 42, the studs 190 in the center portion of the third panel section 1480 may be arranged in back-to-back fashion to form central posts 1499. The third studs 1490 comprising each central post 1499 may be coupled back to by, for example, screws, welding, etc. Also in this embodiment, each third stud 1430 may have one or more openings (not shown) through its web as is known in the art. The openings in the studs would be substantially aligned such that a bracing member 1440 may extend therethrough to engage and support each web. To complete the wall panel assembly, the first wall panel section and the second wall panel section are attached to the second wall panel section by conventional screws, welding, etc. As can be seen in FIG. 38, the first wall panel section, the second wall panel section, and the third wall panel section form a wall panel that has an opening such as a doorway therethrough.

This unique and novel method of fabricating wall panels provides many advantages over the prior art. For example, this embodiment of the subject invention increases the amount of panels that can be shipped on one truck. In one embodiment, all of the panels are essentially solid panels/blocks. This advantage is move prevalent when the openings for the windows require a "ptac" (an air conditioning/heating unit below the window). If ptac's are used, the entire window may resemble a door opening.

Figure 43:
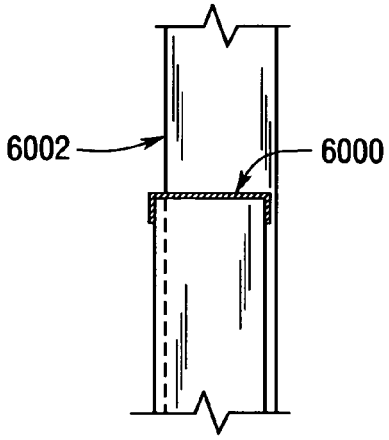
FIG. 43 is a partial elevational view of a framing arrangement wherein the panel is out-of plane with the face of a wall.
Figure 44:
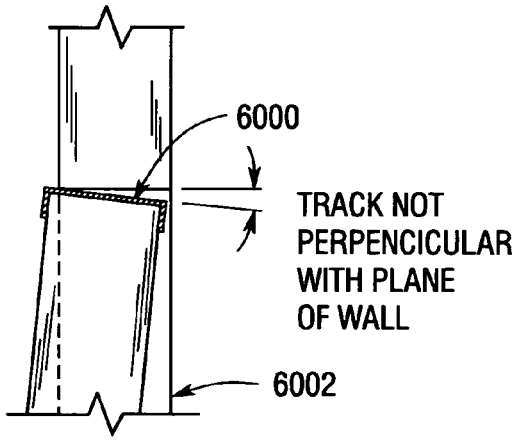
FIG. 44 is a partial elevational view of a framing arrangement wherein the header or sill track is not perpendicular with the plane of the wall;.
Figure 45:
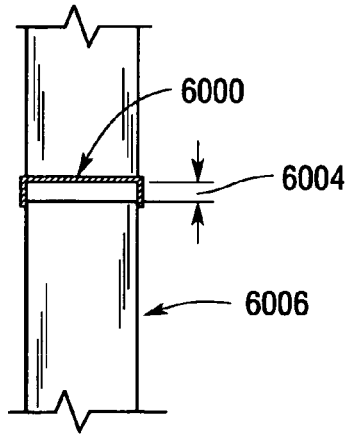
FIG. 45 is a partial elevational view of a wall section wherein the header or sill track has been improperly installed creating a gap between the cripple studs and the header track.

Employment of this embodiment of the present invention can also reduce the potential for fabrication errors. Quality control issues can also occur when attaching the head and sill tracks utilizing prior methods. FIGS. 43-45 illustrate various problems commonly encountered when utilizing prior methods. FIG. 43 illustrates a condition wherein the head or sill track 6000 is out of plane with the wall face 6002 (interior or exterior of the wall). FIG. 44 illustrates a condition wherein the header or sill track 6000 is installed at a skewed angle relative to the wall 6002. FIG. 45 illustrates a condition wherein the header or sill track 6000 is installed such that a gap 6004 is created between the track 6000 and the crippler studs 6006 which are to be installed thereafter. Installers typically identify the errors in the panelization assembly. The costs for repairing these errors can be expensive. Those costs can be exasperated when the error is discovered after the exterior sheathing has been attached to the wall or if the panels' primary means of attachment is welding.

Figure 46:
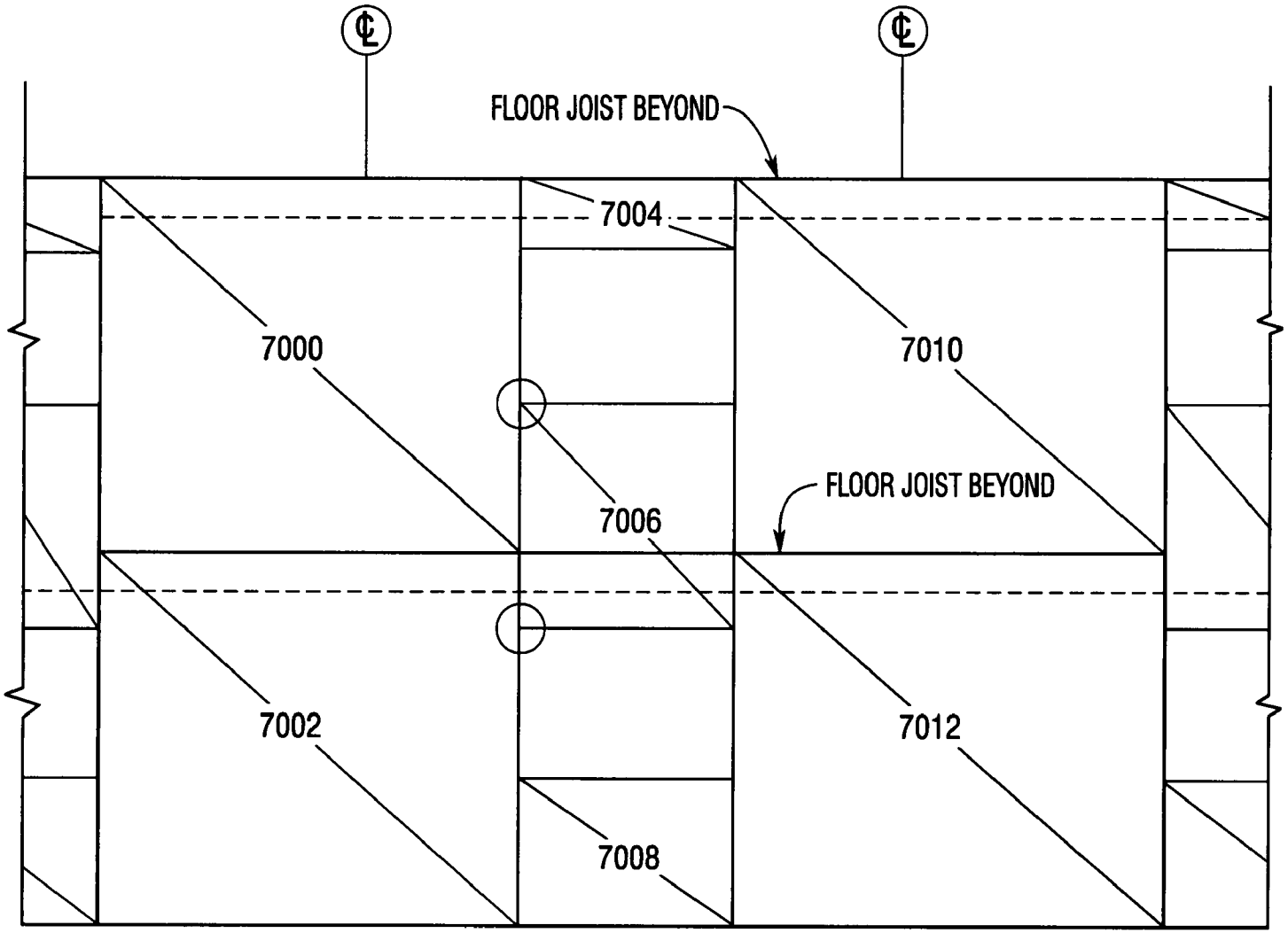
FIG. 46 is an elevational view of another panelized wall assembly of the present invention.

FIG. 46 further illustrates an effective manner in which one embodiment of the present invention solves these problems. As can be seen in that Figure, the infill panels identified as panels (7000, 7002, 7004, 7006, 7008, 7010, 7012) are fabricated as separate panels. The panel fabrication is much less susceptible to the above-mentioned errors. Once the installer confirms that the dimensions of the various components are correct, the individual panel is formed such that it is square and the component studs are seated tight into the top and bottom tracks.

Those walls that have a door or window with an air conditioner below the window opening commonly require a reinforcement member during shipping. This is because the strength of a typical bottom track may not be sufficient to prevent it from being kinked or twisted while the panel is being loaded or unloaded. The panel may also be unbalanced further complicating its installation without a crane. In the past, it was common practice to install a second reinforcing track into the bottom track in a nested fashion. The installer would then have to remove the reinforcing track section after the panel has been installed. To remove the track, a grinder is commonly used to cut the track at each jamb. Thus, the prior methods required additional materials and labor for installation. The subject invention addresses this problem by eliminating the need to install and remove the additional reinforcement track.

Another advantage of this embodiment of the present invention is that the need for additional components at the floor transition is eliminated. This is because the walls attach directly on top of each other. The floor transition area can be further complicated when joists are placed on top of the wall.

When an exterior fire rating is required, the typical methodology in the past required additional work to be performed in the field to accommodate the exposed floor joist. In many instances an additional strip would have to be installed at the floor lines, which requires additional time, equipment and attention to safety. Other past solutions involve permitting the sheathing to extend below the bottom track (for example, ten inches), which makes the sheathing susceptible to inadvertent damage. This embodiment of the present invention solves this problem.

The various embodiments of the subject invention described above provide efficient means of transferring the loads from floor-to-floor without additional material or labor. In addition, these embodiments also provide advantages to other trades. For example, plumbers and electricians will benefit with the reduced mass of components traditionally required when providing penetrations from floor to floor. Requirements for floor-to-floor connections are also simplified when utilizing the various embodiments of the present invention. In particular, various embodiments of the present invention essentially use one connection from wall-to-wall in lieu of wall-to-floor-to-wall. This benefit is accentuated when tension requirements are required by design. The connection also occurs at the floor sheathing/substrate providing an efficient means of transferring loads (reactions) directly into the diaphragm.

Figure 47:
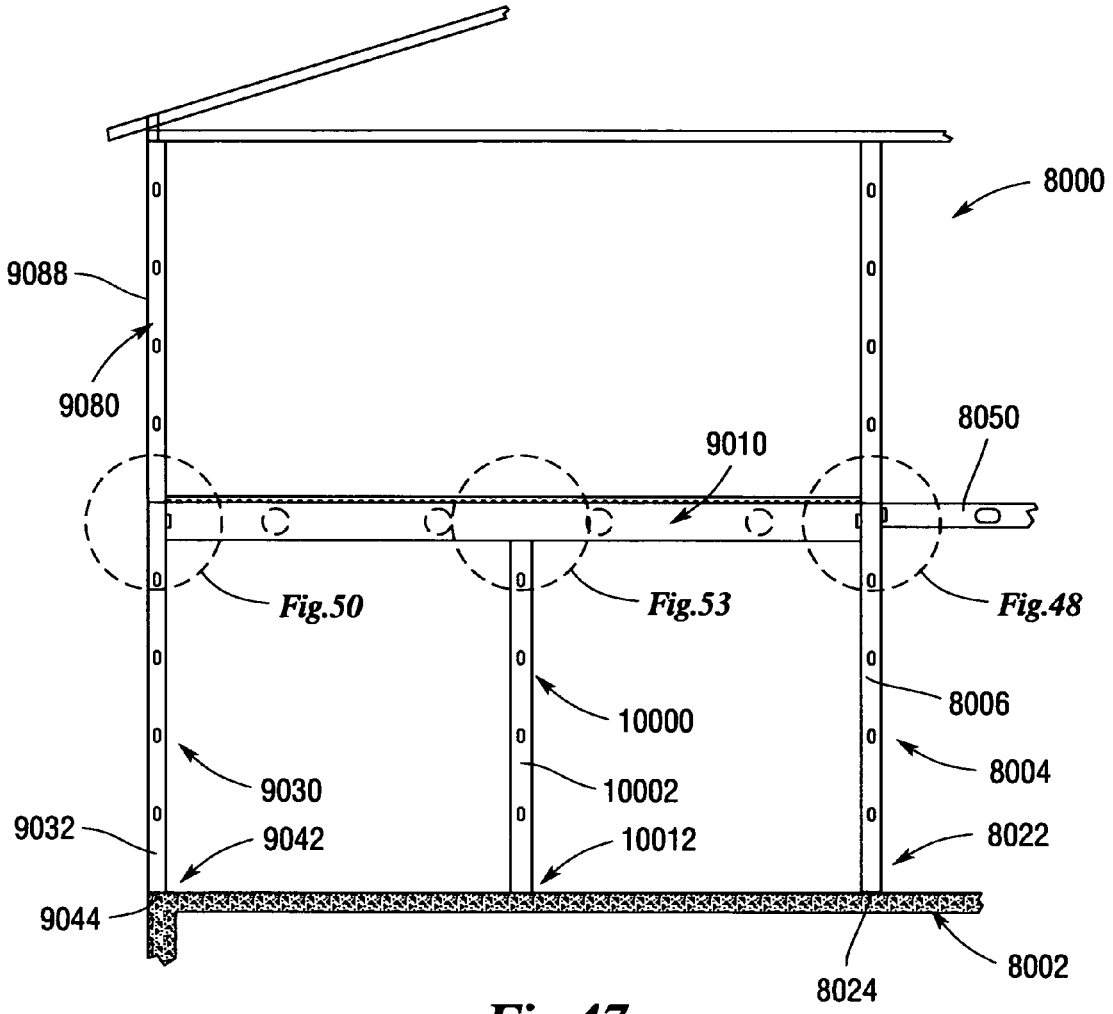
FIG. 47 is a partial elevational view of a structure employing various wall and floor construction arrangements of the present invention.

FIG. 47 is a wall section of a multi-story structure designated as 8000 that illustrates additional unique and novel embodiments of the present invention. While FIG. 47 illustrates a two story structure, the reader will understand that the various embodiments that will be describe below may also be effectively used in structures that have more than two floors without departing from the spirit and scope of the present invention.

Figure 48:
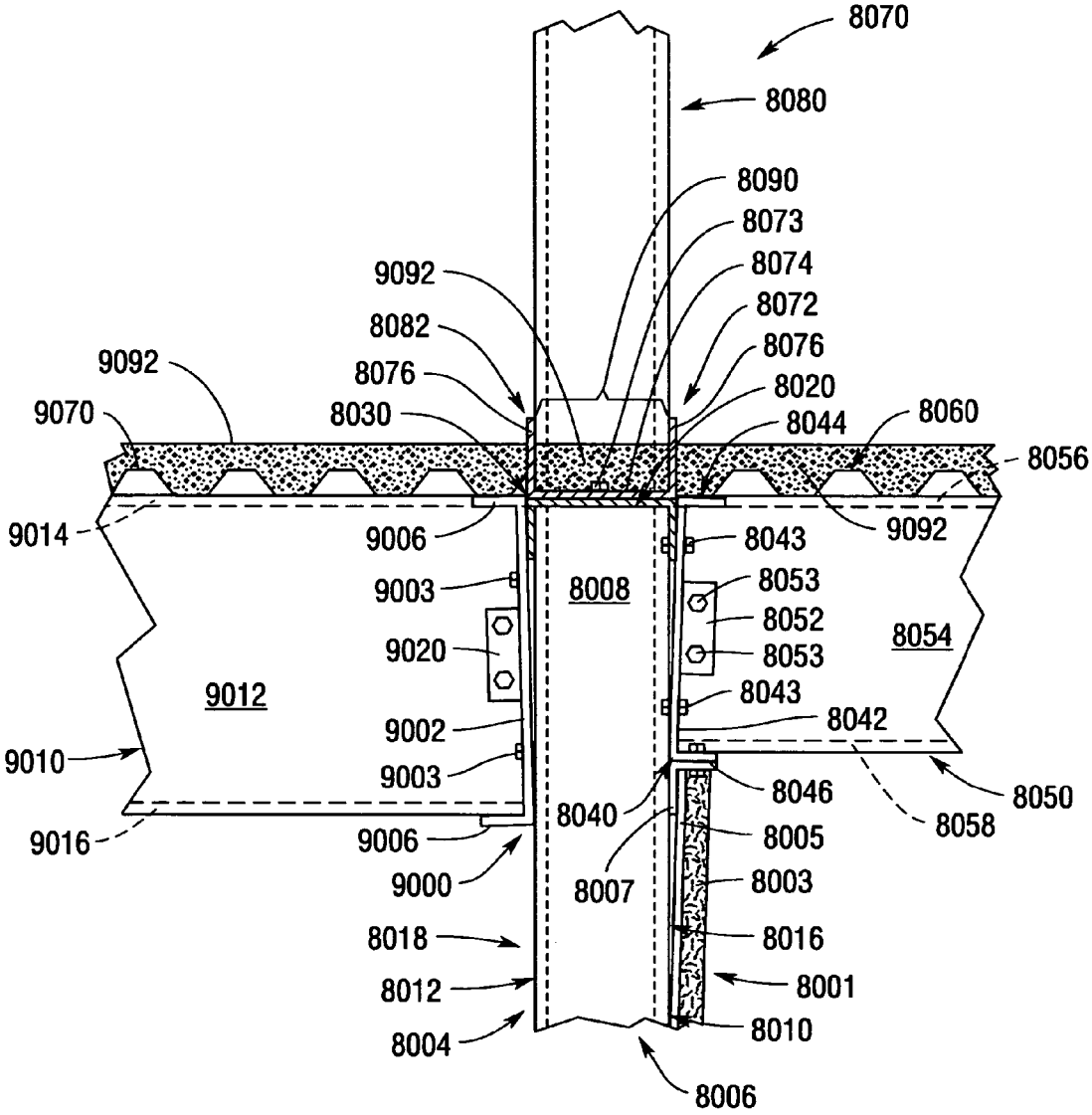
FIG. 48 is a partial view of an embodiment of a wall and floor connection of the present invention with some of the elements shown in cross-section for clarity.

As can be seen in FIGS. 47 and 48, the structure 8000 may have a support structure 8002 which, in this example, comprises a concrete slab. However, other support structures, floors, etc. may be used. Supported on the support structure 8002 is a first wall 8004 that, in this example, is a load bearing interior wall. The first wall 8004 may be fabricated from first steel studs 8006 that generally each have a web portion 8008 and a first leg 8010 and a second leg 8012. In this embodiment, the first legs 8010 serve to define a first wall side (generally designated as 8016) and the second legs 8012 serve to define a second wall side (generally designated as 8018). The first studs 8006 each have a top end portion generally designated 8020 and a bottom end portion generally designated as 8022. The bottom end portions 8022 of the first studs 8006 may be attached to a first bottom track 8024 at a desired spacing arrangement and which is attached to the support structure 8002 in a known manner. Likewise, the top end portions 8020 of the first studs 8006 may be received in a first upper track 8030 that has a web 8032, a first leg 8034 and a second leg 8036. The first and second legs 8010, 8012 of the first studs 8006 may be attached to the first and second legs 8034 and 8036, respectively of the upper track 8030 by, for example, screws, rivets, welds, etc. at the desired spacing intervals (i.e., 8", 12", 16", 19.2", 24", etc.).

Figure 48A:
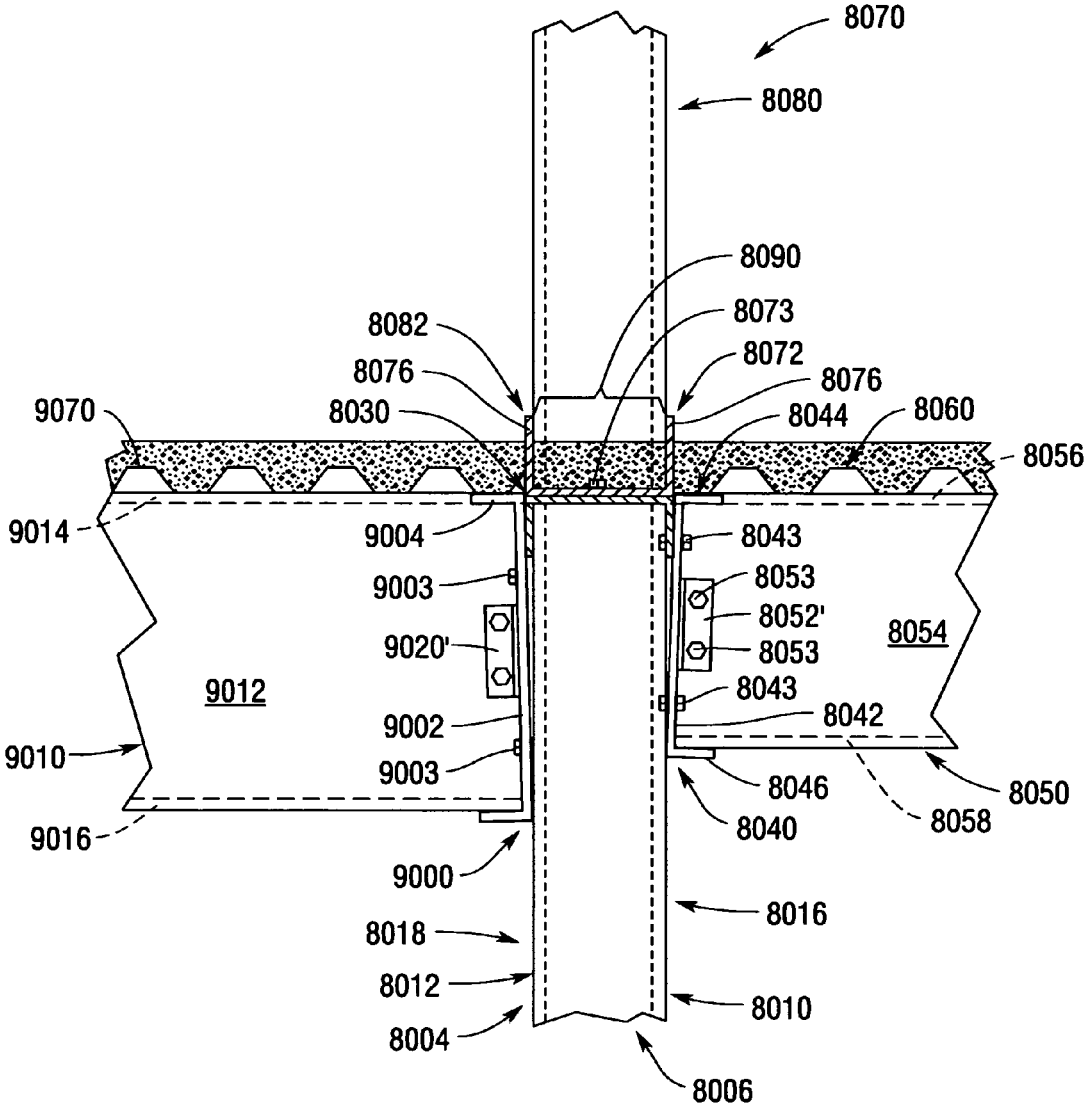
FIG. 48A is a partial view of another embodiment of a wall and floor connection of the present invention with some of the elements shown in cross-section for clarity.

As can be seen in FIG. 48, in one embodiment, a first joist rim 8040 is attached to at least some of the first legs 8010 of the first studs 8006. The first joist rim 8040 may have a first rim web 8042, an upper leg 8044 and a lower leg 8046. The first rim web 8042 may be attached to at least some of the first legs 8010 of the first studs 8006 by, for example, screws 8043. However, bolts, rivets, welds, etc. could also be used. As can further be seen in FIG. 48, the first joist rim 8040 may be installed relative to the upper track 8030 such that the upper leg 8044 of the first joist rim 8040 is coplanar with the web 8032 of the top track 8030. A plurality of first joists 8050, that each have a web portion 8054, an upper leg 8056 and a lower leg 8058, may be attached to the first joist rim 8040 by, for example, a plurality of fastener tabs 8052 that are integrally formed in the web 8042 of the first joist rim 8040. The webs 8054 of the first joists 8050 are attached to those integral tabs 8052 by screws 8053. However, bolts, rivets, welds, etc. may also be employed. In an alternative embodiment, the webs 8054 of the first joists 8050 may be attached to the web of the 8042 of the first joist rim 8040 by conventional L-shaped clips 8052'. See FIG. 48A. In some applications, it may be desirable to also attach the top leg 8044 of the first joist rim 8040 to the top leg 8056 of the first joist and/or attach the bottom leg 8046 of the first joist rim 8040 to the bottom leg 8058 of the first joist 8050. A first decking material 8060, which may comprise corrugated metal decking panels, is supported on the top legs 8056 of the first joists 8050 as shown. The panels may be attached to the top legs 8056 by, for example, screws, rivets, bolts, welding etc.

Also in this embodiment, it may be desirable to attach a sheer wall panel 8001 to the first legs 8010 of the first studs 8006. Such shear wall panels are commercially available and may comprise, for example, a piece of gypsum or other wallboard material 8003 that is attached to (glued, etc.) to a rigid plate 8005. The rigid plate 8005 may comprise a steel plate. See FIG. 48. In an alternative embodiment, the plate 8005 and the wallboard 8003 may be separately attached to the first legs 8010 of the first studs 8006. To facilitate attachment of such panel, a steel angle 8007 may be attached to at least some of the first legs 8010 of each first studs 8006 by, for example, screws, rivets, bolts, welds, etc. In, addition the upper leg of the steel angle 8007 may be attached to the lower leg 8046 of the first joist rim 8040 by, for example, screws, bolts, rivets welding, etc. The downwardly protruding lower leg of angle 8007 provides a surface for attaching the top of the steel plate 8005 to by, for example, screws, bolts, rivets, etc. The shear wall panel 8001 would also be attached to the vertically extending first studs 8006, utilizing screws, rivets, etc. Use of shear wall panels serve to provide additional strength and resistance to shear resulting from the load of the upper floor (s).

Figure 48B:
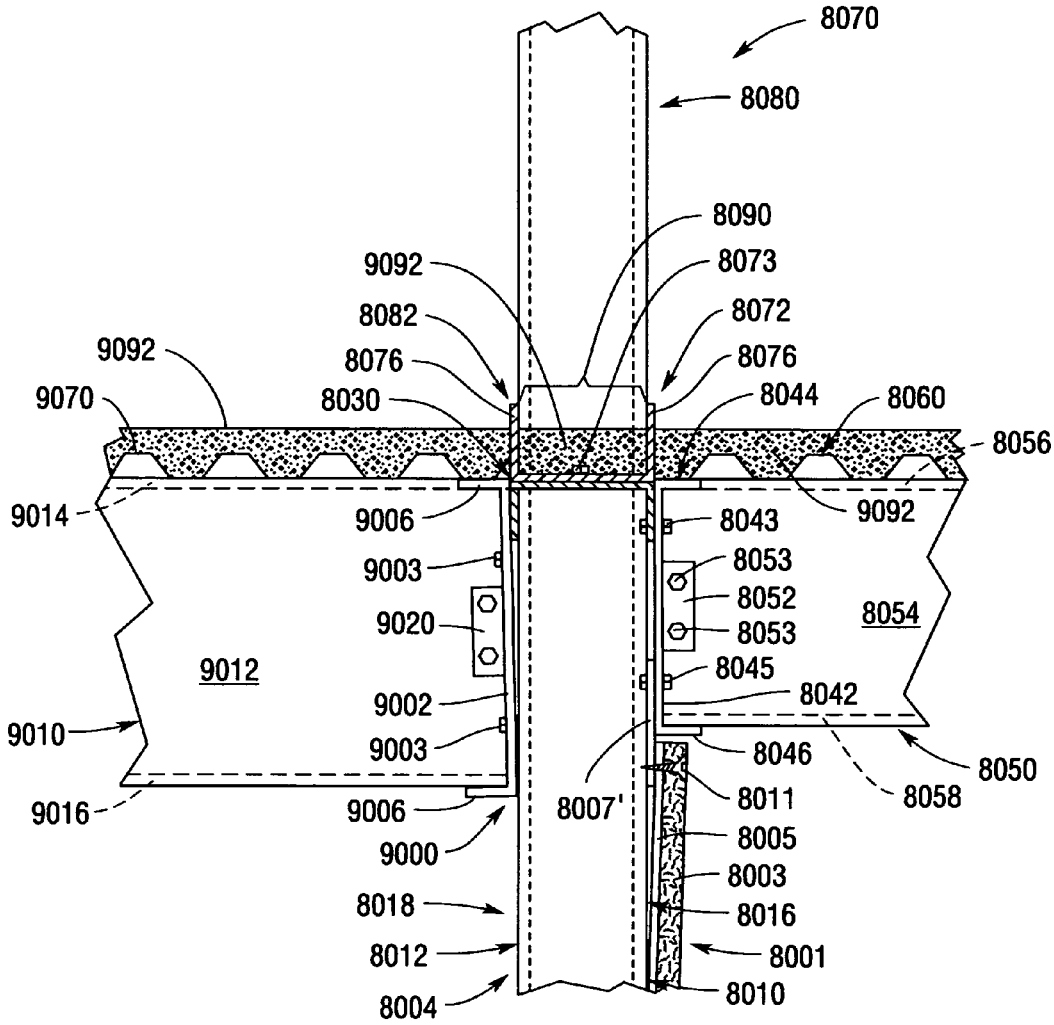
FIG. 48B is a partial view of another embodiment of a wall and floor connection of the present invention with some of the elements shown in cross-section for clarity.

In an alternative embodiment depicted in FIG. 48B, the steel angle 8007 described above is not employed. Instead, in this embodiment, a flat piece of rigid plate 8007' is placed between the web of the 8042 of the first joist rim 8040 and is bolted or otherwise fastened thereto by fasteners 8045. The rigid plate 8007' extends down below the lower leg 8046 of the first joist rim 8040 and the upper end of the shear wall panel 8001 is fastened thereto. As can be seen in FIG. 48B, screws 8011 or other suitable fasteners (bolts, rivets, etc.) extend through the wallboard panel 8003, the rigid plates 8005 and 8007' and through at least some of the first legs 8010 of each first studs 8006. The shear wall panel 8001 may then be attached by other fasteners (screws, bolts, rivets, etc.—not shown) to at least some of the first legs 8010 of the first studs 8006 at other appropriate locations on the shear wall panels 8001. We have found such arrangement may require less fasteners than the arrangement depicted in FIG. 48.

Figure 49:
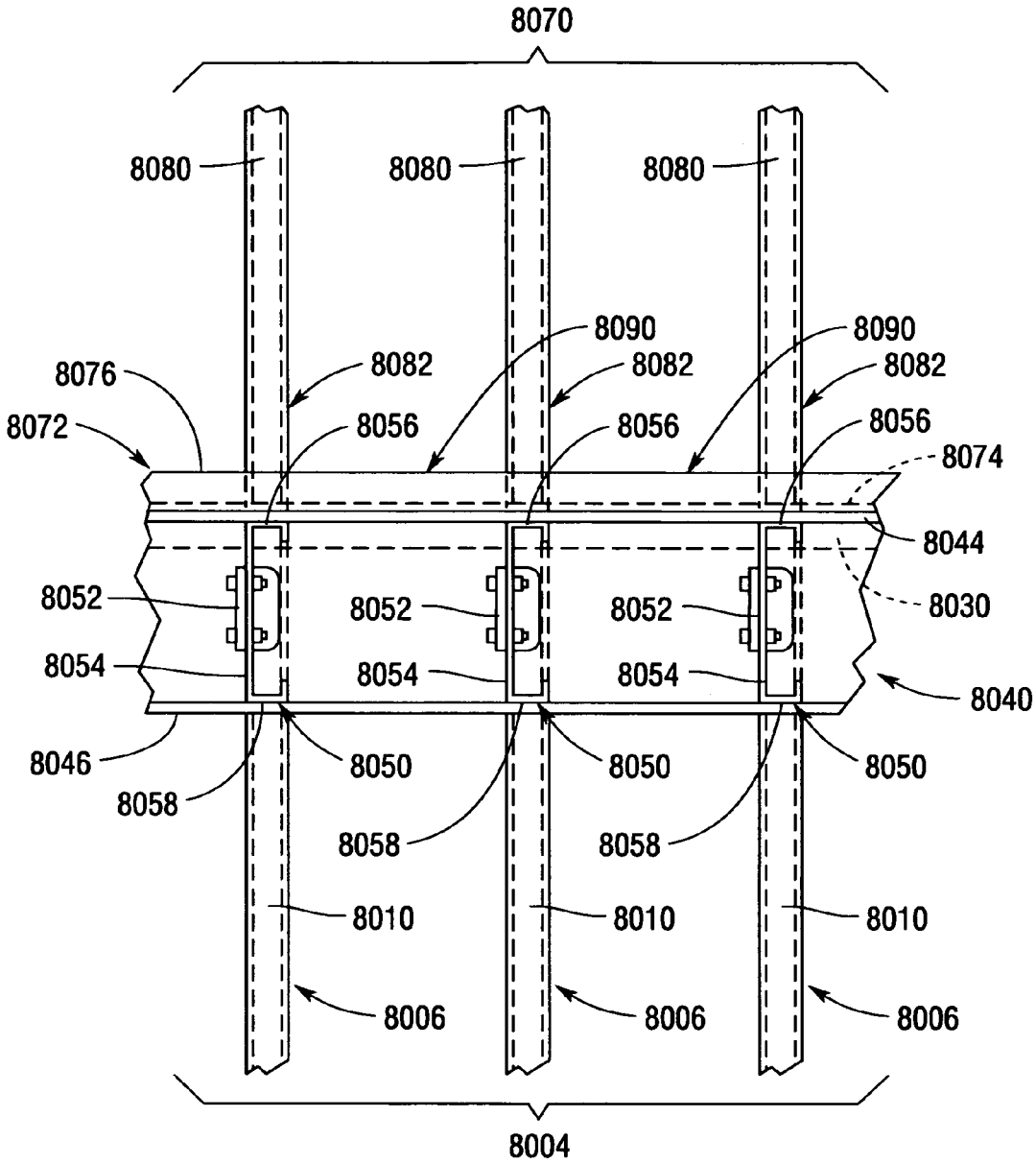
FIG. 49 is a partial view of the floor and wall connection of FIG. 48.

Also in this embodiment, a second bearing wall 8070 may be aligned with and supported on the top track 8030 of the first bearing wall 8004. The second bearing wall 8070 may include a second bottom track 8072 that has a web portion 8074 and two upstanding leg portions 8076. The second bottom track 8072 may be aligned with and supported on the top track 8030 of the first wall 8004 and attached thereto, by screws 8073 or other suitable fastening methods. The second wall 8070 also includes a plurality of second studs 8080 that each have a bottom end portion generally designated as 8082 that are each received within the bottom track 8072 and are arranged at desired spacing intervals with respect to each other (i.e., 8", 12", 16", 19.2", 24", etc.). For example, the second studs 8080 may be arranged at the same spacing intervals as the first studs 8006. An area, generally designated as 8090, is defined between the bottom portion 8072 of each second stud 8080 and the portion of web 8074 and legs 8076 of the second bottom track 8072. See FIGS. 48 and 49.

Also in this embodiment, a second joist rim 9000 is attached to the second wall side 8018 of the top end portions 8020 of the first studs 8006. The second joist rim 9000 may have a web portion 9002 and an upper leg 9004 and a lower leg 9006. The web portion 9002 may be attached to at least some of the second legs 8012 of the first studs 8006 by, for example, screws 9003 such that the upper leg 9004 is substantially coplanar with the web 8032 of the upper track 8030 and the upper leg 8044 of the first joist rim 8040 as illustrated in FIG. 48. However, bolts, rivets, welds, etc. could also be used to fasten the web portion 9002 to at least some of the second legs 8012.

A plurality of second joists 9010 may then be attached to the second joist rim 9000. In one embodiment, the second joists 9010 each have a web 9012 and an upper leg 9014 and a lower leg 9016. The web 9012 of each second joist 9010 may be attached to the web 9002 of the second joist rim 9000 by attachment tabs 9020 that are integrally formed in the web 9002 of the second joist rim 9000. In other embodiments, the webs 9012 of the second joists 9010 may be attached to the web 9002 of the second joist rim 9000 by, for example, conventional L-clips 9020'. See FIG. 48A. The webs 9002, 9012 may be attached to the integral tabs 9020 or the L-clips 9020', by bolts, screws, welds, rivets, etc.

The other ends of the second joists 9010 may be attached, for example, to a third wall 9030. In the example, depicted in FIGS. 47 and 50, third wall 9030 is an exterior load bearing wall. The third wall 9030 may be fabricated from third studs 9032. Each third stud generally has a web portion 9034 and a first leg 9036 and a second leg 9038. See FIG. 50. The third studs 9032 each have a top end portion generally designated as 9040 and a bottom end portion generally designated as 9042. The bottom end portions of the third studs 9032 may be attached to a third bottom track 9044 at a desired spacing arrangement (i.e., 8", 12", 16", 19.2", 24", etc.) and which is attached to the support structure 8002 in a known manner. Likewise, the top end portions 9040 of the third studs 9032 may be received in a third upper track 9050 that has a web 9052, a first leg 9054 and a second leg 9056. The first and second legs 9036, 9038 of the third studs 9032 may be attached to the first and second legs 9054, 9056, respectively of the third upper track 9050 by, for example, screws, rivets, welds, etc. at the desired spacing intervals.

Figure 50:
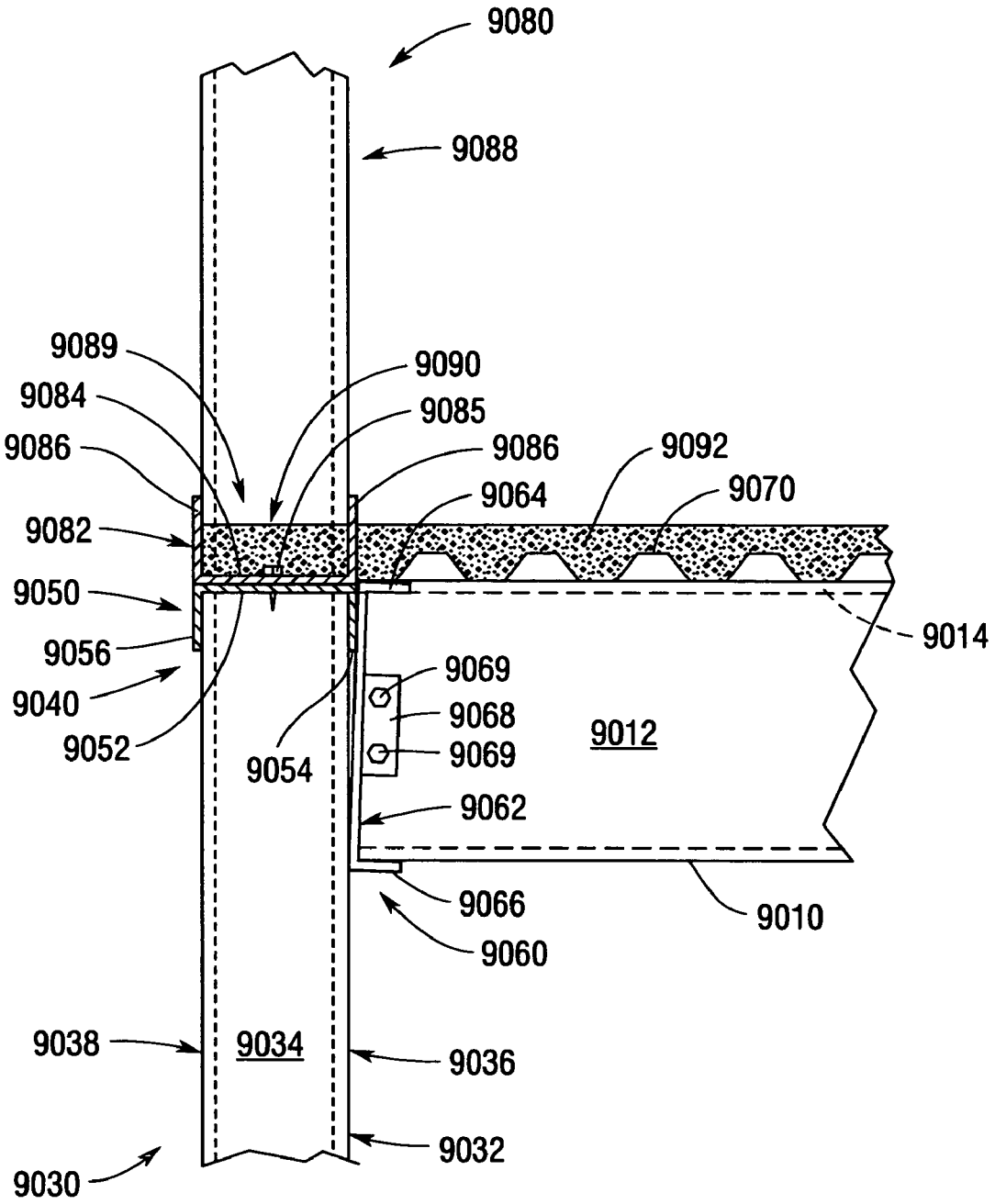
FIG. 50 is a partial view of another embodiment of a wall and floor connection of the present invention with some of the elements shown in cross-section for clarity.
Figure 50A:
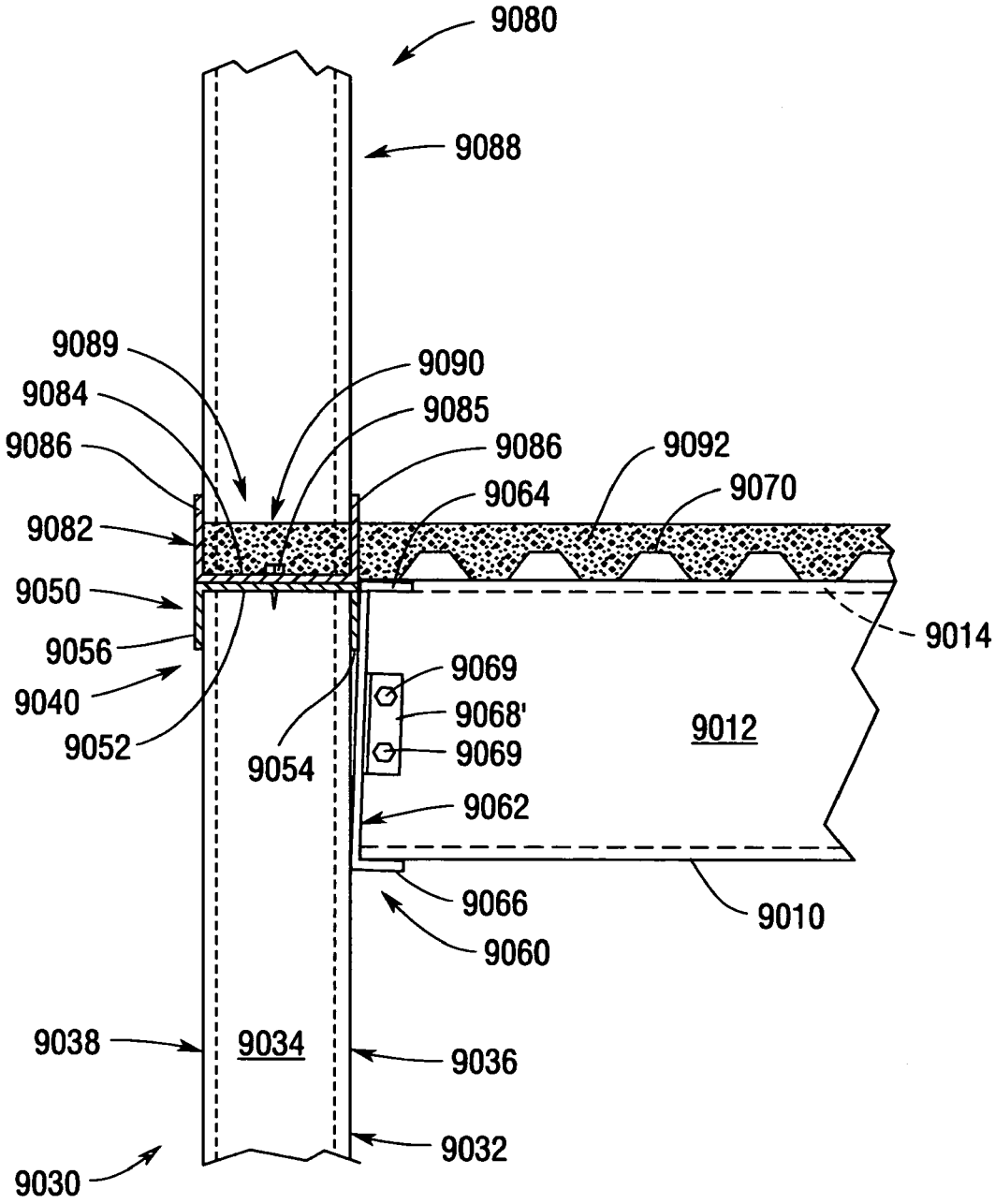
FIG. 50A is a partial view of another embodiment of a wall and floor connection of the present invention with some of the elements shown in cross-section for clarity.

Also in this embodiment, a third joist rim 9060 is attached to at least some of the first legs 9036 of the third studs 9032. The third joist rim 9060 may have a third rim web 9062, an upper leg 9064 and a lower leg 9066. The third rim web 9062 may be attached to at least some of the first legs 9036 of the third studs 9032 by, for example, screws, bolts, rivets, welds, etc. As can be seen in FIG. 50, the upper leg 9064 of the third joist rim 9060 may be coplanar with the web 9052 of the third upper track 9050 of the third wall 9030. In this embodiment, the webs 9012 of the second joists 9010 may be attached to the third joist rim 9060 by a plurality of fastener tabs 9068 that are integrally formed in the web 9062 of the third joist rim 9060 and the first joists 9010 are attached to those integral tabs 9068 by screws 9069. However, bolts, rivets, welds, etc. could also be used. In another embodiment, the webs 9012 of the second joists 9010 may be attached to the web 9062 of the third joist rim 6060 by convention L-clips 9068'. See FIG. 50A. Second decking material 9070 may be supported on and attached to the upper legs 9014 of the second joists 9010. In one embodiment, the second decking material 9070 comprises convention corrugated metal panels.

Figure 51:
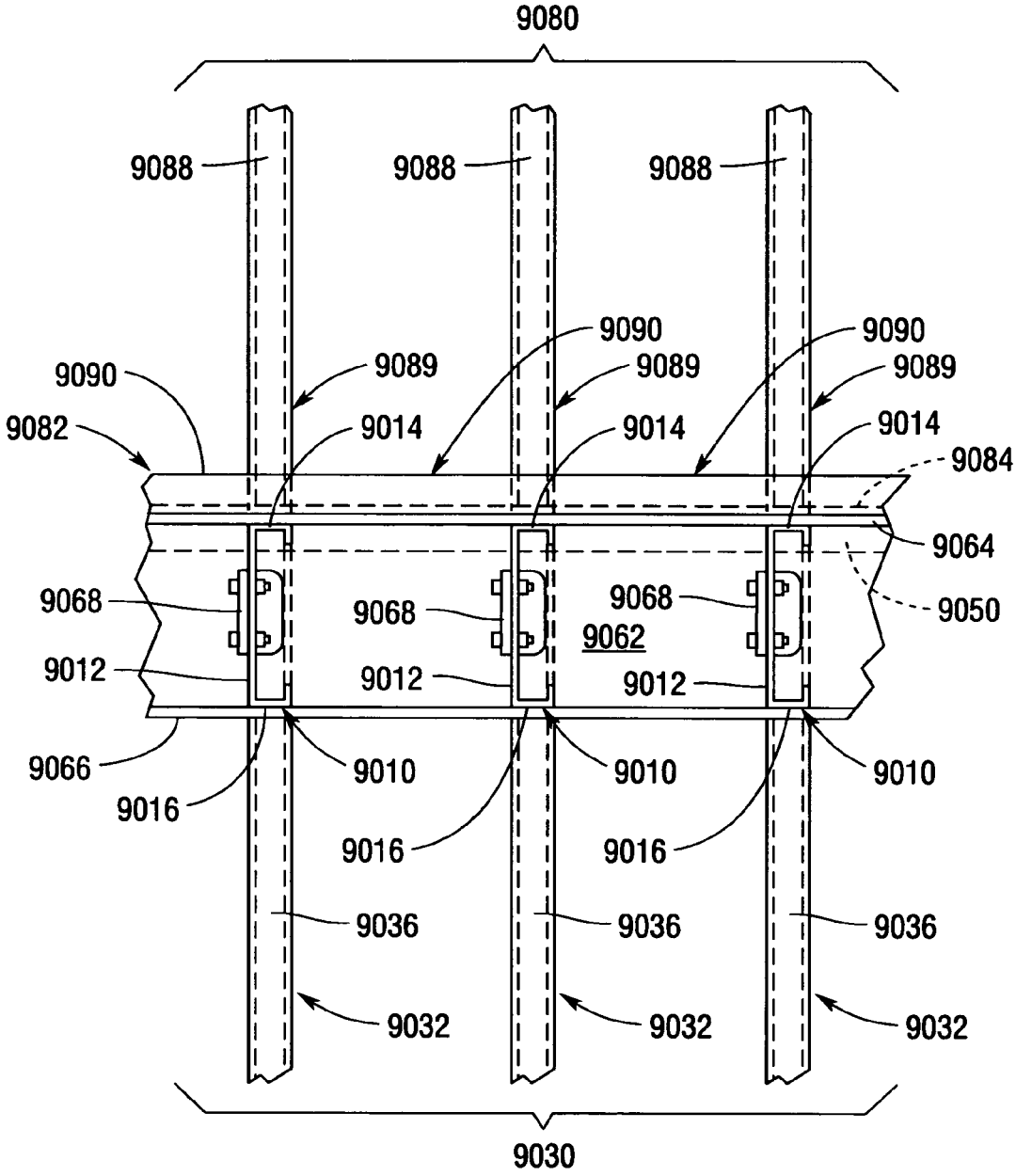
FIG. 51 is a partial view of the wall and floor connection of FIG. 50.

Also in this embodiment, a fourth load bearing wall 9080 may be aligned with and supported on the third upper track 9050 of the third load bearing wall 9030. The fourth load bearing wall 9080 may include a fourth bottom track 9082 that may have a web portion 9084 and two upstanding leg portions 9086. The fourth bottom track 9082 may be aligned with and supported on the third upper track 9050 of the third wall 9030 and be attached thereto, by screws 9085 or other suitable fastening methods. The fourth wall 9080 also includes a plurality of fourth studs 9088 that have bottom end portions 9089 that are received within the bottom track 9082 and are arranged at desired spacing intervals (i.e., 8", 12", 16", 19.2", 24", etc.) with respect to each other. For example, the fourth studs 9088 may be arranged at the same spacing intervals as the third studs 9032. An area, generally designated as 9090, is defined between the bottom portion 9089 of each stud 9088 and the corresponding portion of web 9084 and legs 9086 of the fourth bottom track 9082. See FIGS. 50 and 51.

In this embodiment, a slurry of cementitious material 9092, such as that cementitious material manufactured by United States Gypsum Company of 125 S. Franklin Street, Chicago, Ill. under the trademark LEVELROCK®, is pumped or otherwise placed onto the first and second decking materials 8060, 9070 and into the open areas 8090, 9090. Other cementitious materials could also be employed. The cementitious material 9092 is then leveled utilizing conventional leveling techniques to establish a desired floor thickness. The cementitious material in the open areas provides a variety of significant advantages. In particular, the cementitious material in the open areas serves to form effective fire barriers between the studs and the respective floors. It also serves to limit the passage of sound between the studs from one floor to another.

Figure 52:
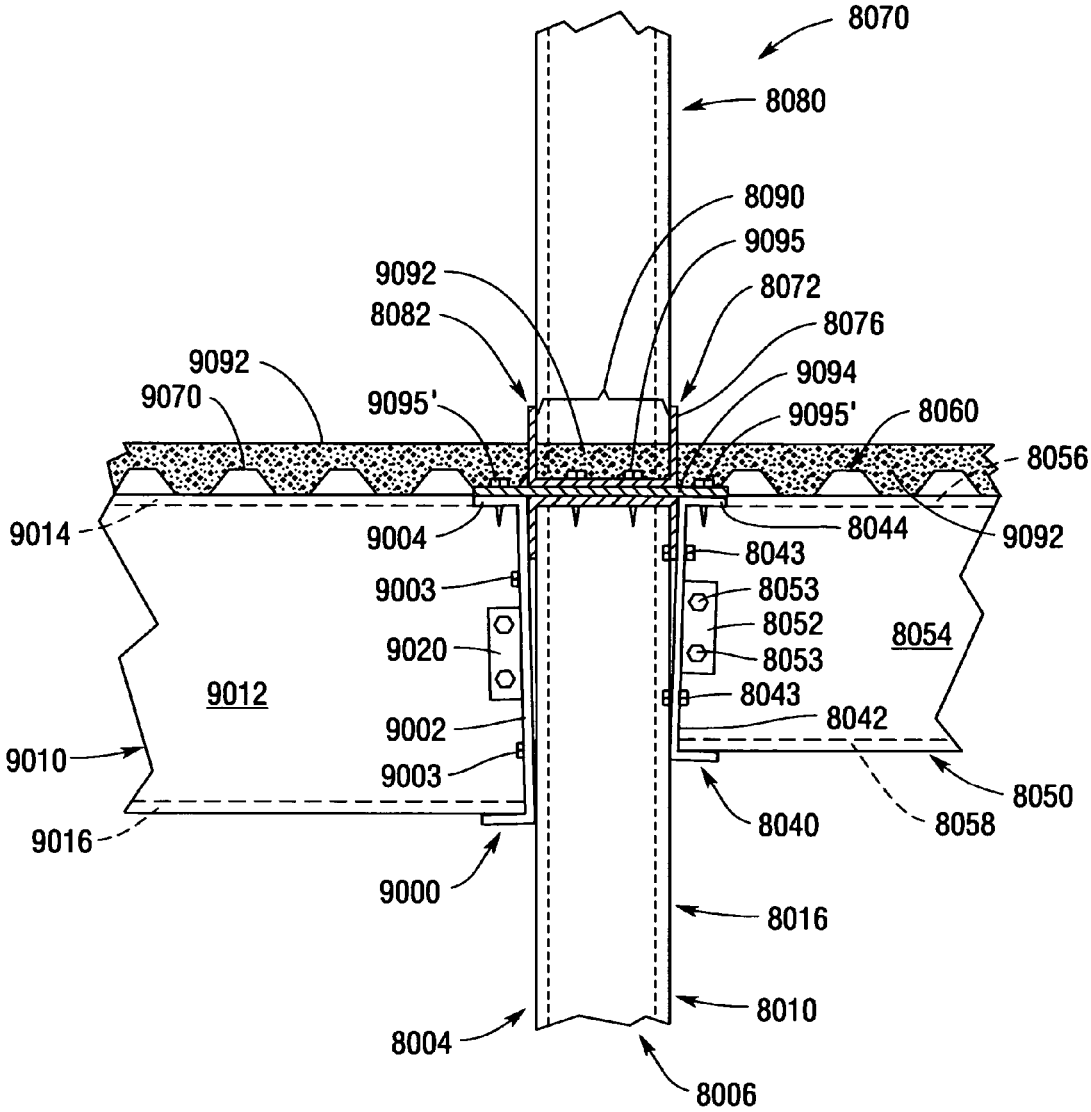
FIG. 52 is a partial view of another embodiment of a wall and floor connection of the present invention with some of the elements shown in cross-section for clarity.

In another embodiment depicted in FIG. 52, a continuous shear transfer plate 9094, in the form of a steel plate or other rigid material, is interposed between the first upper track 8030 and the second bottom track 8072. Such transfer plate 9094 may be attached by screws 9095 that extend through the web of the second bottom track 8072 and the web of the first upper track 8030 and, if desired, screws 9095' that extend through the transfer plate 9094 and the upper leg 8044 of the first joist rim 8040 and the upper leg 9004 of the second joist rim 9000. Bolts or rivets could also be used. The use of such a transfer plate serves to prevent the second studs 8080 from punching through the web 8074 of the second bottom track 8072 and the first top track 8030 and also serves to improve the continuity between the first and second floor portions formed by the first and second decking materials. If desired, another shear transfer plate 9094 may be interposed between the third top track 9050 and the fourth bottom track 9082.

Figure 53:
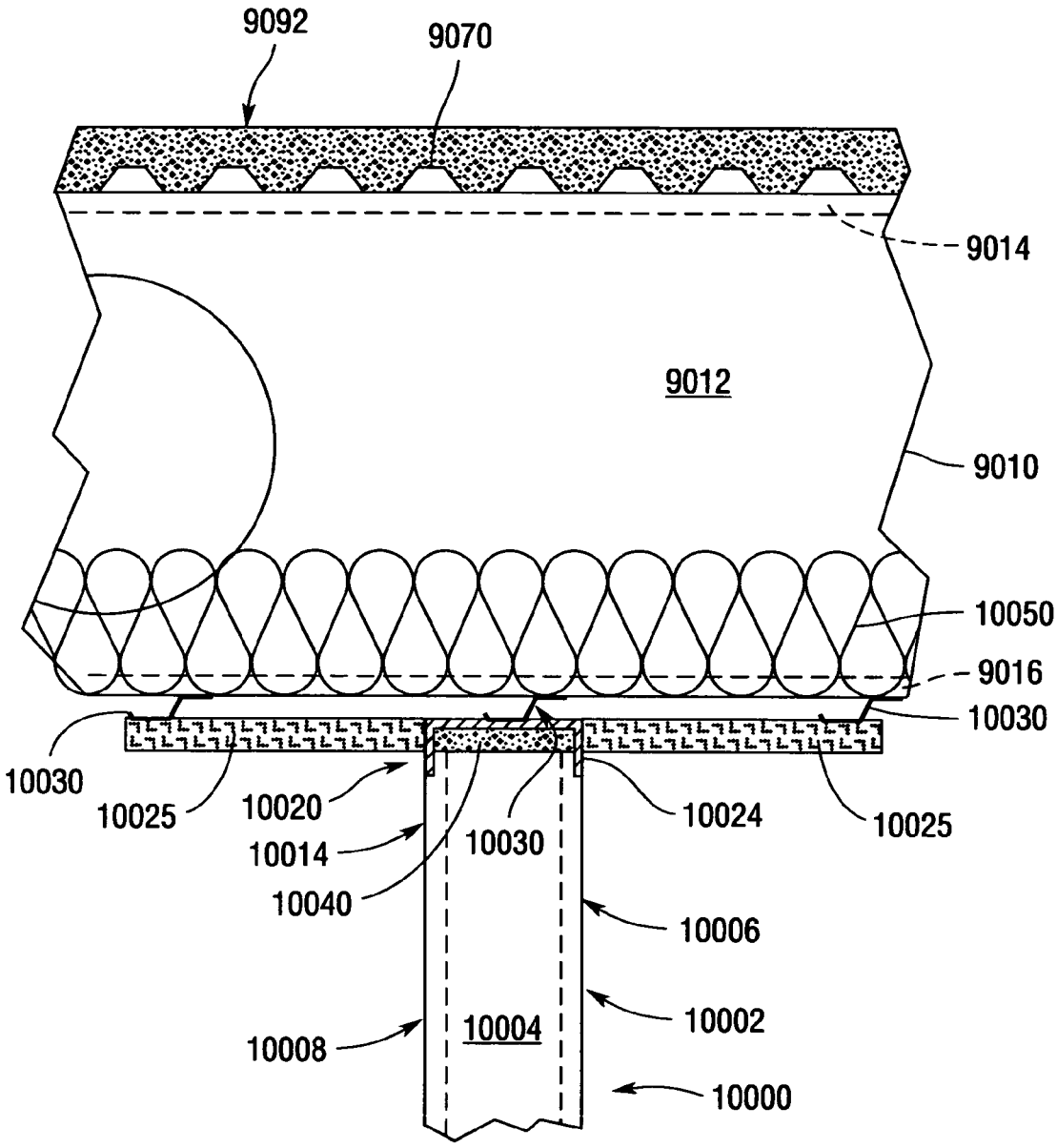
FIG. 53 is a partial view of another embodiment of a wall and floor connection of the present invention with some of the elements shown in cross-section for clarity.

A fifth interior wall, generally designated as 10000 is depicted in FIG. 53. Fifth wall 10000 may comprise a series of fifth studs 10002 that each has a web 10004 and a first leg 10006 and a second leg 10008. The bottom end portions 10010 of the fifth studs 10002 are received in a fifth bottom track 10012 that is attached to the support structure 8002. See FIG. 47. The upper end portions 10014 of studs 10002 are received in an upper track 10020 that has a web portion 10022 and two legs 10024. In this embodiment, the web 10022 may be attached to corresponding lower legs 9016 of joists 9010 by commercially available resilient members 10030 which facilitate movement of the fifth wall 10000 relative to the joists 9010 and also improve the sound deadening characteristics of the connection. To provide an additional fire barrier and improve the sound deadening characteristics of wall 10000, cementitious material may be placed between the web 10022 of the upper track 10020 and the top end portions 10004 of the fifth studs 10002. For example, pieces of commercially available cementitious board 10040 may be cut and placed in side the upper track 10020 as shown in FIG. 52. In one embodiment, that cementitious board manufactured by USG Corporation of Chicago, Ill. under the trademark AQUA-TOUGH®) is employed. As can also be seen in FIG. 52, commercially available insulation 10050 may be installed between the joists 9010. Also shown in FIG. 53 are pieces of ceiling boards 10025, such as gypsum or the like, that are attached to the corresponding lower legs 9016 of joists 9010 by commercially available resilient members 10030.

Figure 54:
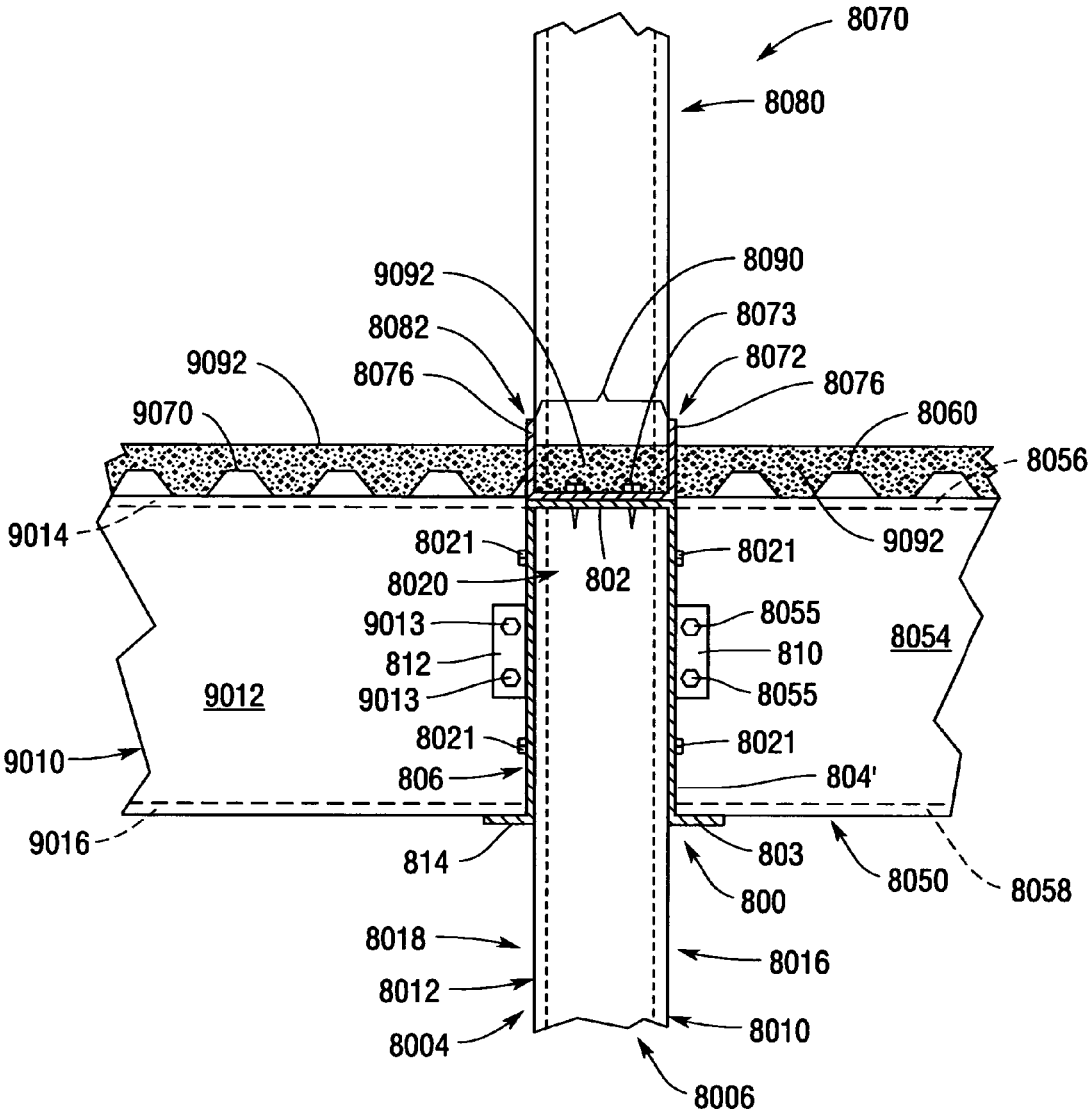
FIG. 54 is a partial view of another embodiment of a wall and floor connection of the present invention with some of the elements shown in cross-section for clarity.

FIG. 54 depicts another wall and floor arrangement of the present invention. As can be seen in that Figure, a joist rim/header 800 of the type described above may be employed. The joist rim header 800 has a first header flange 804 and a second header flange 806 that depend from a header web 802 in a spaced opposing relationship. The joist rim/header 800 may be fabricated from, for example, cold rolled galvanized steel or other suitable metal, the gauge of which may be dependent upon the amount and types of loads that the floor must support. The top end portions 8020 of the first studs 8006 may be supported between the first and second header flanges 804, 806 and attached thereto by, for example, screws 8021. However, rivets, bolts, welds etc. could be used. Thus, in this embodiment, the joist rim header 800 may replace the first top track 8030 or, if desired, the rim joist header 800 may be placed over a first top track 8030.

The first header flange 804 may be provided with a plurality of integrally formed first attachment tabs 810 for affixing the ends of the first floor joists 8050 thereto. The first attachment tabs 810 may be punched out of the first header flange 804 of the joist rim/header 800 at first predetermined intervals and may bent at a first predetermined angle relative to the first header flange 804. In one embodiment, the first predetermined intervals may be, for example, intervals of 8", 12", 16", 19.2" or 24" and the first predetermined angle may be, for example, 90°. Such arrangement also may result in the formation of first openings through the first header flange 804 of the joist rim/header 800. The first floor joists 8050 may be of the type and construction described above. The joist webs 8054 of the first floor joists 8050 may be attached to corresponding first attachment tabs 810 by appropriate fastening methods. For example, mechanical fasteners such as screws 8055 or the like may be employed in an appropriate number and configuration. However, it is conceivable that other fastening methods such as welding or bolting could be employed to affix the first floor joists 8050 to the first attachment tabs 810. Joist rim/header 800 may also be provided with a first lower leg 803 as shown in FIG. 54.

Also in this embodiment, the second header flange 806 may be provided with a plurality of integrally formed second attachment tabs 812 for affixing the ends of the second floor joists 9010 thereto. The second attachment tabs 812 may be punched out of the second header flange 804 of the joist rim/header 800 at second predetermined intervals and may bent at a second predetermined angle relative to the second header flange. In one embodiment, the second predetermined intervals may be, for example, intervals of 8", 12", 16", 19.2"

or 24" and the second predetermined angle may be, for example, 90°. Such arrangement also may result in the formation of second openings through the second header flange of the joist rim/header 800. The second floor joists 9010 may be of the type and construction described above. The joist webs 9012 of the second floor joists 9010 may be attached to corresponding second attachment tabs 812 by appropriate fastening methods. For example, mechanical fasteners such as screws 9013 or the like may be employed in an appropriate number and configuration. However, it is conceivable that other fastening methods such as welding or bolting could be employed to affix the second floor joists 9010 to the second attachment tabs 812. Joist rim/header 800 may also be provided with a second lower leg 814 as shown in FIG. 54.

A second bottom track 8072 of a second wall 8070 is supported on and attached to the header web 802 by conventional fasteners such as screws 8073, rivets or the like. Open areas 8090 are defined in the bottom track 8072 between the bottom end portions 8082 of the second studs 8080. If desired, a continuous shear plate of the type and construction described above may be interposed between the second bottom track 8072 and the header web 802 of the header 800 in the manner described above.

First and second decking materials 8060, 9070, such corrugated metal panels or the like are supported on and attached to the upper legs 8056, 9014 of the first and second joists 8050, 9010, respectively as was described above. The metal panels 8060, 9070 may be attached to the first and second joists 8050, 9010, respectively by conventional means such as screws, rivets, welding, etc. A slurry of cementitious material 9092 is placed on the first and second decking materials 8060, 9070 and in the open areas 8090 and leveled to form the first and second floor surfaces.

Figure 55:
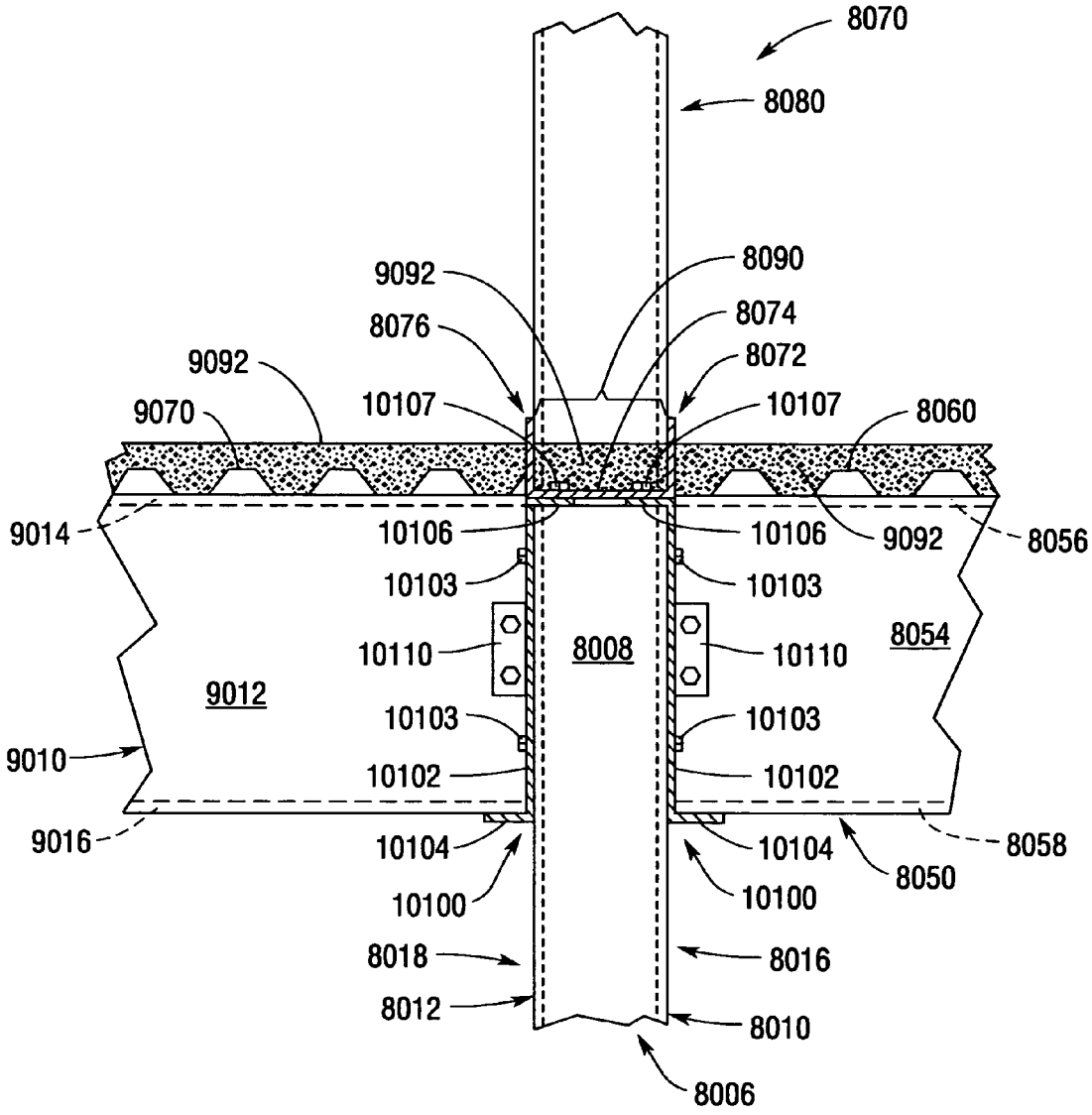
FIG. 55 is a partial view of another embodiment of a wall and floor connection of the present invention with some of the elements shown in cross-section for clarity.

FIG. 55 depicts the use of alternative joist rims 10100 that are each substantially "Z"-shaped when viewed from one of the ends. Each joist rim 10100 has a web 10102, a lower leg 10104 and an upper leg 10106. The lower leg 10104 protrudes from a first side of the web 10102 and the upper leg protrudes from a second side of the web 10102. The upper legs 10106 may be sized such that when installed as shown in FIG. 54, the upper legs 10106 either abut each other or a small space is provided therebetween such that the top end portions 8020 of the first studs 8006 may be received between their respective webs 10102. The first and second legs 8010, 8012 of the first studs 8006 may be attached to the webs 10102 by screws 10103, rivets, etc. The web 8074 of the second bottom track 8072 of the second wall 8070 may be supported on and attached to upper legs 10106 as shown utilizing conventional fasteners such as screws 10107, rivets, etc. The second wall 8070 may otherwise be fabricated as describe above. Open areas 8090 are defined in the bottom track 8072 between the bottom end portions 8082 of the second studs 8080. If desired, a continuous transfer shear plate of the type and construction describe above may be interposed between the web 8074 of the second bottom track 8072 and the upper legs 10106 of the joist rims 10100 and attached in the manner described above.

Figure 55A:
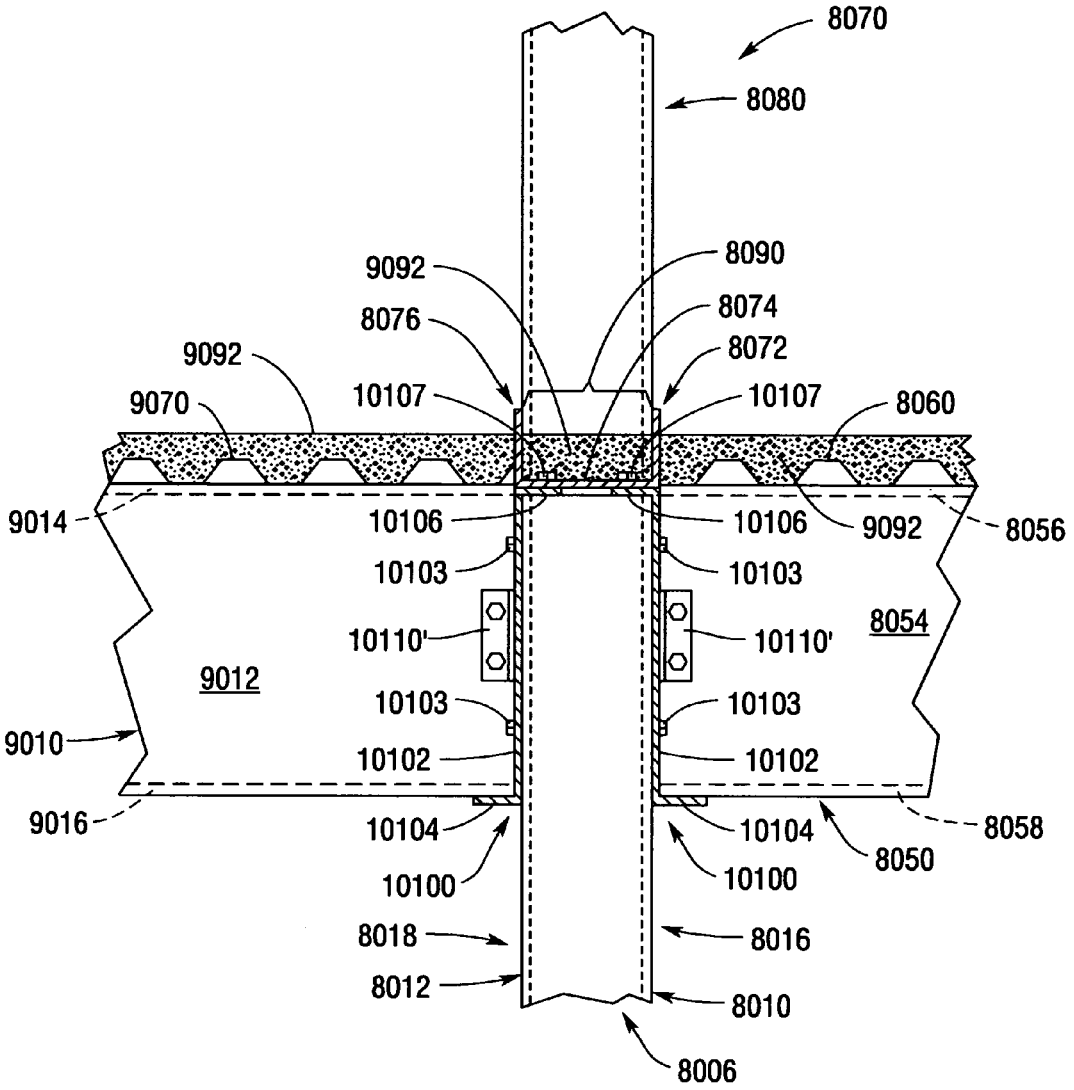
FIG. 55A is a partial view of another embodiment of a wall and floor connection of the present invention with some of the elements shown in cross-section for clarity.

The first and second joists 8050, 9010 may be attached to the joist rims 10100, by integral tabs 10110 formed in the webs 10102 of the joist rims 10100. The tabs 10110 may be attached to the webs 8054 of the first joists 8050 and the webs 9012 of the second joists 90101 by screws 10111 or other suitable fasteners. In an alternative embodiment, the first and second joists 8050, 9010, respectively may be attached to the webs 10102 of the joist 10100 rims by conventional L-clips 10110' and bolts 10111'. However, screws, rivets, welds, etc. could also be used. See FIG. 55A. First and second decking material 8060, 9070, respectively is supported on the first and second joists 8050, 9010, respectively and attached thereto by screws, bolts, rivets, welding, etc. Cementitious material 9092 is placed on the first and second decking material 8060, 9070 and in the open areas 8090 as described above. The cementitious material is leveled to form first and second floor surfaces.

Figure 56:
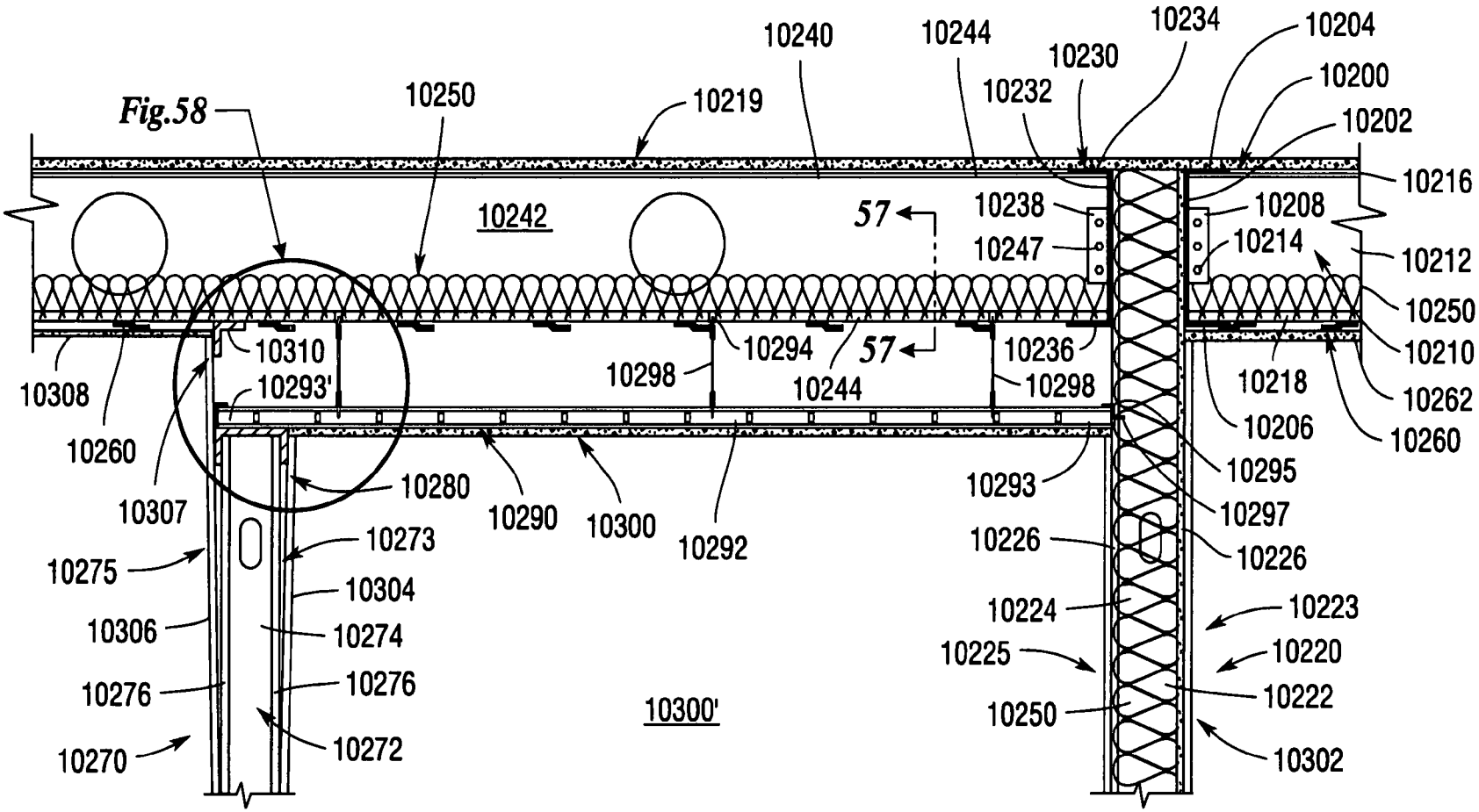
FIG. 56 is a side view of a portion of a wall and ceiling embodiment of the present invention.
Figure 58:
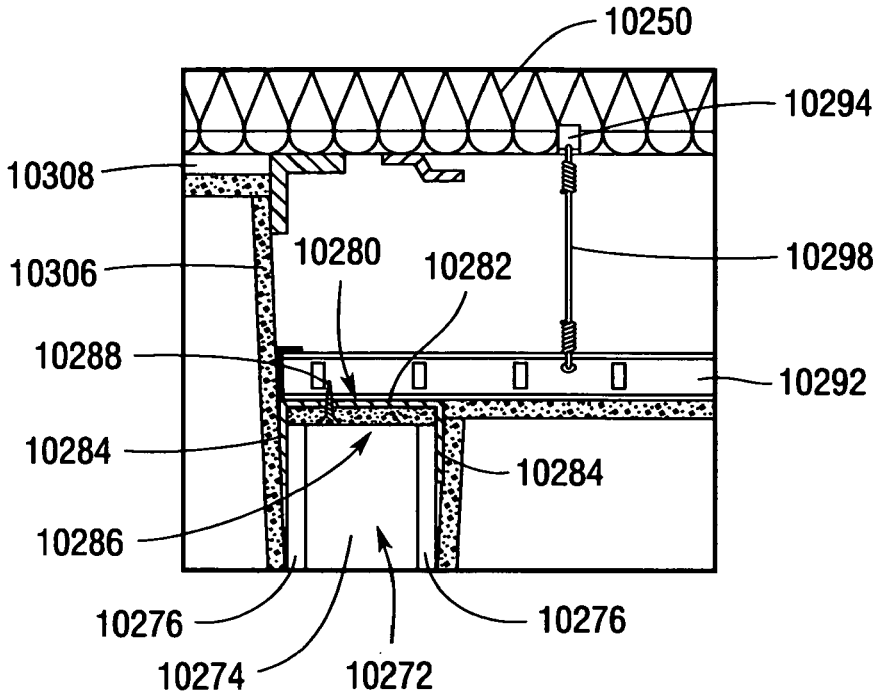
FIG. 58 is an enlarged view of a portion of the ceiling and wall detail of FIG. 56, the location of which is indicated in FIG. 56.
Figure 57:
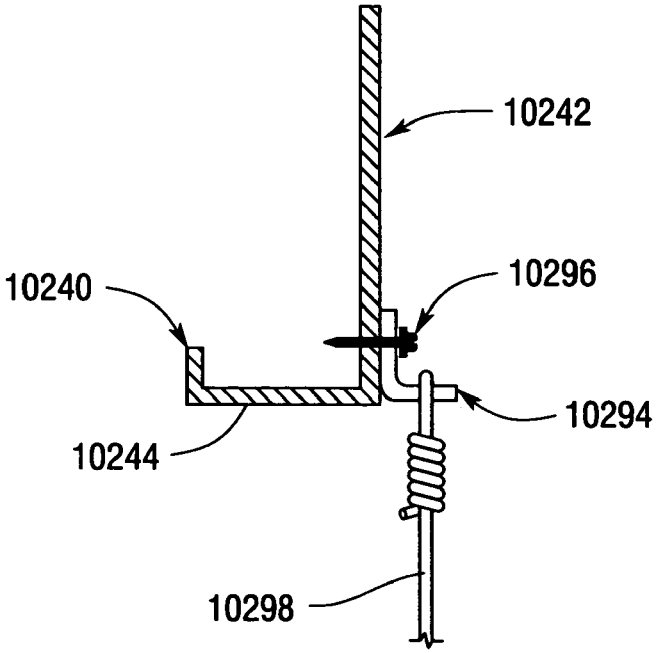
FIG. 57 is a partial cross-sectional view of the second joists and hanger arrangement taken along line 57-57 in FIG. 56.

Another embodiment of the present invention is depicted in FIGS. 56-58. As can be seen in those Figures, the embodiment includes a first rim joist 10200 which may be of the type and construction described above. The first rim joist 10200 has a first rim joist web 10202, a first rim joist upper leg 10204 and a first rim joist lower leg 10206. A plurality of first rim joist attachment tabs 10208 are integrally formed in the first rim joist web 10202 for attaching first joists 10210 to the first rim joist 10200. In the alternative, separate L-clips may be affixed to the first rim joist web 10202 for affixing a series of first joists 10210 to the first rim joist 10200. In the embodiment depicted in FIG. 56, the first rim joist attachment tab 10208 may be attached to the web 10212 of a corresponding first joist 10210 by screws 10214 or other suitable fasteners such as bolts, rivets, welds, etc. Each first joist 10210 has a first upper joist leg 10216 and a first lower joist leg 10218 and such first joists 10210 collectively form a portion of a support structure for a floorboard 10219. In one embodiment, the floorboard 10219 comprises ¾" cementitious sheathing that may be attached to the upper legs 10216 of the first joists 10210.

The web 10202 of the first rim joist 10200 is attached to a vertical wall assembly 10220. In one embodiment, the wall assembly 10220 includes a series of vertically extending first studs 10222 that each has a web 10224 and a pair of legs 10226. Each first stud 10222 has a first side 10223 and a second side 10225. The first rim joist web 10202 is attached to the legs 10226 of at least some of the first studs 10222 on the first side 10223 thereof by appropriately sized fasteners such as bolts, screws, rivets, welds, etc. Also in this embodiment, a second rim joist 10230 is attached to at least some of the legs 10226 of the first studs 10222 along the second side 10225 thereof as shown in FIG. 56.

As can be seen in FIG. 56, the second rim joist 10230 has a web 10232, an upper leg 10234 and a lower leg 10236. In one embodiment, a series of attachment tabs 10238 are formed along the length of the second rim joist web 10232 for attaching a series of second joists 10240 thereto. In an alternative embodiment, separate L-shaped clips may be attached to the second rim joist web 10232 by screws or other suitable fasteners for affixing the second joists 10240 thereto. Each second joist 10240 has a second joist web 10242, a second joist upper leg 10244 and a second joist lower leg 10246. The second rim joist attachment tabs 10238 may be attached to the second joist web 10242 of a corresponding second joist 10240 by screws 10247 or other suitable fasteners such as bolts, rivets, welds, etc. As can be seen in FIG. 56, the floorboard 10219 is also supported on and attached to the upper legs 10244 of the second joists 10240.

As can also be seen in FIG. 56, insulation 10250, such as 3½" commercially available fiberglass insulation may be employed in the first vertical wall assembly 10220, and in the first joists 10210 and the second joists 10240. To form a ceiling in the area under the first joists, first ceiling panel material 10262 may be attached to the lower legs 10218 of the first joists 10210. In the embodiment depicted in FIG. 56, the first ceiling panel material 10262 is attached to the lower legs 10218 of the first joists 10210 by a series of commercially available resilient connectors/furring strips 10260. In one embodiment, the first ceiling panel material 10262 may comprise, for example, ⅝" fire-rated gypsum wallboard.

In this embodiment, the first vertical wall assembly 10220 is load bearing. However, the unique and novel features of the present invention may be effectively used with a variety of non-load bearing wall arrangements. FIGS. 56-58 illustrate the use of a non-load bearing wall assembly 10270 in connection with a commercially available drywall grid system 10290. As can be seen in FIG. 56, the second wall assembly 10270 is spaced from the first wall assembly 10220 and cooperates with the drywall grid system 10290 to define an interior room designated as 10300'. In one embodiment, for example, the interior room could comprise a bathroom.

Drywall grid systems are known in the art and are used to form suspended ceiling arrangements. As can be seen in FIGS. 56 and 57, the drywall grid assembly 10290 comprises a series of support struts 10292 that are interconnected with cross struts (not shown) and which are suspended from the lower legs 10244 of the second joists 10240. In one embodiment, as illustrated in FIG. 57, a series of ceiling clips 10294, such as those manufactured by Hilti, Inc. of Tulsa, Okla. under Model No. CC27 may be used to fasten hanger wires 10298 to the second floor joists 10240. However, other clips or arrangements could conceivably be used. The ceiling clips 10294 are attached to the webs 10242 of the second joists 10240, by screws 1296, bolts, rivets, welds, etc. A hanger wire 10298 is attached to each ceiling clip 10294 and a corresponding strut 10292 to suspend the struts 10292 from the second floor joists 10240. The hanger wire 10298 may comprise, for example, W/12 SWG galvanized steel wire. However, other types of wires, chains, etc. could conceivably be employed.

As illustrated in FIG. 56, the ends 10293 of the struts 10292 may be received in a cross strut 10295 that is attached to at least some of the legs 10226 of the first studs 10222 along the second side 10225 thereof by appropriate fasteners 10297, such as screws, bolts, rivets, etc. The other ends 10293' of the struts 10292 are supported on a second vertical wall 10270 that is non-load bearing. As can be seen in FIGS. 56 and 58, the second vertical wall 10270 may be fabricated from a series of vertically extending second studs 10272 that are attached to an upper track 10280 and a lower track (not show) which is attached to the support structure (floor, concrete slab, wall, etc.) below. The second studs 10272 each have a web 10274 and a pair of legs 10276. Each second studs has a primary side 10273 and a secondary side 10275. See FIG. 56. The upper track 10280 has a web 10282 and a pair of legs 10284. The upper track 10280 is sized such that the upper ends of the studs 10272 may be received between the legs 10284 of the upper track 10280 as shown in FIG. 58. Also in this embodiment, cementitious board 10286 is placed between the upper ends of the studs 10272 and the web 10282 of the upper track 10280 and is attached thereto by fasteners 10288 such as screws or the like. See FIG. 58. The legs 10282 of the upper track 10280 are attached to the corresponding legs 10276 of the studs 10272, by screws, rivets, bolts, etc.

To complete the interior space formed by the first vertical wall 10220, the second vertical wall 10270 and the grid system 10290, drywall material 10300 is suspended by the grid system 10290 in a known manner. In one embodiment, the drywall material 10300 may comprise ⅝" fire-rated gypsum board. Also in this embodiment, first wallboard material 10302 is attached to at least some of the legs 10226 of the first studs 10222 along the first side 10223 thereof. Such first wallboard material 10302 may comprise ⅝" gypsum board. Likewise, second wallboard material 10303 is attached to at least some of the legs 10226 of the first studs 10222 along the second side 10225 thereof. The second wallboard material 10303 may comprise ⅝" gypsum board. A primary wallboard 10304 is attached to at least some of the legs 10276 of the second studs 10272 along the primary side 10273 thereof and secondary wallboard material 10306 is attached to at least some of the legs 10276 of the second studs 10272 along the secondary side 10275 thereof. Because the ceiling is higher on one side of the second vertical wall 10270, the secondary wallboard material 10306 has an upper end 10307 that extend to contact or be in close proximity to the second ceiling panel material 10308 attached to at least some of the lower legs 10244 of the second joists 10240 as shown in FIG. 56. To provide support for the upper ends of the wallboard panels 10306 and 10308, a continuous piece of angle 10310 or other lateral support member may be attached to the lower legs 10244 of the second joists 10240 by appropriate fasteners screws (not shown) or by bolting, welding, etc.

The various embodiments of the present invention provide vastly improved approaches for fabricating wall and floor arrangements for multistory structures. In particular, the various embodiments of the present invention described above provide improved fire barriers between respective floors. Also, various embodiments of the present invention provide improved sound deadening characteristics between adjacent floors when compared to prior construction arrangements.

Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A wall and floor construction, comprising:

a support structure;

a plurality of vertically extending first studs supported on the support structure the first studs each having a top end portion received in an upper wall track and define a first wall side and a second wall side;

a vertically extending first rim web of a first joist rim attached to a plurality of the vertically extending first studs on the first wall side such that said first joist rim is oriented at a desired distance above the support structure;

a plurality of first joists coupled to the first joist rim;

first decking material supported on the plurality of first joists;

a bottom wall track having a web and two upstanding legs, the bottom web supported on the upper wall track;

a plurality of vertically extending second studs each having a bottom end received in the bottom wall track and being attached thereto, the ends of said vertically extending second studs being spaced from each other to define open areas between the bottom ends of the spaced second studs and the web and legs of the bottom track; and a cementitious material on the first decking and in the open areas to form a floor surface on the first decking material and a barrier in the open areas.

2. The wall and floor construction of claim 1 wherein the plurality of first joists are each attached to the vertically extending first rim web of the first joist rim by a corresponding first rim tab integrally formed therein.

3. The wall and floor construction of claim 2 wherein:

each of the first joists comprises:

a first joist web;

a first joist upper leg protruding from the first joist web; and a first joist lower leg protruding from the first joist web and wherein the first joist rim further comprises:

a first upper rim leg protruding from the first rim web;

a first lower rim leg protruding from the first rim web; and a plurality of first rim tabs integrally formed and reinforced in the first rim web corresponding to the first joists for attachment to the first joist webs thereof.

4. The wall and floor construction of claim 1 wherein the first decking material comprises corrugated metal panels.

5. The wall and floor construction of claim 1 further comprising a continuous shear transfer plate interposed between the upper wall track and the bottom wall track.

6. The wall and floor construction of claim 1 further comprising:

a first angle coupled to a plurality of the vertically extending first studs and the first joist rim; and a shear wall panel attached to a plurality of the vertically extending first studs on the first wall side and being further attached to the first angle.

7. The wall and floor construction of claim 1 further comprising:

a vertically extending second rim web of a second joist rim attached to a plurality of the vertically extending first studs on the second wall side and being oriented at the desired distance above the support structure;

a plurality of second joists coupled to the second joist rim; and second decking material supported on the plurality of second joists wherein the cementitious material is also applied onto the second decking material to form another floor surface on the second decking material.

8. The wall and floor construction of claim 7 wherein the plurality of second joists are each attached to the second rim web of the second joist rim by a corresponding second rim tab integrally formed therein.

9. The wall and floor construction of claim 7 wherein:

each of the second joists comprises:

a second joist web;

a second upper joist leg protruding from the second joist web; and a second lower joist leg protruding from the second joist web and wherein the second joist rim further comprises:

a second upper rim leg protruding from the second rim web;

a second lower rim leg protruding from the second rim web; and a plurality of second rim tabs integrally formed and reinforced in the second rim web and corresponding to the second joists for attachment to the second joist webs thereof.

10. The wall and floor construction of claim 7 wherein the first and second decking materials each comprise corrugated metal panels.

11. The wall and floor construction of claim 7 further comprising a continuous shear transfer plate interposed between the upper wall track and the bottom wall track.

12. The wall and floor construction of claim 7 wherein the plurality of second joists are each attached to the second rim web of the second joist rim by a corresponding second clip angle.

13. The wall and floor construction of claim 1 wherein the plurality of first joists are each attached to the vertically extending first rim web of the first joist rim by a corresponding first clip angle.

14. A wall and floor construction, comprising:

a support structure;

a plurality of vertically extending first studs supported on the support structure and each having a top end portion and defining a first wall side and a second wall side;

a first joist rim comprising:

a first rim web attached to top portions of the vertically extending first studs on the first wall side thereof;

a first bottom rim leg protruding from one the of the first rim web; and a first top rim leg protruding from another side of the first rim web and extending over a portion of the top end portions of the first studs such that said first joist rim has a Z-shaped cross-sectional shape;

a plurality of first joists coupled to the first rim web;

a second joist rim comprising:

a second rim web attached to said top end portions of the vertically extending first studs on the second wall side thereof;

a second bottom rim leg protruding from one side of the second rim web; and a second top rim leg protruding from another side of the second rim web and extending over another portion of the top end portions of the first studs such that said second joist rim has a Z-shaped cross-sectional shape;

a plurality of second joists coupled to the second rim web;

first decking material supported on the plurality of first joists;

a bottom wall track having a bottom web and two upstanding legs, the bottom web supported on the first top rim leg and the second top rim leg;

a plurality of vertically extending second studs each having a bottom end received in the bottom wall track and being attached thereto, the ends of the vertically extending second studs being spaced from each other to define open areas between the bottom ends of the spaced second studs and the web and legs of the bottom track;

second decking material supported on the plurality of second joists; and a cementitious material on the first decking material, the second decking material and in said open areas to define coplanar first and second floor surfaces.

15. The wall and floor construction of claim 14 wherein the plurality of first joists are each attached to the first rim web by a corresponding first tab integrally formed in the first rim web and wherein each of the second joists are attached to the second rim web by a corresponding second tab integrally formed in the second rim web.

16. The wall and floor construction of claim 14 wherein the first and second decking materials comprise corrugated metal panels.

17. The wall and floor construction of claim 14 further comprising a continuous shear transfer plate interposed between the first and second top legs and the bottom wall track.

18. The wall and floor construction of claim 14 wherein the plurality of first joists are each attached to the first rim web by a corresponding first clip angle and wherein each of the second joists are attached to the second rim web by a corresponding second clip angle.

19. A wall and floor arrangement, comprising:

a plurality of vertically extending first studs forming a first wall structure, each said vertically extending studs having a first side and a second side;

a first rim joist having a first rim joist web and a first rim joist upper leg and a first rim joist lower leg, the first rim joist web attached to said plurality of vertically extending studs on said first side thereof such that said first rim joist upper leg is substantially co-planar with upper ends of said plurality of vertically extending studs;

a plurality of first joists coupled to said first rim joist web, each said first joist having a first joist web and a first joist upper leg and a first joist lower leg;

a second rim joist having a second rim joist web and a second rim joist upper leg and a second rim joist lower leg, the second rim joist web attached to said plurality of vertically extending studs on said second side thereof such that said second rim joist upper leg is substantially co-planar with upper ends of said plurality of vertically extending studs and said first rim joist upper leg;

a plurality of second joists coupled to said second rim joist web, each said second joist having a second joist web and a second joist upper leg and a second joist lower leg; and cementitious floor panels supported on said upper legs of said first joists, said first rim joist upper leg, said upper ends of said plurality of vertically extending studs, said second rim joist upper leg and said upper legs of said second joists.

20. The wall and floor arrangement of claim 19 further comprising:

first ceiling panel material attached to said lower legs of said first joists;

second ceiling panel material attached to said lower legs of said second joists;

first wallboard material attached to a plurality of said plurality of said first vertically extending studs on said first side thereof;

second wallboard material attached to a plurality of said plurality of said first vertically extending studs on said second side thereof;

a plurality of second vertically extending studs forming a second wall structure spaced from said first wall structure, said plurality of second vertically extending studs having a primary side and a secondary side;

a drywall grid system attached to at least some of said plurality of first vertically extending studs on said second side thereof and to at least some of said second vertical wall studs on said primary side thereof and extending between said first and second wall structure;

drywall material supported by said drywall grid system to form a ceiling of an interior space between said first and second wall structures;

primary wallboard material attached to at least some of said second vertical studs on said primary side thereof; and secondary wallboard material attached to at least some of said second vertical studs on said second side thereof, said secondary wall board material having an upper end that extends to said second ceiling panel material.

21. The wall and floor arrangement of claim 20 further comprising a support member attached to the lower legs of a plurality of said second joists for providing lateral support to said upper end of said secondary wallboard material.

22. The wall and floor arrangement of claim 21 wherein said support member comprises a steel angle.

23. The wall and floor arrangement of claim 20 wherein said first ceiling panel material is attached to said lower legs of said first joists by a plurality of resilient first members and wherein said second ceiling panel material is attached to said lower legs of said second joists by a plurality of second resilient members.

24. The wall and floor arrangement of claim 20 wherein said plurality of second vertically extending studs each have an upper end that is attached to an upper track member that has an upper track member web and a paid of upper track member legs.

25. The wall and floor structure of claim 24 further comprising cementitious material between said upper ends of said plurality of said second vertically extending studs and said upper track member web.

26. A wall and floor construction, comprising:

a support structure;

a plurality of vertically extending first studs supported on the support structure and each having a top end portion and defining a first wall side and a second wall side;

a header comprising:

a first header flange having a first horizontally extending rim flange protruding therefrom;

a second header flange; and a top header web connected to said first and second header flanges and extending therebetween to define an area for receiving the top end portions of the first studs therein, the top end portions of the first studs being coupled the first and second header flanges;

a plurality of first joists coupled to the first header flange;

first decking material supported on the plurality of first joists;

a bottom wall track having a web and two upstanding legs, the web supported on the top header web of the header;

a plurality of vertically extending second studs each having a bottom end received in the bottom wall track and attached to the upstanding legs thereof, the bottom ends of the vertically extending second studs being spaced from each other to define open areas between the bottom ends of the spaced second studs and the web and the upstanding legs of the bottom wall track; and a cementitious material on the first decking material and in the open areas to define a barrier in the open areas and a first floor surface on the first decking materials.

27. The wall and floor construction of claim 26 wherein the first decking material comprises corrugated metal panels.

28. The wall and floor construction of claim 26 further comprising:

a plurality of second joists coupled to the second header flange; and second decking material supported on the plurality of second joists and wherein the cementitious material is also applied onto the second decking material to form a second floor surface thereon.

29. The wall and floor construction of claim 28 further comprising a second horizontally extending rim flange protruding from the second header flange.

30. The wall and floor construction of claim 28 wherein the plurality of second joists are each attached to the second header flange by a corresponding second tab integrally formed in the second header flange.

31. The wall and floor construction of claim 28 wherein the first and second decking materials comprise corrugated metal panels.

32. A wall and floor construction, comprising:

a support structure;

a plurality of vertically extending first studs supported on the support structure and each having a top end portion and defining a first wall side and a second wall side;

a header comprising:

a first header flange;

a second header flange; and a top header web connected to said first and second header flanges and extending therebetween to define an area for receiving the top end portions of the first studs therein, the top end portions of the first studs being coupled the first and second header flanges;

a plurality of first joists, each said first joist attached to the header by a corresponding first tab integrally formed in the first header flange;

first decking material supported on the plurality of first joists;

a bottom wall track having a web and two upstanding legs, the web supported on the top header web of the header;

a plurality of vertically extending second studs each having a bottom end received in the bottom wall track and attached to the upstanding legs thereof, the bottom ends of the vertically extending second studs being spaced from each other to define open areas between the bottom ends of the spaced second studs and the web and the upstanding legs of the bottom wall track; and a cementitious material on the first decking material and in the open areas to define a barrier in the open areas and a first floor surface on the first decking materials.

33. The wall and floor construction of claim 32 wherein the first decking material comprises corrugated metal panels.

34. The wall and floor construction of claim 32 further comprising:

a plurality of second joists coupled to the second header flange; and second decking material supported on the plurality of second joists and wherein the cementitious material is also applied onto the second decking material to form a second floor surface thereon.

35. The wall and floor construction of claim 34 further comprising a second horizontally extending rim flange protruding from the second header flange.

36. The wall and floor construction of claim 34 wherein the plurality of second joists are each attached to the second header flange by a corresponding second tab integrally formed in the second header flange.

37. The wall and floor construction of claim 34 wherein the first and second decking materials comprise corrugated metal panels.

* * * * *